US008758117B2

(12) United States Patent
Nicely et al.

(10) Patent No.: US 8,758,117 B2
(45) **Date of Patent: *Jun. 24, 2014**

(54) GAMING SYSTEM, GAMING DEVICE AND METHOD OF PROVIDING SELECTION GAME WITH INTERDEPENDENT AWARD DISTRIBUTION

(75) Inventors: Mark C. Nicely, Daly City, CA (US); Binh T. Nguyen, Reno, NV (US); Bryan D. Wolf, Reno, NV (US); Paul D. Miltenberger, San Francisco, CA (US); Scott A. Caputo, Santa Clara, CA (US)

(73) Assignee: IGT, Las Vegas, NV (US)

( * ) Notice: Subject to any disclaimer, the term of this patent is extended or adjusted under 35 U.S.C. 154(b) by 275 days.

This patent is subject to a terminal disclaimer.

(21) Appl. No.: 13/295,716

(22) Filed: Nov. 14, 2011

(65) Prior Publication Data

US 2012/0071232 A1 Mar. 22, 2012

Related U.S. Application Data

(63) Continuation of application No. 12/196,800, filed on Aug. 22, 2008, now Pat. No. 8,079,903.

(51) Int. Cl.
*G07F 17/32* (2006.01)

(52) U.S. Cl.
USPC ..... 463/20; 463/16; 463/25

(58) Field of Classification Search
USPC ..... 463/16–20, 25–29
See application file for complete search history.

(56) References Cited

U.S. PATENT DOCUMENTS 3,167,313 A 1/1965 Davenport et al.
4,003,578 A 1/1977 Jones
4,103,895 A 8/1978 Pressman et al.
4,182,515 A 1/1980 Nemeth
4,277,067 A 7/1981 Gettleman
4,323,242 A 4/1982 Rosenfeld (Continued)

FOREIGN PATENT DOCUMENTS

EP 0 945 837 9/1999
EP 1 199 689 4/2002

(Continued)

OTHER PUBLICATIONS

Article entitled "Battle Plan" in Strictly Slots, published Sep. 2000.

(Continued)

*Primary Examiner* — Omkar Deodhar
(74) *Attorney, Agent, or Firm* — Neal, Gerber & Eisenberg LLP

(57) ABSTRACT

The disclosed gaming system, gaming device and method provide a selection game having a plurality of selectable positions and a plurality of awards interdependently distributed or associated with the selectable positions. For one, a plurality, or all the selectable positions, the award associated with such selectable position is interdependent in that such award has a relationship to one or more of the awards associated with the selectable positions bordering such position. In various embodiments, the value of the award associated with such selectable position has a relationship to one or more of the values of the awards associated with the selectable positions bordering such position. Based on these interdependencies, when each of the selectable positions is selected, the award, or value of the award, associated with the position provides certain information which can be subsequently used to make better informed position selections.

55 Claims, 53 Drawing Sheets

(56) References Cited

U.S. PATENT DOCUMENTS 4,511,143 A 4/1985 Sankrithi
4,850,592 A 7/1989 Winter
5,083,800 A 1/1992 Lockton
5,178,395 A 1/1993 Lovell
5,333,868 A 8/1994 Goldfarb
5,355,442 A 10/1994 Paglieroni et al.
5,566,942 A 10/1996 Elum
5,611,730 A 3/1997 Weiss
5,664,998 A 9/1997 Seelig et al.
5,772,509 A 6/1998 Weiss
5,813,672 A 9/1998 Loud, Jr.
5,855,514 A 1/1999 Kamille
5,931,467 A 8/1999 Kamille
5,961,384 A 10/1999 Robinson
5,980,384 A 11/1999 Barrie
5,996,997 A 12/1999 Kamille
6,015,344 A 1/2000 Kelly et al.
6,015,346 A 1/2000 Bennett
6,089,976 A 7/2000 Schneider et al.
6,102,798 A 8/2000 Bennett
6,126,542 A 10/2000 Fier
6,134,556 A 10/2000 Shin
6,159,095 A 12/2000 Frohm et al.
6,254,481 B1 7/2001 Jaffe
6,261,177 B1 7/2001 Bennett
6,273,420 B1 8/2001 Brooks
6,309,299 B1 10/2001 Weiss
6,309,300 B1 10/2001 Glavich
6,315,660 B1 11/2001 DeMar et al.
6,315,664 B1 11/2001 Baerlocher et al.
6,319,124 B1 11/2001 Baerlocher et al.
6,328,649 B1 12/2001 Randall et al.
6,346,043 B1 2/2002 Collin et al.
6,347,996 B1 2/2002 Gilmore et al.
6,364,767 B1 4/2002 Brossard et al.
6,398,644 B1 6/2002 Perrie et al.
6,406,369 B1 6/2002 Baerlocher et al.
6,439,995 B1 8/2002 Hughs-Baird et al.
6,443,837 B1 9/2002 Jaffe et al.
6,450,883 B1 9/2002 O'Halloran
6,494,785 B1 12/2002 Gerrard et al.
6,511,375 B1 1/2003 Kaminkow
6,514,141 B1 2/2003 Kaminkow et al.
6,558,254 B2 5/2003 Baelocher et al.
6,572,469 B2 6/2003 Klitsner et al.
6,572,473 B1 6/2003 Baerlocher
6,582,307 B2 6/2003 Webb
6,589,117 B1 7/2003 Moritome et al.
6,595,854 B2 7/2003 Hughs-Baird et al.
6,599,185 B1 7/2003 Kaminkow et al.
6,602,136 B1 8/2003 Baerlocher et al.
6,602,137 B2 8/2003 Kaminkow et al.
6,607,438 B2 8/2003 Baerlocher et al.
6,632,141 B2 10/2003 Webb et al.
6,638,164 B2 10/2003 Randall et al.
6,656,040 B1 12/2003 Brosnan et al.
6,676,516 B2 1/2004 Baerlocher et al.
6,692,356 B2 2/2004 Baerlocher et al.
6,722,981 B2 4/2004 Kaminkow et al.
6,722,982 B2 4/2004 Kaminkow et al.
6,722,983 B2 4/2004 Kaminkow et al.
6,733,386 B2 5/2004 Cuddy et al.
6,743,096 B2 6/2004 Allendorf et al.
6,749,504 B2 6/2004 Hughs-Baird
6,758,747 B2 7/2004 Baerlocher
6,769,983 B2 8/2004 Slomiany
6,780,107 B2 8/2004 Baerlocher et al.
6,780,111 B2 8/2004 Cannon et al.
6,783,457 B2 8/2004 Hughs-Baird et al.
6,814,664 B2 11/2004 Baerlocher et al.
6,817,944 B2 11/2004 Kaminkow et al.
6,837,793 B2 1/2005 McClintic
6,843,722 B2 1/2005 Webb
6,863,606 B1 3/2005 Berg et al.
6,875,108 B1 4/2005 Hughs-Baird
6,899,620 B2 5/2005 Kaminkow et al.
6,913,533 B2 7/2005 Cuddy et al.
6,913,535 B2 7/2005 Kaminkow et al.
6,918,830 B2 7/2005 Baerlocher
6,932,701 B2 8/2005 Glavich et al.
6,958,013 B2 10/2005 Miereau et al.
6,966,833 B2 11/2005 Kaminkow et al.
6,995,751 B2 2/2006 Falvo
6,996,833 B1 2/2006 Olson et al.
7,037,191 B2 5/2006 Rodgers et al.
7,040,984 B2 5/2006 Mead
7,056,214 B2 6/2006 Miereau et al.
7,077,744 B2 7/2006 Cannon
7,104,888 B2 9/2006 Miereau et al.
7,112,137 B2 9/2006 Baerlocher et al.
7,121,942 B2 10/2006 Baerlocher
7,160,186 B2 1/2007 Cuddy et al.
7,160,188 B2 1/2007 Kaminkow et al.
7,172,506 B2 2/2007 Baerlocher et al.
7,175,523 B2 2/2007 Gilmore et al.
7,182,689 B2 2/2007 Hughs-Baird et al.
7,198,570 B2 4/2007 Rodgers et al.
7,220,180 B2 5/2007 Kaminkow et al.
7,235,011 B2 6/2007 Randall et al.
7,264,545 B2 9/2007 Maya et al.
7,270,604 B2 9/2007 Gerrard et al.
7,300,348 B2 11/2007 Kaminkow et al.
7,303,469 B2 12/2007 Kaminkow et al.
7,311,598 B2 12/2007 Kaminkow et al.
7,311,604 B2 12/2007 Kaminkow et al.
7,314,409 B2 1/2008 Maya et al.
7,318,773 B2 1/2008 Baerlocher
7,326,115 B2 2/2008 Baerlocher
7,338,367 B2 3/2008 Kaminkow et al.
7,338,369 B2 3/2008 Mierau et al.
7,566,272 B2 7/2009 Gerrard et al.
7,727,068 B2 6/2010 Peterson
7,887,409 B2 2/2011 Baerlocher et al.
2002/0052232 A1 5/2002 Kaminkow
2002/0183105 A1 12/2002 Cannon et al.
2003/0013514 A1 1/2003 Cregan et al.
2003/0036422 A1 2/2003 Baerlocher et al.
2003/0036424 A1 2/2003 Baerlocher
2003/0040358 A1 2/2003 Rothkranz et al.
2003/0064773 A1 4/2003 Baerlocher et al.
2003/0078096 A1 4/2003 Kaminkow et al.
2003/0153378 A1 8/2003 Schlegel et al.
2003/0157982 A1 8/2003 Gerrard et al.
2003/0162578 A1 8/2003 Baerlocher et al.
2004/0048644 A1 3/2004 Gerrard et al.
2004/0048649 A1 3/2004 Peterson et al.
2004/0053665 A1 3/2004 Baerlocher
2004/0176156 A1 9/2004 Walker et al.
2004/0242315 A1 12/2004 Paulsen et al.
2004/0248639 A1 12/2004 Slomiany
2005/0020351 A1 1/2005 Baerlocher et al.
2005/0033461 A1 2/2005 Gerrard et al.
2005/0054404 A1 3/2005 Baerlocher
2005/0054405 A1 3/2005 Baerlocher et al.
2005/0054415 A1 3/2005 Kaminkow et al.
2005/0054416 A1 3/2005 Hostetler et al.
2005/0054435 A1 3/2005 Rodgers et al.
2005/0059456 A1 3/2005 Mead et al.
2005/0059461 A1 3/2005 Ching et al.
2005/0064928 A1 3/2005 Baerlocher et al.
2005/0096114 A1 5/2005 Cannon et al.
2005/0096123 A1 5/2005 Cregan et al.
2005/0101372 A1 5/2005 Mierau et al.
2005/0181860 A1 8/2005 Nguyen et al.
2005/0192081 A1 9/2005 Marks et al.
2005/0197180 A1 9/2005 Kaminkow et al.
2005/0218591 A1 10/2005 Torigian et al.
2006/0030401 A1 2/2006 Mead et al.
2006/0068882 A1 3/2006 Baerlocher et al.
2006/0073874 A1 4/2006 Cregan et al.
2006/0084500 A1 4/2006 Baerlocher et al.
2006/0183528 A1 8/2006 Rodgers et al.
2006/0199628 A1 9/2006 Rodgers et al.
2006/0246977 A1 11/2006 Cannon

(56) References Cited

U.S. PATENT DOCUMENTS

| | | | |
|---|---|---|---|
| 2007/0015566 | A1 | 1/2007 | Baerlocher et al. |
| 2007/0032285 | A1 | 2/2007 | Wolf |
| 2007/0054732 | A1 | 3/2007 | Baerlocher |
| 2007/0060271 | A1 | 3/2007 | Cregan et al. |
| 2007/0060300 | A1 | 3/2007 | Baerlocher |
| 2007/0077990 | A1 | 4/2007 | Cuddy et al. |
| 2007/0087809 | A1 | 4/2007 | Baerlocher |
| 2007/0105620 | A1 | 5/2007 | Cuddy et al. |
| 2007/0111783 | A1 | 5/2007 | Cuddy et al. |
| 2007/0117606 | A1 | 5/2007 | Baerlocher et al. |
| 2007/0129131 | A1 | 6/2007 | Kaminkow et al. |
| 2007/0149269 | A1 | 6/2007 | Benbrahim |
| 2007/0155485 | A1 | 7/2007 | Cuddy et al. |
| 2007/0167211 | A1 | 7/2007 | Rodgers et al. |

FOREIGN PATENT DOCUMENTS

| | | | |
|---|---|---|---|
| EP | 1 298 607 | | 4/2003 |
| EP | 1 531 434 | | 5/2005 |
| EP | 1 764 753 | | 3/2007 |
| EP | 1 779 908 | | 5/2007 |
| GB | 2 097 160 | | 10/1982 |
| GB | 2 113 881 | | 8/2003 |
| JP | 2006-326041 | A | 12/2006 |
| JP | 2007-82821 | A | 4/2007 |
| WO | WO 97/32285 | | 9/1997 |
| WO | WO 00/12186 | | 3/2000 |
| WO | WO 01/74464 | | 10/2001 |
| WO | WO 03/026759 | | 4/2003 |
| WO | WO 03/049053 | | 6/2003 |
| WO | WO 2005/002697 | | 1/2005 |
| WO | WO 2005/015826 | | 2/2005 |
| WO | WO 2006/017036 | | 2/2006 |
| WO | WO 2006/017067 | | 2/2006 |
| WO | WO 2006/017068 | | 2/2006 |
| WO | WO 2007/021724 | | 2/2007 |
| WO | WO 2007/052549 | | 5/2007 |
| WO | WO 2007/103054 | | 9/2007 |
| WO | WO 2008/048634 | | 4/2008 |

OTHER PUBLICATIONS

Article entitled "Cash Box" in Strictly Slots, published Jul. 2000.
Article entitled "Cool Cat Cash" in Strictly Slots, published Jul. 2005.
Article entitled "Crazy Fruits" in Strictly Slots, published Apr. 2001.
Article entitled "Deviled Eggs" in Strictly Slots, published May 2005.
Article entitled "Hollywood Squares—Premier Night" in Strictly Slots, published 2005.
Article entitled "Men in Black" in Strictly Slots, published Apr. 2004.
Battleship (game), Wikipedia description, http://en.wikipedia.org/wiki/attleship_(game), website printed Jan. 29, 2008.
Battleship All Aboard, website description, Mikohn, website printed 2001.
Battleship instructions, Hasbro, published 2002.
Clue: The Great Museum Caper, Wikipedia description, http://en.wikipedia.org/wiki/Clue:_The_Great_Museum_Caper, website printed on Jan. 29, 2008.
Command & Conquer, Wikipedia description, http://en.wikipedia.org/wiki/Command_and_conquer, website printed Aug. 18, 2008.
Dig Dug, Wikipedia description, http//en.wikipedia.org/wiki/Dig_Dug, website printed on Jan. 29, 2008.
Its My Party advertisement, IGT, published 2004.
"Jeopardy", [online] [printed Dec. 1998] Retrieved from the Internet at <URL: www.absolute-playstation.com/appi_review/rjeop.html> (4 pages).
Jeopardy Advertisements written by IGT, published in 2000 (1 page).
Jeopardy Video Slots advertisement written by IGT, published in 2000 (2 pages).
Jeopardy, MegaJackpots Advertisement written by IGT, published in 1998 (1 page).
Minesweeper (computer game), Wikipedia description, http://en.wikipedia.org/wiki/Minesweeper_(compter_game), website printed Jul. 13, 2011 (8 pages).
Minesweeper (computer game), Wikipedia description, http://en.wikipedia.org/wiki/Minesweeper_(compter_game), website printed Jan. 29, 2008.
Radar Mission, Wikipedia description, http://en.wikipedia.org/wiki/Radar_Mission, website printed Aug. 18, 2008.
Stratego, Wikipedia description, http://en.wikipedia.org/wiki/Stratego, website printed on Sep. 3, 2008.
"The Jeopardy! Database of Champions", [online] [printed before Sep. of 2002] Retrieved from the Internet at <URL www.oddchange.com/doc/evrules.html> (3 pages).
Triple Double Dollars Video Slots advertisement, IGT, published 2004.
Third Party Submission in Published Application Under 37 C.F.R. 1.99 filed for U.S. Appl. No. 13/295,716, dated May 21, 2012 (2 pages).
English translation of Abstract and paragraph [0014] of JP 2007-82821A submitted with Third Party Submission in Published Application Under 37 C.F.R. § 1.99 for U.S. Appl. No. 13/295,716 (2 pages).
English translation of Abstract and paragraphs [0006] and [0034] of JP 2006-326041A submitted with Third Party Submission in Published Application Under 37 C.F.R. § 1.99 for U.S. Appl. No. 13/295,716 (2 pages).

FIG. 3A

90

| | | | | | | | | | |
|---|---|---|---|---|---|---|---|---|---|
| 5,000 | 4,000 | 3,000 | 2,000 | 500 | 100 | 100 | 50 | 50 | 50 |
| 4,000 | 4,000 | 3,000 | 2,000 | 500 | 100 | 100 | 100 | 50 | 50 |
| 3,000 | 3,000 | 3,000 | 2,000 | 500 | 100 | 500 | 1,000 | 500 | 50 |
| 2,000 | 2,000 | 2,000 | 2,000 | 500 | 100 | 500 | 2,000 | 500 | 50 |
| 500 | 500 | 500 | 500 | 500 | 100 | 500 | 1,000 | 500 | 50 |
| 100 | 100 | 100 | 100 | 100 | 100 | 100 | 500 | 500 | 50 |
| 100 | 100 | 100 | 100 | 100 | 100 | 100 | 100 | 100 | 50 |
| 50 | 50 | 50 | 200 | 200 | 200 | 300 | 500 | 1,000 | 1,000 |
| 50 | 50 | 100 | 200 | 300 | 300 | 500 | 500 | 1,000 | 2,000 |
| 50 | 50 | 50 | 100 | 500 | 500 | 1,000 | 1,000 | 1,000 | 10,000 |

92

| | |
|---|---|
| Total Available Award | 84,200 |
| Progressive Award | 84,200 |

FIG. 3B

90

| | | | | | | | | | |
|---|---|---|---|---|---|---|---|---|---|
| 5,200 | 4,200 | 3,200 | 2,200 | 700 | 300 | 300 | 250 | 250 | 250 |
| 4,200 | 4,200 | 3,200 | 2,200 | 700 | 300 | 300 | 300 | 250 | 250 |
| 3,200 | 3,200 | 3,200 | 2,200 | 700 | 300 | 700 | 1,200 | 700 | 250 |
| 2,200 | 2,200 | 2,200 | 2,200 | 700 | 300 | 700 | 2,200 | 700 | 250 |
| 700 | 700 | 700 | 700 | 700 | 300 | 700 | 1,200 | 700 | 250 |
| 300 | 300 | 300 | 300 | 300 | 300 | 300 | 700 | 700 | 250 |
| 300 | 300 | 300 | 300 | 300 | 300 | 300 | 300 | 300 | 250 |
| 250 | 250 | 250 | 400 | 400 | 400 | 500 | 700 | 1,200 | 1,200 |
| 250 | 250 | 300 | 400 | 500 | 500 | 700 | 700 | 1,200 | 2,200 |
| 250 | 250 | 250 | 300 | 700 | 700 | 1,200 | 1,200 | 1,200 | 10,200 |

92

| | |
|---|---|
| Total Available Award | 104,200 |
| Progressive Award | 104,200 |

FIG. 4G

16

| | a | b | c | d | e | f | g | h | i | j | k | l | m | n | o |
|---|---|---|---|---|---|---|---|---|---|---|---|---|---|---|---|
| 1 | 10 | 10 | 10 | 10 | 10 | 10 | 10 | 10 | 10 | 15 | 15 | 15 | 15 | 10 | 10 |
| 2 | 10 | 10 | 10 | 10 | 10 | 10 | 10 | 10 | 15 | 15 | 1000 | 1000 | 15 | 15 | 10 |
| 3 | 10 | 10 | 10 | 10 | 10 | 10 | 15 | 15 | 15 | 1000 | 1000 | 1200 | 1000 | 15 | 15 |
| 4 | 10 | 10 | 10 | 10 | 10 | 10 | 10 | 15 | 900 | 1200 | 1500 | 1500 | 1100 | 1000 | 15 |
| 5 | 10 | 10 | 10 | 10 | 10 | 10 | 10 | 15 | 15 | 1100 | 1200 | 1300 | 1000 | 15 | 15 |
| 6 | 10 | 10 | 10 | 15 | 15 | 15 | 15 | 15 | 15 | 15 | 900 | 900 | 15 | 15 | 10 |
| 7 | 10 | 10 | 15 | 15 | 7500 | 7700 | 6500 | 15 | 10 | 15 | 15 | 15 | 15 | 10 | 10 |
| 8 | 10 | 10 | 15 | 7700 | 7700 | 7800 | 15 | 15 | 10 | 10 | 10 | 10 | 10 | 10 | 10 |
| 9 | 10 | 10 | 15 | 7700 | 8000 | 7500 | 15 | 10 | 10 | 10 | 10 | 10 | 10 | 10 | 10 |
| 10 | 15 | 15 | 6000 | 7500 | 7600 | 15 | 15 | 10 | 10 | 10 | 10 | 10 | 10 | 10 | 10 |
| 11 | 15 | 5400 | 5500 | 15 | 15 | 10 | 10 | 10 | 10 | 10 | 10 | 10 | 10 | 10 | 10 |
| 12 | 15 | 15 | 15 | 15 | 10 | 10 | 10 | 10 | 10 | 10 | 10 | 10 | 10 | 10 | 10 |
| 13 | 10 | 10 | 10 | 10 | 10 | 10 | 10 | 10 | 10 | 10 | 10 | 10 | 10 | 10 | 10 |
| 14 | 10 | 10 | 10 | 10 | 10 | 10 | 10 | 10 | 10 | 10 | 10 | 10 | 10 | 10 | 10 |
| 15 | 10 | 10 | 10 | 10 | 10 | 10 | 10 | 10 | 10 | 10 | 10 | 10 | 10 | 10 | 10 |

100

Here is where the awards were.

120

Credits 28,500

FIG. 5A

16

| | a | b | c | d | e | f | g | h | i | j |
|---|---|---|---|---|---|---|---|---|---|---|
| 1 | 200 | 200 | 200 | 10 | 10 | 0 | 10 | 0 | 200 | 10 |
| 2 | 500 | 500 | 500 | 0 | 0 | 500 | 10 | 800 | 500 | 0 |
| 3 | 2000 | 500 | 1000 | 1000 | 10 | 1000 | 0 | 500 | 1000 | 500 |
| 4 | 500 | 500 | 1000 | 1000 | 0 | 1000 | 10 | 500 | 1000 | 500 |
| 5 | 500 | 500 | 500 | 0 | 10 | 500 | 0 | 0 | 500 | 0 |
| 6 | 10 | 10 | 15 | 500 | 1000 | 1000 | 10 | 10 | 2000 | 10 |
| 7 | 500 | 1000 | 15 | 10 | 1500 | 1000 | 0 | 0 | 1500 | 0 |
| 8 | 500 | 500 | 1500 | 10 | 0 | 10 | 15 | 500 | 1000 | 500 |
| 9 | 1000 | 500 | 1000 | 0 | 15 | 0 | 10 | 1000 | 500 | 1000 |
| 10 | 1000 | 500 | 1000 | 10 | 0 | 10 | 15 | 400 | 0 | 15 |

200

FIG. 5B

| Position | Depth 1 | Depth 2 | Depth 3 | Depth 4 | Depth 5 |
|---|---|---|---|---|---|
| 1a | 200 | 0 | 0 | 0 | 0 |
| 1b | 200 | 500 | 0 | 1000 | 1500 |
| 1c | 200 | stop | stop | stop | stop |
| 1d | 10 | 0 | 0 | 1500 | 0 |
| 1e | 10 | 500 | 0 | 1000 | 2500 |
| 1f | 0 | 500 | 0 | 1000 | 0 |
| 1g | 10 | 0 | 1000 | stop | stop |
| 1h | 0 | 500 | 0 | 1000 | 1500 |
| 1i | 200 | 500 | 0 | 0 | 2000 |
| 1j | 10 | 500 | 0 | 500 | 1000 |
| 2a | 500 | 1000 | 0 | stop | stop |
| 2b | 500 | 0 | 1000 | 0 | 2500 |
| 2c | 500 | 500 | 500 | 500 | 500 |
| 2d | 0 | 500 | 1500 | 0 | 1000 |
| 2e | 0 | 0 | 500 | 1000 | 1500 |
| 2f | 500 | 1500 | 1000 | 500 | 2000 |
| 2g | 10 | 0 | 2000 | 2000 | 0 |
| 2h | 800 | 500 | 2000 | 0 | 0 |
| 2i | 500 | stop | stop | stop | stop |
| 2j | 0 | 1000 | 0 | 2000 | 0 |
| 3a | 2000 | 0 | 0 | 0 | 0 |
| 3b | 1000 | stop | stop | stop | stop |
| 3c | 1000 | 500 | 0 | 500 | 1000 |
| 3d | 1000 | 0 | 0 | stop | stop |
| 3e | 10 | 1500 | 2000 | 0 | 5000 |
| 3f | 1000 | 2000 | 3000 | 4000 | 5000 |
| 3g | 0 | 2000 | 0 | 3000 | 0 |
| 3h | 500 | 0 | 2500 | 500 | 0 |
| 3i | 1000 | 0 | 2500 | 3000 | 0 |
| 3j | 500 | 1000 | 1500 | 2000 | 2500 |
| 4a | 500 | 0 | 1000 | 1500 | 0 |
| 4b | 500 | stop | stop | stop | stop |
| 4c | 1000 | 500 | 0 | 500 | 1000 |
| 4d | 1000 | 0 | 0 | stop | stop |
| 4e | 0 | 1500 | 2000 | 0 | 5000 |
| 4f | 1000 | 2000 | 3000 | 4000 | 5000 |
| 4g | 10 | 2000 | 0 | 3000 | 0 |
| 4h | 500 | 0 | 2500 | 500 | 0 |
| 4i | 1000 | 500 | 0 | 0 | 2000 |
| 4j | 500 | 500 | 0 | 500 | 1000 |
| 5a | 500 | 1000 | 0 | stop | stop |
| 5b | 500 | 0 | 1000 | 0 | 2500 |
| 5c | 500 | 500 | 500 | 500 | 500 |
| 5d | 10 | 500 | 1500 | 0 | 1000 |
| 5e | 10 | 0 | 500 | 1000 | 1500 |
| 5f | 500 | 0 | 0 | 1500 | 0 |
| 5g | 0 | 500 | 0 | 1000 | 2500 |
| 5h | 0 | 500 | 0 | 1000 | 0 |
| 5i | 500 | 0 | 1000 | stop | stop |
| 5j | 0 | 500 | 0 | 1000 | 1500 |
| 6a | 10 | 0 | 2500 | 500 | 0 |
| 6b | 10 | 0 | 2500 | 3000 | 0 |
| 6c | 15 | 1000 | 1500 | 2000 | 2500 |
| 6d | 500 | 0 | 1000 | 1500 | 0 |
| 6e | 1000 | 0 | 2000 | 2000 | 0 |
| 6f | 1000 | 500 | 2000 | 0 | 0 |
| 6g | 10 | stop | stop | stop | stop |
| 6h | 10 | 1000 | 0 | 2000 | 0 |
| 6i | 2000 | 0 | 0 | 0 | 0 |
| 6j | 10 | stop | stop | stop | stop |
| 7a | 500 | 1500 | 2000 | 0 | 5000 |
| 7b | 1000 | 2000 | 3000 | 4000 | 5000 |
| 7c | 15 | 2000 | 0 | 3000 | 0 |
| 7d | 10 | 0 | 2500 | 500 | 0 |
| 7e | 1500 | 1000 | 500 | stop | stop |
| 7f | 1000 | 2000 | 3000 | 4000 | 5000 |
| 7g | 0 | 2000 | 0 | 3000 | 0 |
| 7h | 0 | 0 | 2500 | 500 | 0 |
| 7i | 1500 | 500 | 0 | 0 | 2000 |
| 7j | 0 | 500 | 0 | 500 | 1000 |
| 8a | 500 | 1000 | 0 | stop | stop |
| 8b | 500 | 0 | 1000 | 0 | 2500 |
| 8c | 1500 | stop | stop | stop | stop |
| 8d | 10 | 1000 | 0 | 2000 | 0 |
| 8e | 0 | 0 | 0 | 0 | 0 |
| 8f | 10 | stop | stop | stop | stop |
| 8g | 15 | stop | stop | stop | stop |
| 8h | 500 | 500 | 0 | 500 | 1000 |
| 8i | 1000 | 0 | 0 | stop | stop |
| 8j | 500 | 1500 | 2000 | 0 | 5000 |
| 9a | 1000 | 2000 | 3000 | 4000 | 5000 |
| 9b | 500 | 1500 | 2000 | 0 | 5000 |
| 9c | 1000 | 2000 | 3000 | 4000 | 5000 |
| 9d | 0 | 2000 | 0 | 3000 | 0 |
| 9e | 15 | 0 | 2500 | 500 | 0 |
| 9f | 0 | 500 | 0 | 0 | 2000 |
| 9g | 10 | 500 | 0 | 500 | 1000 |
| 9h | 1000 | 500 | 0 | 1000 | 1500 |
| 9i | 500 | stop | stop | stop | stop |
| 9j | 1000 | 0 | 0 | 1500 | 0 |
| 10a | 1000 | 500 | 0 | 1000 | 2500 |
| 10b | 500 | 500 | 0 | 1000 | 0 |
| 10c | 1000 | 0 | 1000 | stop | stop |
| 10d | 10 | 500 | 0 | 1000 | 1500 |
| 10e | 0 | 500 | 0 | 0 | 2000 |
| 10f | 10 | 500 | 0 | 500 | 1000 |
| 10g | 15 | 2000 | 3000 | 4000 | 5000 |
| 10h | 400 | 2000 | 0 | 3000 | 0 |
| 10i | 0 | 0 | 2500 | 500 | 0 |
| 10j | 15 | 500 | 0 | 0 | 2000 |

| | Player 1 | Player 2 | Player 3 | Player 4 |
|---|---|---|---|---|
| 220 Selections | 2 | 2 | 2 | 2 |
| 230 Credits | 1010 | 500 | 1500 | 1510 |
| 250 Wager | 100 | 100 | 100 | 100 |

Congratulations Player 1, you win 500 credits.
Player 2, you also win 500 credits.
Player 3, you win 1,000 credits.
Player 4, you win 1,500 credits.

You now have seven seconds to move your avatar up to two positions from your present position by touching an available postion on the screen.
If you hit a stop symbol, you must move.

FIG. 6C

16

| | a | b | c | d | e | f | g | h | i | j |
|---|---|---|---|---|---|---|---|---|---|---|
| 1 | 1000 | 500 | | 200 | 500 | 200 | | | 500 | 500 |
| 2 | 500 | 500 | | 200 | 300 | 200 | | | 500 | 500 |
| 3 | | | R | | | | | 500 | 1000 | 500 |
| 4 | | R | | | | | | | 1000 | 500 |
| 5 | | | | | | | Rock | | 500 | 500 |
| 6 | 500 | 1000 | 500 | | | | 2000 | | | |
| 7 | | | | | | | | | | 500 |
| 8 | | | | | | | | | 500 | 1000 |
| 9 | | | 500 | | 1000 | 1000 | 1000 | | 500 | 1000 |
| 10 | | 500 | 1000 | | 1000 | 2000 | 1000 | | | 500 |

200

FIG. 6D

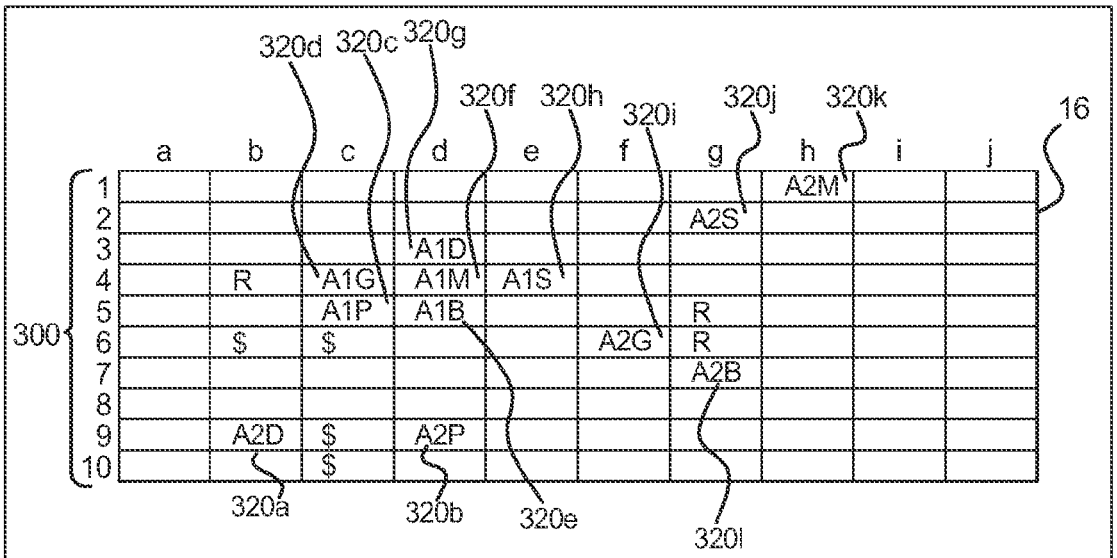

318a Miner (M): Hammers through one half depth of rock or digs one depth per time at a postion.

318b Digger (D): Digs one depth per time at a postion.

318c Blaster (B): Blasts through one depth of rock or two depth of dirt per time at a postion.

318d Prospector (P): Searches for and identifies awards or information relevant to a designated number of surrounding postions.

318e Geologist (G): Advises on geological properties within designated number of surrounding postions.

318f Security (S): Prevents opponents avatars from moving to designated number of surrounding postions.

330

| Moves | Miner | Digger | Blaster | Prospector | Geologist | Security | Credits | Wager |
|---|---|---|---|---|---|---|---|---|
| Player 1 | 3 | 3 | 3 | 3 | 3 | 3 | 0 | 100 |
| Player 2 | 3 | 3 | 3 | 3 | 3 | 3 | 0 | 100 |

Sorry, no hits. Move each of your avatars, or leave them stationary, but don't move them more than two positions.

Remember, there may be awards under rock.

FIG. 6E

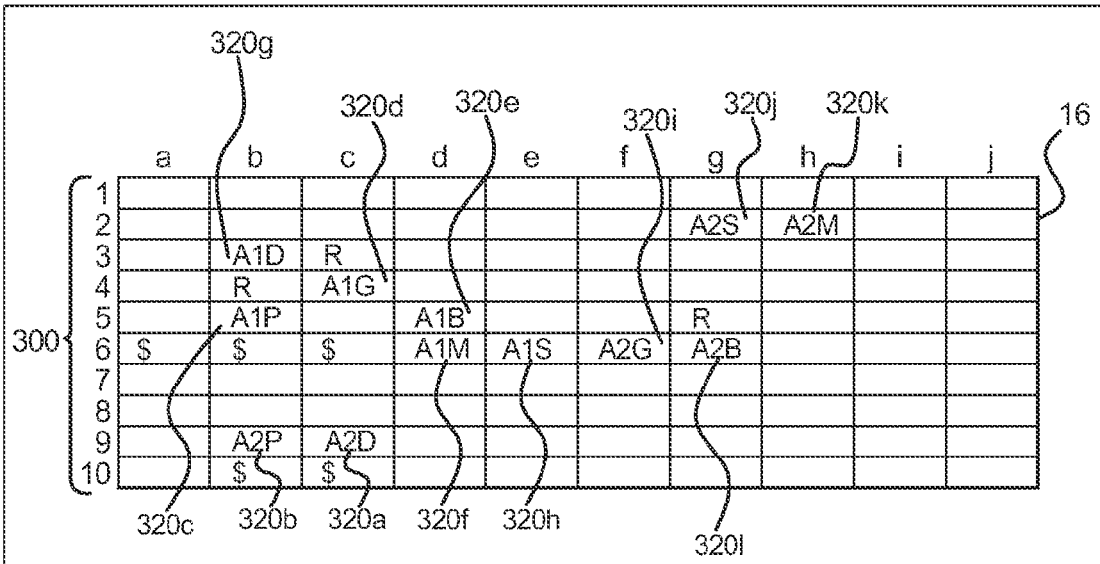

318a
Miner (M): Hammers through one half depth of rock or digs one depth per time at a postion.

318b
Digger (D): Digs one depth per time at a postion.

318c
Blaster (B): Blasts through one depth of rock or two depth of dirt per time at a postion.

318d
Prospector (P): Searches for and identifies awards or information relevant to a designated number of surrounding postions.

318e
Geologist (G): Advises on geological properties within designated number of surrounding postions.

318f
Security (S): Prevents opponents avatars from moving to designated number of surrounding postions.

330

| Moves | Miner | Digger | Blaster | Prospector | Geologist | Security | Credits | Wager |
|---|---|---|---|---|---|---|---|---|
| Player 1 | 2 | 2 | 2 | 2 | 2 | 2 | 0 | 100 |
| Player 2 | 2 | 2 | 2 | 2 | 2 | 2 | 500 | 100 |

Congratulations Player 2, you win 500 credits.
Move each of your avatars, or leave them stationary, but don't move them more than two positions.

Remember, there may be awards under rock.

FIG. 6F

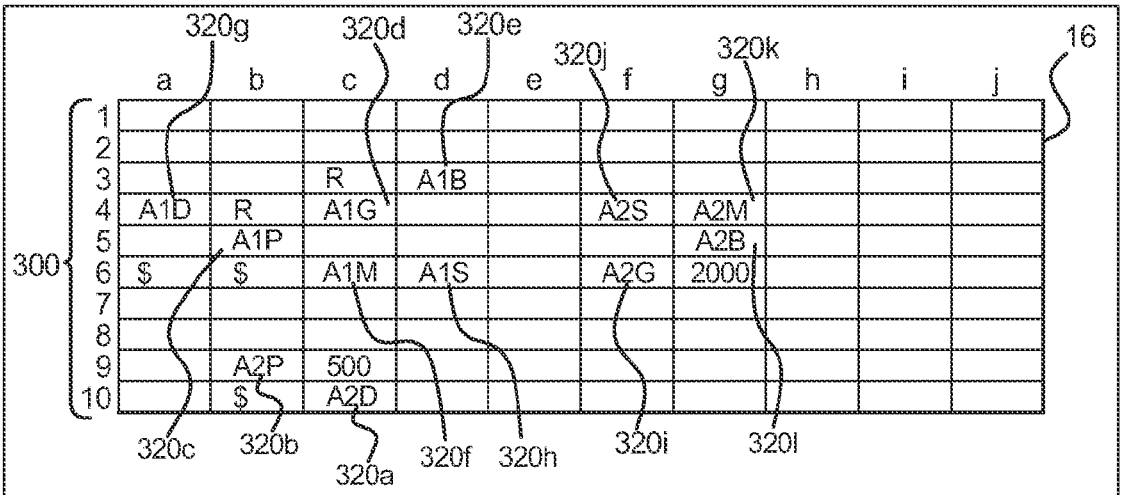

318a
Miner (M): Hammers through one half depth of rock or digs one depth per time at a postion.

318b
Digger (D): Digs one depth per time at a postion.

318c
Blaster (B): Blasts through one depth of rock or two depth of dirt per time at a postion.

318d
Prospector (P): Searches for and identifies awards or information relevant to a designated number of surrounding postions.

318e
Geologist (G): Advises on geological properties within designated number of surrounding postions.

318f
Security (S): Prevents opponents avatars from moving to designated number of surrounding postions.

330

| Moves | Miner | Digger | Blaster | Prospector | Geologist | Security | Credits | Wager |
|---|---|---|---|---|---|---|---|---|
| Player 1 | 1 | 1 | 1 | 1 | 1 | 1 | 1,500 | 100 |
| Player 2 | 1 | 1 | 1 | 1 | 1 | 1 | 1,500 | 100 |

Player 1, you win 500 credits.
Player 2, you win another 1,000 credits.

Remember, there may be awards under rock.

FIG. 6G

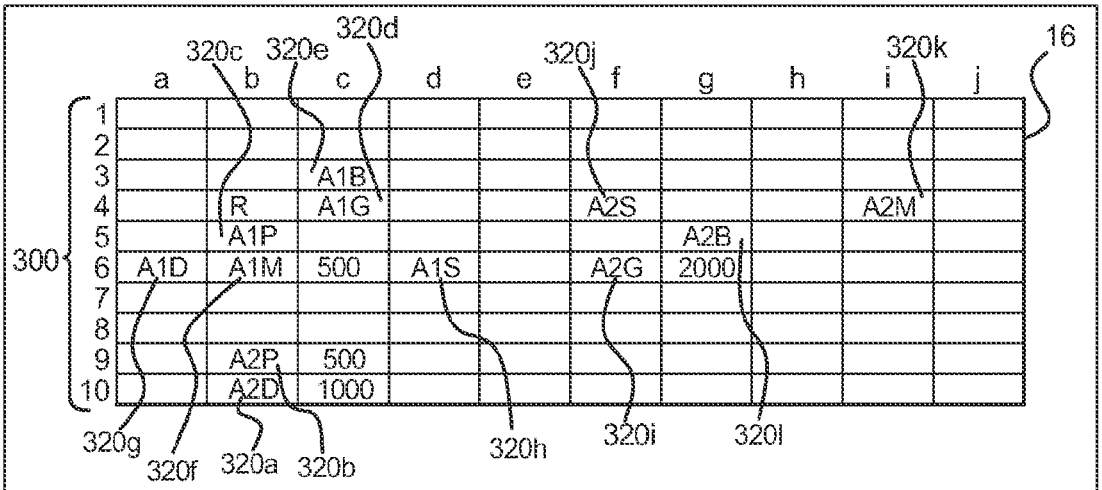

318a
Miner (M): Hammers through one half depth of rock or digs one depth per time at a position.

318b
Digger (D): Digs one depth per time at a position.

318c
Blaster (B): Blasts through one depth of rock or two depth of dirt per time at a position.

318d
Prospector (P): Searches for and identifies awards or information relevant to a designated number of surrounding positions.

318e
Geologist (G): Advises on geological properties within designated number of surrounding positions.

318f
Security (S): Prevents opponents avatars from moving to designated number of surrounding positions.

330

| Moves | Miner | Digger | Blaster | Prospector | Geologist | Security | Credits | Wager |
|---|---|---|---|---|---|---|---|---|
| Player 1 | 0 | 0 | 0 | 0 | 0 | 0 | 1,500 | 100 |
| Player 2 | 0 | 0 | 0 | 0 | 0 | 0 | 2,000 | 100 |

Congratulations Player 1, you win another 1,000 credits, winning 2,000 credits total.

Player 2, you win another 500 credits, winning 4,500 credits total.

FIG. 7B

| | | | | | | | | | |
|---|---|---|---|---|---|---|---|---|---|
| 500 | 500 | 500 | 1,000 | 1,000 | 1,000 | 1,000 | 3,000 | 4,000 | 5,000 |
| 500 | 1,000 | 500 | 1,000 | 1,000 | 1,000 | 1,000 | 2,000 | 4,000 | 4,000 |
| 500 | 500 | 500 | 1,000 | 2,000 | 2,000 | 2,000 | 1,000 | 1,000 | 1,000 |
| 500 | 1,000 | 1,000 | 2,000 | 3,000 | 5,000 | 3,000 | 2,000 | 1,000 | 1,000 |
| 1,000 | 1,000 | 1,000 | 2,000 | 3,000 | 5,000 | 3,000 | 2,000 | 1,000 | 1,000 |
| 1,000 | 1,000 | 1,000 | 1,000 | 1,000 | 2,000 | 2,000 | 2,000 | 1,000 | 1,000 |
| 1,500 | 3,000 | 1,500 | 1,000 | 1,000 | 1,000 | 1,000 | 1,000 | 1,000 | 1,000 |
| 1,500 | 3,000 | 1,500 | 1,000 | 1,000 | 2,000 | 2,000 | 1,000 | 1,500 | 1,500 |
| 1,000 | 1,000 | 1,000 | 1,000 | 1,000 | 3,000 | 3,000 | 1,000 | 1,500 | 2,000 |
| 500 | 500 | 500 | 1,000 | 1,000 | 1,000 | 1,000 | 1,000 | 1,500 | 2,000 |

FIG. 10A

500

Place designated wager to qualify to play bonus game on this display!

| | | | | | | | | | |
|---|---|---|---|---|---|---|---|---|---|
| | | | | | | | 3,000 | | |
| | | | | | | | | | |
| | | | | | 2,000 | | | | |
| | | | | | | | | 1,000 | |
| | | | | | | | | | |
| | | | | | | | | | |
| | | | | | 1,000 | | | | |
| | | | | | | | | | |
| | | | | | | | | | |
| | | | | | | | | | |

FIG. 11A

500

Place designated wager to qualify to play bonus game on this display!

| | | | | | | | | | |
|---|---|---|---|---|---|---|---|---|---|
| | | | | | | | 3,000 | 4,000 | |
| | | | | | | | | | |
| | | | | | 2,000 | | | | |
| | | | | | | | | 1,000 | |
| | | | | | | | | | |
| | | | | | 2,000 | | | | |
| | | | | | 1,000 | | | | |
| | | | | | | | | | |
| | | | | | | | | | |
| | | | | | | | | | |

FIG. 12A

500

Place designated wager to qualify to play bonus game on this display!

| | | | | | | | | | |
|---|---|---|---|---|---|---|---|---|---|
| | | | | | | | 3,000 | 4,000 | 5,000 |
| | | | | | | | | | |
| | | | | | 2,000 | | | | |
| | | | | | | | | 1,000 | |
| | | | | | 5,000 | | | | |
| | | | | | 2,000 | | | | |
| | | | | | 1,000 | | | | |
| | | | | | | | | | |
| | | | | | | | | | |
| | | | | | | | | | |

GAMING SYSTEM, GAMING DEVICE AND METHOD OF PROVIDING SELECTION GAME WITH INTERDEPENDENT AWARD DISTRIBUTION

PRIORITY CLAIM

This application is a continuation of, and claims priority to and the benefit of, U.S. patent application Ser. No. 12/196,800, filed on Aug. 22, 2008, the entire contents of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Player selection games are popular and well-known in the gaming industry. In certain known selection games, a gaming device displays a plurality of positions to a player, some of which are associated with awards and at least one of which is associated with a terminating symbol. In these types of games, typically a gaming device enables the player to select positions until the player selects a position associated with a terminator, at which time the gaming device provides the player with any earned awards and the game ends. In other selection games, a gaming device enables the player to select a certain number of positions. In one variation, the player may earn additional selection opportunities over the course of the play.

Other known selection games are matching games. These games generally require a player to select displayed positions until the player selects two or more matching symbols, at which time the player may be provided with an award. Certain known matching games require some element of player skill, in that over the course of a play of a game, a player can memorize what symbols are located at each symbol position, to assist in finding matching symbols.

Although games in which a player picks positions until selecting a position associated with a terminating symbol are exciting for players, such games do not enable the use of player skill, as players do not select positions based on information obtained from the selection of previous positions.

Although matching games require some skill to the extent a player memorizes what symbols occupy respective positions for use in making future selections, picking a position does not provide a player with information relevant to an award amount, for example, of another position, which would lead a player to subsequently pick a certain position or pick a position in a certain area of a game grid.

Accordingly, a need exists for gaming systems, gaming devices and methods providing new and exciting player selection games.

SUMMARY

Various embodiments of the disclosed gaming system, gaming device and method provide a selection game having a plurality of selectable positions and a plurality of awards interdependently distributed or associated with the selectable positions. For one, a plurality, or all of the selectable positions, the award associated with such selectable position is interdependent in that such award has a relationship to one or more of the awards associated with the selectable positions bordering such position. In various embodiments, the value of the award associated with such selectable position has a relationship to one or more of the values of the awards associated with the selectable positions bordering such position. Based on these interdependencies, when each of the selectable positions is selected, the award, or value of the award, associated with the position provides certain information which the player can subsequently use to make better informed subsequent position selections.

In various embodiments, no two bordering positions in a plurality or group of positions are associated with respective awards which differ by more than a designated amount. In one such embodiment, the designated amount is the difference between the amount of the largest and smallest award associated with a plurality of positions. In other embodiments, the variances in the awards in a group are much smaller. For example, the variance is not more than 10, 50, 100, 1,000, etc., which is less than the difference between the largest and smallest award.

In one embodiment, the awards are interdependent in that each award constitutes a designated percentage of a total award available to win. If the total available award is adjusted upwardly or downwardly, the value of each of the awards associated with the selectable positions is adjusted proportionally based on each award's respective percentage of the total award, such that the percentages of the awards relative to one another remain constant or within a designated range of percentage values. In various embodiments such as this, such total award is a progressive award. In various embodiments, the awards are interdependent in this manner in addition to the above manner. In other embodiments, the awards are interdependent in this manner alone.

It should be appreciated that the present disclosure in various embodiments thus provides information based on the selection of at least one (and preferably a plurality or all) of the selectable positions including one or more of: (a) the amount of one or more awards associated with that selectable position; (b) information enabling an inference of the amount of one or more awards associated with one or more bordering or adjacent selectable positions; (c) information enabling an inference of the amount of one or more awards associated with one or more other of the plurality of selectable positions; (d) information enabling an inference of whether one or more bordering or adjacent selectable positions are associated with any awards; (e) information regarding other awards associated with the selected position; (f) locality information; and (g) other suitable information.

For example, in various embodiments, the information is locality information regarding other selectable positions. Examples of such locality information include, but are not limited to: (a) the relative, approximate or exact position of one or more near-by selectable positions associated with awards; (b) the relative, approximate or exact position of one or more near-by selectable positions not associated with awards; (c) the relative, approximate or exact value of awards associated with one or more near-by selectable positions; and (d) any other kind of information.

In various embodiments, the selectable positions include one or more clusters, groups or sub-groups of bordering selectable positions which include less positions than a total number of selectable positions. In various such embodiments, for one, a plurality or all of the clusters, the awards associated with the selectable positions in such clusters are interdependently related awards. In certain such embodiments, each of the one or more clusters of positions associated with interdependently related awards is bordered or surrounded by a plurality of selectable positions not associated with awards. The value of the award associated with each selectable position in a cluster provides information which can be subsequently used to more strategically select other selectable positions in the cluster. For example, if a player selects a first selectable position in a cluster associated with an award of two thousand credits and selects a second selectable position in the cluster directly to the right of the first position associated with an award of three thousand credits, the player may recognize a pattern and conclude that they should pick the position to the right of the second position, due to the increasing values of the respective awards at the first and second positions. In another example, if a player selects a first selectable position in a cluster associated with an award, the first selected position depicts a graphic or a suitable alternative mechanism to indicate which of the positions bordering that position has a highest value relative to the value associated with the selection.

The present disclosure contemplates multiple ways in which the gaming system and gaming device can provide the selection game. The selection game in alternative embodiments is provided as a primary or base game or as a secondary or bonus game. The selection game in alternative embodiments is provided in a single-player format or in a multi-player format. The selection game in further alternative embodiments is provided as a type of extended or persistence game which extends over multiple plays or activations of a primary game or a secondary game. The selection game can be provided as a single play game where the selectable positions and awards are reset for each play or as one of an extended or persistence type game where the selectable positions and awards remain for multiple plays, activations or entries into the selection game.

In one single player embodiment, the selection game is a bonus game and a player is provided with a designated number of selections of the selectable positions upon the occurrence of a designated triggering event. As the player selects selectable positions, the gaming device displays the awards associated with the selected positions. After the player has selected the designated number of selectable positions, the gaming device provides the player with a total award including the sum of the awards associated with the selected positions. In this embodiment, interdependence of the awards enables the player to make better informed subsequent position selections based on their previous position selections. In another embodiment, locality information enables the player to make subsequent position selections based on their previous position selections, either instead of or in addition to information based upon award value interdependence. As the player makes more selections, the player receives more information. The selection game of this embodiment may also be provided in this form as a primary game or base game which the gaming device initiates upon the placement of a suitable wager.

In one multi-player embodiment, the selection game is a primary game and each of a plurality of players are provided with a designated number of selections of the selectable positions upon placement of a wager. The players take turns selecting selectable positions and as positions are selected, the gaming device displays the awards associated with the selected positions. After each of the players have selected their respective designated number of selectable positions, the gaming device provides each of the players with their respective total award including the sum of the awards associated with their respective selected positions. In this embodiment, interdependence of the awards enables the players make subsequent position selections based both on their previous selections and other players' previous selections. In another embodiment, the players make selection decisions at the same time. In one variation, all players make one selection within a specific time interval, followed by the simultaneous revelation of information associated with the selections at the end of the time interval. The selection game of this embodiment may also be provided as a multi-player secondary game which can be triggered in any suitable manner.

In certain multiplayer embodiments, the gaming system reveals information to all players. In other multiplayer embodiments, the gaming system reveals information to all players associated with the player who caused the gaming system to reveal the information (i.e., to players on that player's team). In further multiplayer embodiments, the gaming system reveals information to players within a certain proximity of the position associated with the revelation. In additional multiplayer embodiments, the gaming system reveals locality information to the player that caused the gaming system to reveal the information.

In one multiplayer embodiment, information that was revealed to the player that caused the gaming system to reveal the information is revealed to other players after the player causing the gaming system to reveal the information moves from that location. In another multiplayer embodiment, information that was revealed to the player that caused the gaming system to reveal the information is revealed to other players after a certain number of pick intervals. In a further multiplayer embodiment, information that was revealed to the player that caused the gaming system to reveal the information is revealed to other players after a certain period of time.

The multiplayer embodiments herein fulfill a need for offering multiplayer bonus events that lead to the possibility that one player's neutral or positive actions can lead to another player's benefit (i.e., via the revelation of information to a player based on another player's position selection, which enables the player make a better informed subsequent position selection).

In one embodiment, the selection game is an extended or persistence type game, continuing until a terminating event occurs. In such embodiments, one or more players (dependent on whether the selection game is a single player or multi-player game) may enter or play the selection game: (a) at designated time intervals; (b) as a bonus award associated with a play of another game; (c) by placing a wager of a designated number of credits; (d) any combination of these; and (e) in any other manners. In various such embodiments, when a player enters the selection game, the player may: (a) play the selection game for a designated period (i.e., amount of time); (b) be provided a designated number of selections and play the selection game until they run out of selections; (c) play the selection game until no awards remain in the selection game; (d) play the selection game until selecting one or more designated selectable positions which cause the termination of that player's participation in the selection game; and (e) play the selection game according to any other suitable criteria.

In one such extended or persistent type selection game, the awards associated with each of the plurality of positions do not change and the terminating event is the selection of each of the awards associated with the plurality of selectable positions by one or more players (dependent on whether the selection game is a single player or multi-player game).

In other such embodiments, one or more of the awards associated with the plurality of selectable positions change upon the occurrence of one or more designated triggering events. It should be appreciated that for purposes of these embodiments, changing the awards associated with the selectable positions includes, but is not limited to any or multiple of: (a) changing the award associated with at least one of the plurality of selectable positions that is already associated with an award and yet to be selected; (b) associating an award with at least one selectable position which was not previously associated with an award; (c) associating at least one selectable position which was associated with an award, but has been selected, with a new award; (d) increasing all awards by a predetermined amount; (e) multiplying all awards by a predetermined amount; (f) increasing each award by a randomly determined amount; (g) multiplying each award by a randomly determined amount; (h) inverting the value of award locations so that previously revealed (but not awarded) high award values are now low and previously revealed (but not awarded) low award values are now high; (i) regeneration of the entire game field; (j) any combination of these; and (k) any other suitable change.

In various such embodiments, the designated triggering event which causes one or more awards to change includes: (a) the entry or exit of the selection game by one or more players; (b) the depletion of the sum of the total value of the awards associated with each of the plurality of positions below a designated amount; (c) the depletion of the total number of the plurality of positions associated with awards below a designated number; (d) the passage of a designated period (i.e., an amount of time); (e) a change in the available awards relative to the average expected value; (f) the placement of a wager of a designated size by one or more players; (g) the selection of a predetermined position; (h) the selection of each of a predetermined group of positions; and (i) any other suitable event.

In addition to or instead of an award, one or more of the plurality of positions in any of the embodiments of the selection game contemplated herein may be associated with: (a) a plurality of awards; (b) a plurality of levels (i.e., depths as explained below); (c) a symbol; (d) a piece of information; (e) a terminating condition or event; (f) a modifier; (g) any combination of these; and (h) any other suitable symbol or event. In one embodiment in which a plurality of awards may be associated with at least one single position, the number of awards associated with the at least one position varies as a function of time. In various other such embodiments, the number of awards associated with the at least one position varies as a function of any suitable variable.

The present disclosure contemplates multiple ways in which positions are selected, including: (a) by a player via at least one input device; (b) randomly by the gaming device; (c) in a predetermined manner by the gaming device; (d) by an avatar displayed by the gaming device and controlled by a player; (e) by an avatar displayed by the gaming device and acting according to artificial intelligence; (f) any combination of these; and (g) any other suitable manner of selection.

In various embodiments, at least one restriction is placed on one or more selections of the selectable positions. Examples of such restrictions include: (a) limiting players to a designated amount of time to make each selection; (b) limiting the total number of positions between a selected position and a subsequently selected position; (c) limiting the amount of time players remain at each position; (d) limiting the number of turns players remain at each position; (e) limiting the number of players who can select a position or positions in a cluster; (f) limiting the total number of positions between all position selections over the entire game; (g) limiting the total number of positions between a selected position and a subsequently selected position based on player status; (h) any combination of these; and (i) any other suitable restrictions.

In various embodiments, the award associated with one of, a plurality or each of the plurality of positions may include: (a) a number of credits; (b) a number of free spins or activations; (c) a number of activations or plays of a bonus game; (d) a number of selections; (e) a physical prize; (f) promotional points; (g) player tracking points; (h) money; (i) an increase or decrease in an amount of additional time remaining in a play of a game; (j) an increase or decrease in a range in which a player may select a position relative to a last selected position; (k) an increase or decrease in the speed at which a player may cause an avatar to move or the player may move to a new position; (l) an increase or decrease in a multiplier that applies to all awards; (m) an increase or decrease in a multiplier that applies to subsequent awards; (n) an increase or decrease in the number of levels associated with a position a single selection of that position reveals; (o) an increase or decrease in the number of grid positions that a single selection encompasses; (p) an increase or decrease in locality information available to a player; (q) any combination of these; and (r) any other suitable award.

Additional features and advantages are described herein, and will be apparent from, the following Detailed Description and the figures.

BRIEF DESCRIPTION OF THE FIGURES

FIGS. 3A and 3B include views of a grid and table demonstrating the interdependence of awards.

FIGS. 4A, 4B, 4C, 4D, 4E, 4F, 4G, 4H, 4I, 4J and 4K include front views of a gaming device display enabling a play of a game by a single player in accordance with one embodiment of the gaming device disclosed herein.

FIGS. 5A, 5B, 5C, 5D, 5E, 5F, 5G, 5H and 5I include front views of a gaming device display enabling a play of a game by multiple players in accordance with one embodiment of the gaming device disclosed herein.

FIGS. 6A, 6B, 6C, 6D, 6E, 6F and 6G include front views of a gaming device display enabling a play of a game by multiple players in accordance with another embodiment of the gaming device disclosed herein.

FIG. 7B include a front view of a gaming device display enabling a play of a game by multiple players in accordance with another embodiment of the gaming device disclosed herein.

FIGS. 10A, 10B, 10C and 10D include a front view of a gaming device display enabling a play of a game by multiple players in accordance with another embodiment of the gaming device disclosed herein.

FIGS. 11A, 11B, 11C and 11D include a front view of a gaming device display enabling a play of a game by multiple players in accordance with another embodiment of the gaming device disclosed herein.

FIGS. 12A, 12B, 12C and 12D include a front view of a gaming device display enabling a play of a game by multiple players in accordance with another embodiment of the gaming device disclosed herein.

DETAILED DESCRIPTION

The present disclosure may be implemented in various configurations for gaming machines, gaming devices, or gaming systems, including but not limited to: (1) a dedicated gaming machine, gaming device, or gaming systems wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
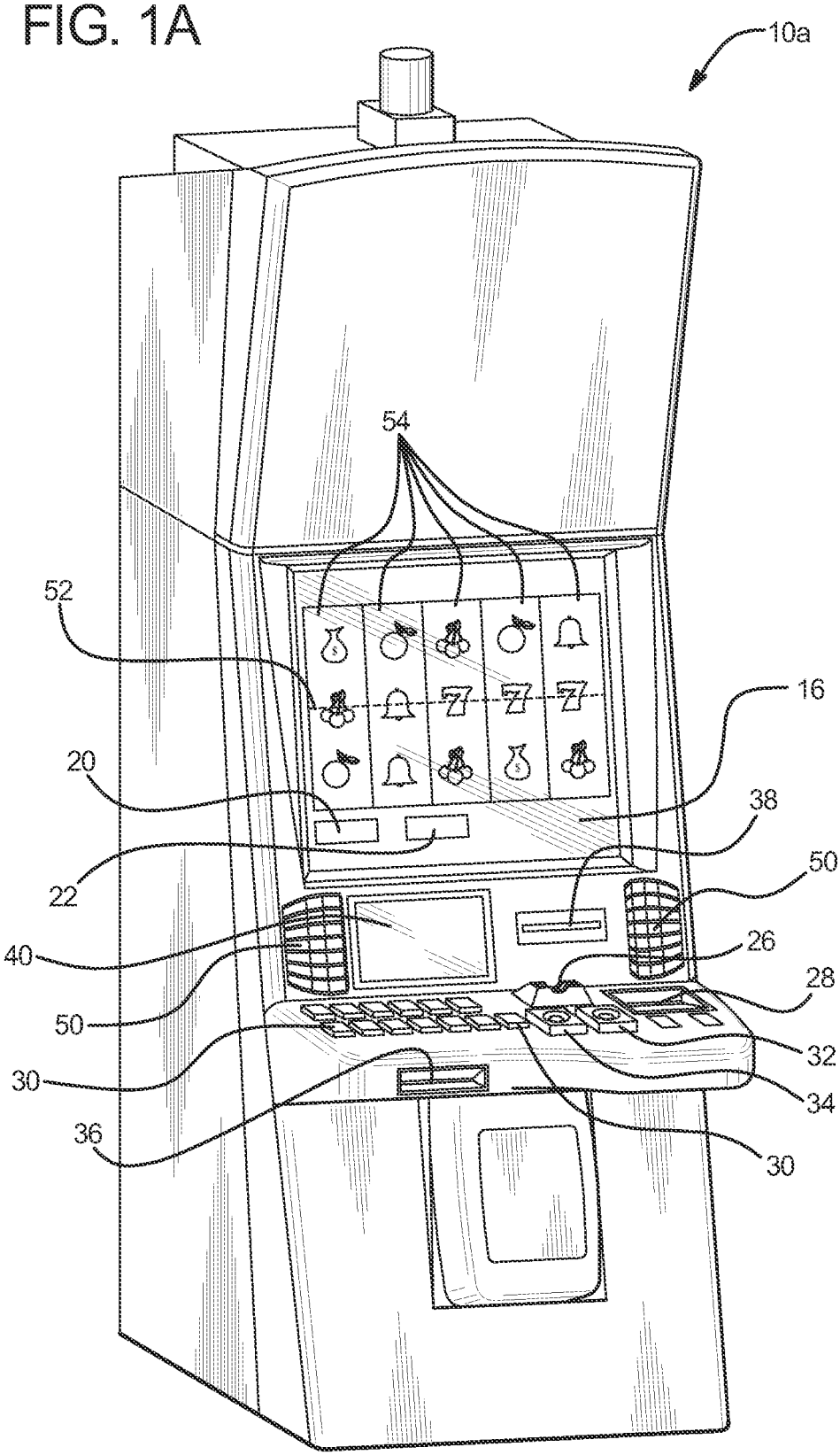
FIGS. 1A and 1B are front perspective views of alternative embodiments of gaming devices disclosed herein.
Figure 1B:
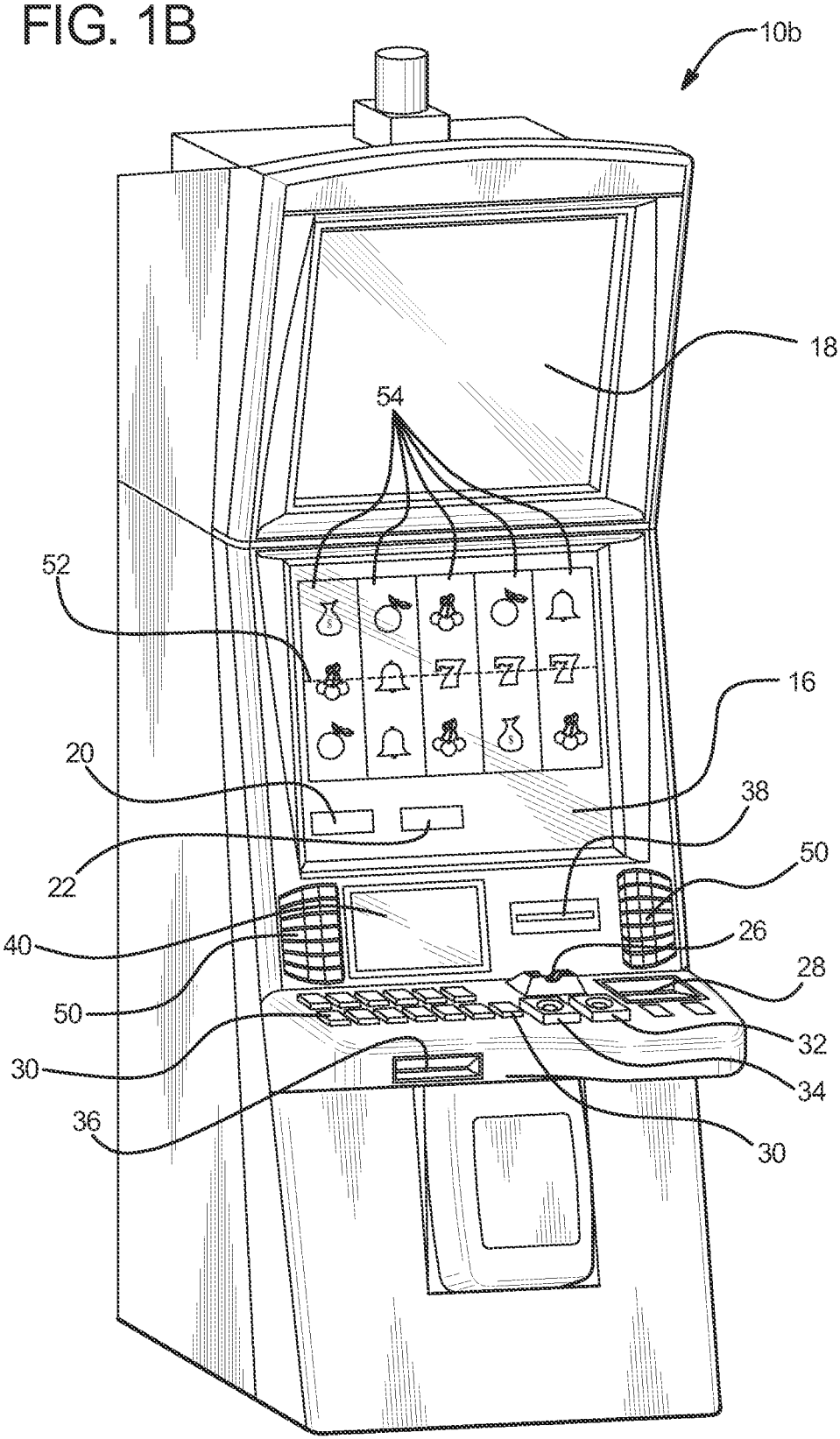

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
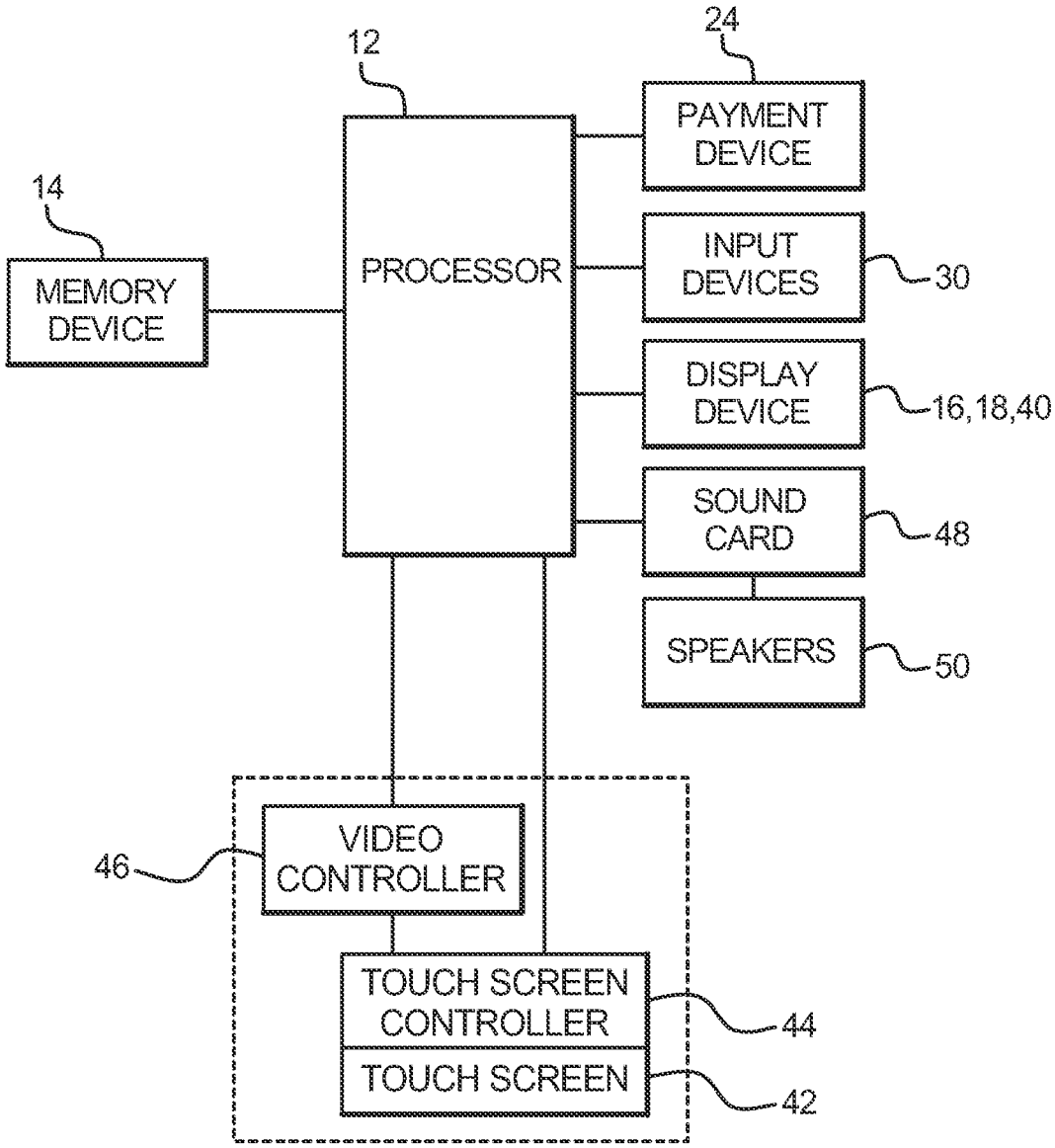
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as a primary or base game, with various embodiments of the selection game serving as a secondary or bonus game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52, with the disclosed selection game serving as a bonus game. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards, with the disclosed selection game serving as a secondary or bonus game. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, a base or primary game may be a multi-hand version of video poker, with the disclosed selection game serving as a secondary or bonus game. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices, with the disclosed selection game serving as a secondary or bonus game. In this embodiment, the player selects at least one but potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central controller) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
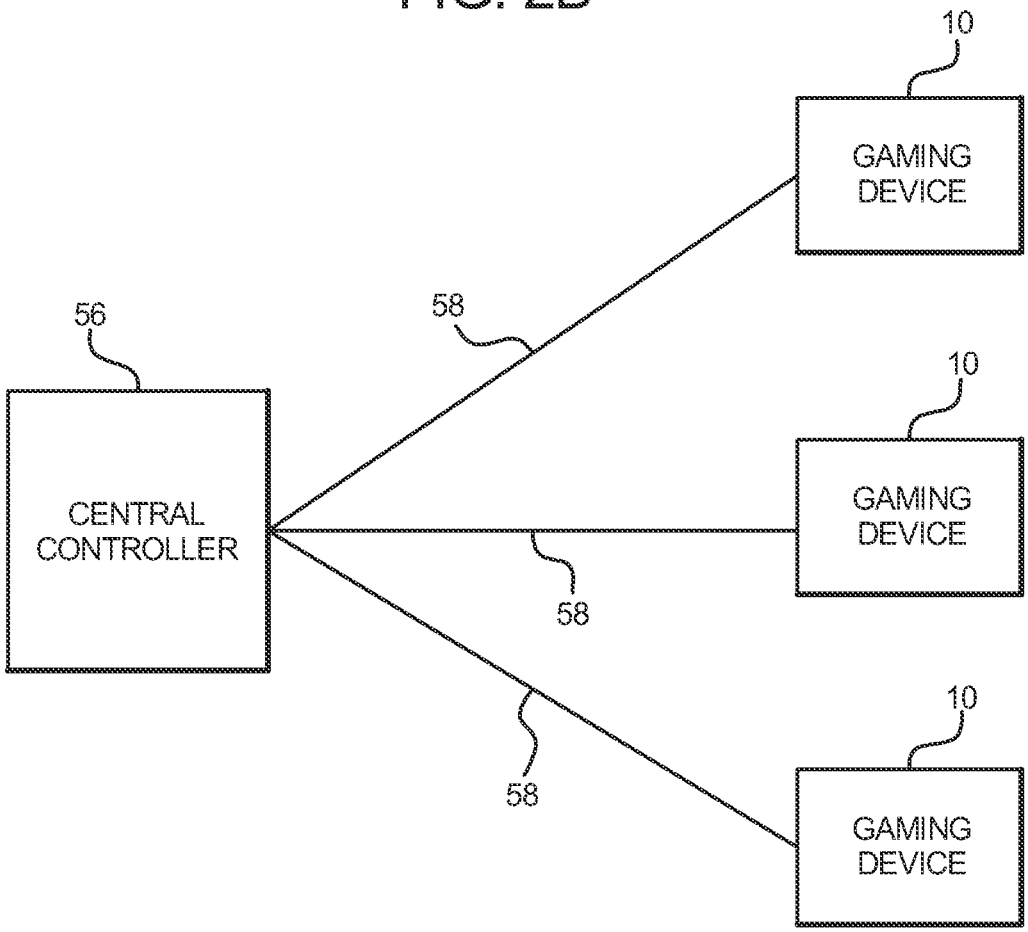
FIG. 2B is a schematic diagram of the central controller in communication with a plurality of gaming devices in accordance with one embodiment of the gaming system disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

Interdependent Award Distribution

Various embodiments of the disclosed gaming system, gaming device and method provide a selection game having a plurality of selectable positions and a plurality of awards interdependently distributed or associated with the selectable positions. For one, a plurality, or all the selectable positions, the award associated with such selectable position is interdependent in that such award has a relationship to one or more of the awards associated with the selectable positions bordering such position. In various embodiments, the value of the award associated with such selectable position has a relationship to one or more of the values of the awards associated with the selectable positions bordering such position. Based one these interdependencies, when each of the selectable positions is selected, the award, or value of the award, associated with the position provides certain information which can be subsequently used to make better informed position selections.

In various embodiments, no two bordering positions are associated with respective awards which differ by more than a designated amount. In one such embodiment, the designated amount is the difference between the amount of the largest and smallest award associated with a plurality of positions. For example, if the largest award associated with a plurality of positions is 5,000 credits and the smallest award associated with the plurality of positions is 100 credits, the difference between the awards associated with any two bordering positions will be less than 4,900 credits. It should be appreciated that in various other such embodiments, this difference or variance in amount need not be linked to the respective largest and smallest awards associated with a plurality of positions, but rather may be any suitable difference or variance.

In another such embodiment, no two bordering positions in one or more respective groups or areas of positions are associated with awards which differ or vary by more than a designated amount. For example, in one illustrative embodiment, in a first group of positions at a first area of a grid, the difference or variance between the amounts of awards associated with the positions does not vary by more than plus or minus 50 credits. In a second group of positions at a second area of the grid, the difference or variance between the amounts of awards associated with the positions does not vary by more than plus or minus 100 credits. In various such embodiments, the different groups could be differentiated by color, location or any suitable form of differentiating identification.

In one embodiment, the awards are interdependent in that each award constitutes a designated percentage of a total award available to win. If the total available award is adjusted upwardly or downwardly, the value of each of the awards associated with the selectable positions is adjusted proportionally based on each award's respective percentage of the total award, such that the percentages of the awards relative to one another remain constant or within a designated range of percentage values. It should be appreciated that in various embodiments, this total award may be a progressive award. In various embodiments, the awards are interdependent in this manner in addition to the above manner. In other embodiments, the awards are interdependent in this manner alone.

Referring specifically to the example embodiment of FIGS. 3A and 3B, a grid 90 includes a plurality of selectable positions of a bonus selection game, each of which are associated with an award. Each of the awards associated with positions in the grid 90 is associated with a total available award of 84,200 credits, as illustrated in table 92 in FIG. 3A. In this embodiment, the total available award is a progressive award, as also illustrated in table 92.

Referring now to FIG. 3B, the progressive award increased to 104,200 credits, thus in grid 90 of FIG. 3B the total available award was increased to 104,200 credits by adding 200 credits to each respective award. The awards associated with the plurality of selectable positions in the grid 90 are interdependent, such that if the total available award is adjusted upwardly or downwardly, the value of each of the awards associated with the selectable positions is adjusted proportionally, such that the percentages of the awards relative to one another remain constant.

It should be appreciated that in the embodiment illustrated in FIGS. 3A and 3B, the awards are interdependent in each of the above discussed manners. In FIGS. 3A and 3B, certain portions of the grid 90 have been surrounded by darkened lines for illustrative purposes to show clusters of positions wherein awards are interdependently related in that the value of the award associated with such selectable position has a relationship to one or more of the values of the awards associated with the selectable positions bordering such position. For example, referring to the upper right hand corner of the grid 90 in FIGS. 3A and 3B, the values of the awards in the emphasized area increase in a trend-like fashion as they get closer to the upper right hand corner of the grid 90. Thus, as a player picks selections closer to the upper right hand corner of the grid 90, the player would recognize this pattern and in the best case, ultimately select the maximum award of 5,000 credits in this emphasized area.

It should also be appreciated that the embodiment illustrated in FIGS. 3A and 3B could be a primary game or a bonus game.

It should further be appreciated that although in this example, each of the positions in the grid are associated with an award, in various other embodiments, all of the positions in the grid do not need to be associated with an award.

It should be appreciated that the present disclosure in various embodiments thus provides information based on the selection of at least one (and preferably a plurality or all) of the selectable positions including one or more of: (a) the amount of one or more awards associated with that selectable position; (b) information enabling an inference of the amount of one or more awards associated with one or more bordering or adjacent selectable positions; (c) information enabling an inference of the amount of one or more awards associated with one or more other of the plurality of selectable positions; (d) information enabling an inference of whether one or more bordering or adjacent selectable positions are associated with any awards; (e) information regarding other awards associated with the selected position; (f) locality information; and (g) other suitable information.

For example, in various embodiments, the information is locality information regarding other selectable positions. Examples of such locality information include, but are not limited to: (a) the relative, approximate or exact position of one or more near-by selectable positions associated with awards; (b) the relative, approximate or exact position of one or more near-by selectable positions not associated with awards; (c) the relative, approximate or exact value of awards associated with one or more near-by selectable positions; and (d) any other kind of information.

Single Player Example Embodiments

FIGS. 4A to 4H illustrates a single player embodiment of a bonus selection game. The selection game is triggered upon the occurrence of any suitable designated triggering event in or associated with a base or primary game. The selection game could also be triggered based on a mystery or other event. In this embodiment, interdependence of the awards enables the player to make better informed subsequent position selections based on information obtained as a result of their previous position selections. The selection game of this embodiment may also be provided as a primary or base game.

Figure 4A:
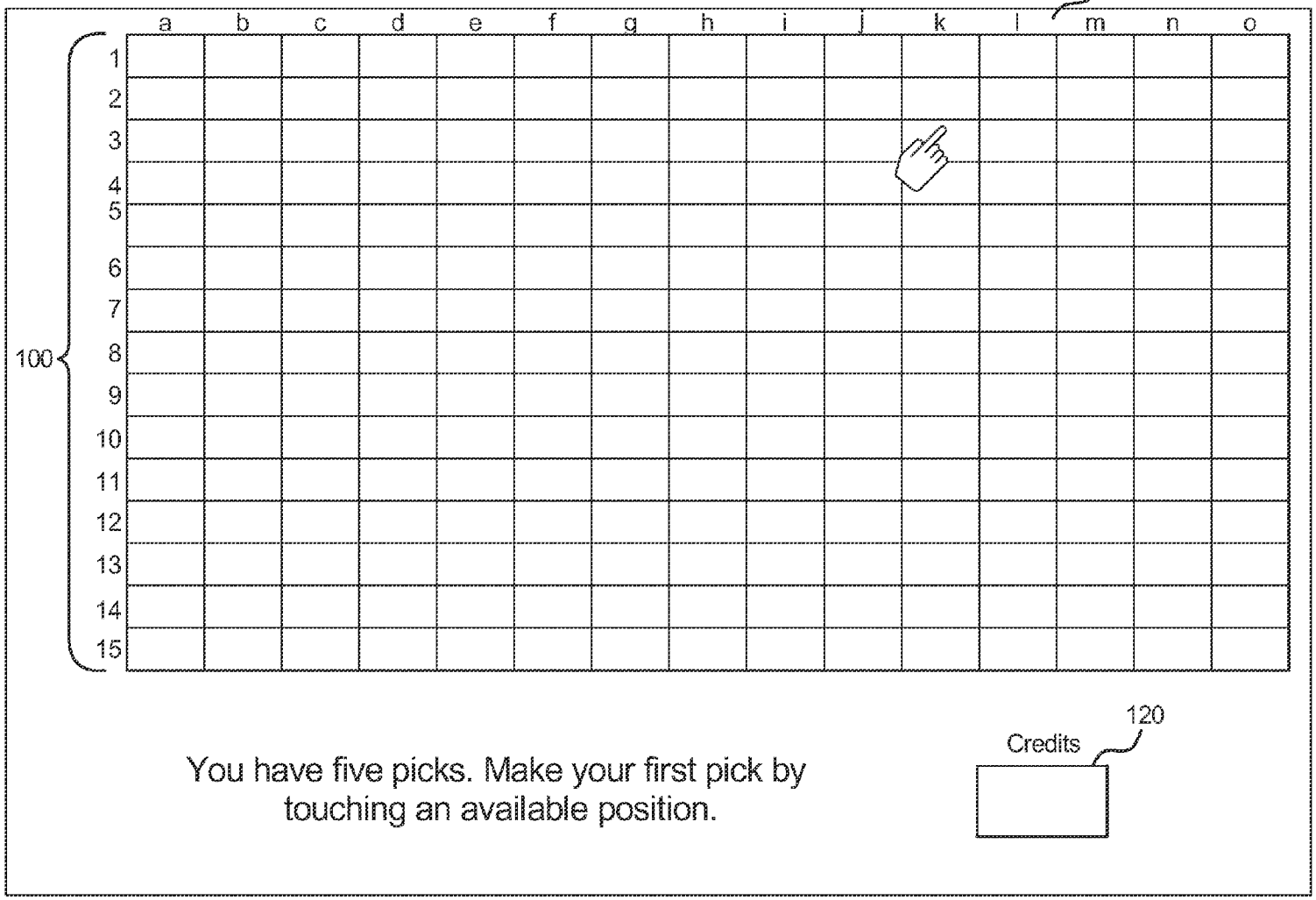

Upon the occurrence of a triggering event, the gaming device displays the bonus selection game as illustrated in FIG. 4A. The gaming device displays a grid 100 including a plurality of selectable positions, 101*a* to 115*o* (the positions in the grid 100 are referenced according to their vertical numerical coordinate and horizontal alphabetical coordinate, (i.e., the top left position in the grid 100 is 101*a* and the bottom right position in the grid 100 is 115*o*)) and provides the player five selections of the selectable positions. It should be appreciated that in various embodiments, the grid itself is always displayed.

The gaming device prompts the player to make their first of five picks of the selectable positions, as illustrated in FIG. 4A. It should be appreciated that in various embodiments, the gaming device may provide the player with any suitable designated number of selections or enable the player to make selections until one of any suitable terminating events occur.

The grid 100 includes fifteen individually selectable vertical and horizontal coordinates. In this embodiment, preferably the screen or display 16 includes a touch screen and a player selects respective positions of the grid 100 by pressing that position directly on the displayed grid 100.

Figure 4B:
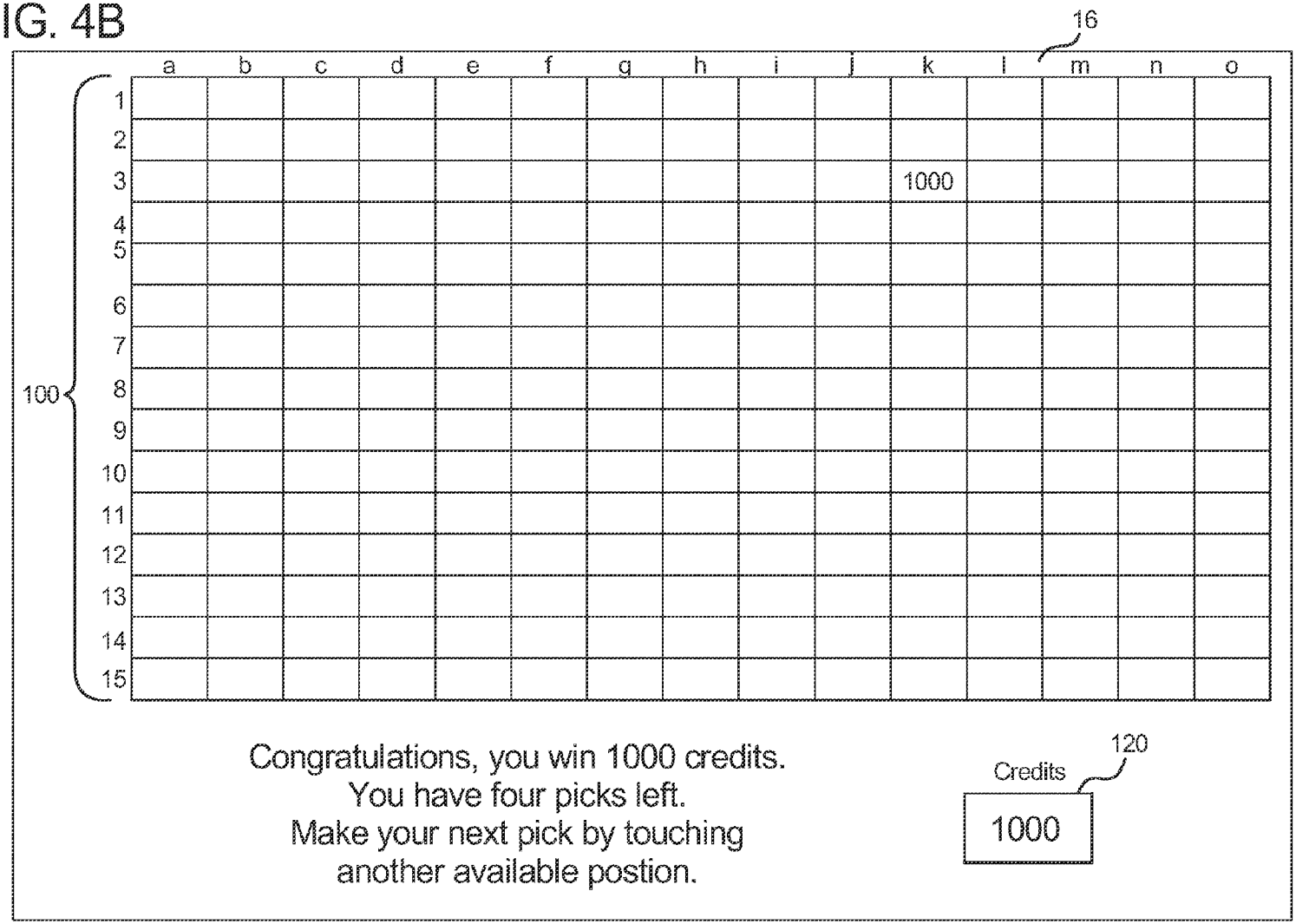

The player first selects position 103*k*, which is associated with an award of 1,000 credits, as illustrated in FIG. 4B. Accordingly, the gaming device provides the player with an award of 1,000 credits, as illustrated in FIG. 4B. The gaming device then prompts the player to make their second of the five selections, as illustrated in FIG. 4B.

Figure 4C:
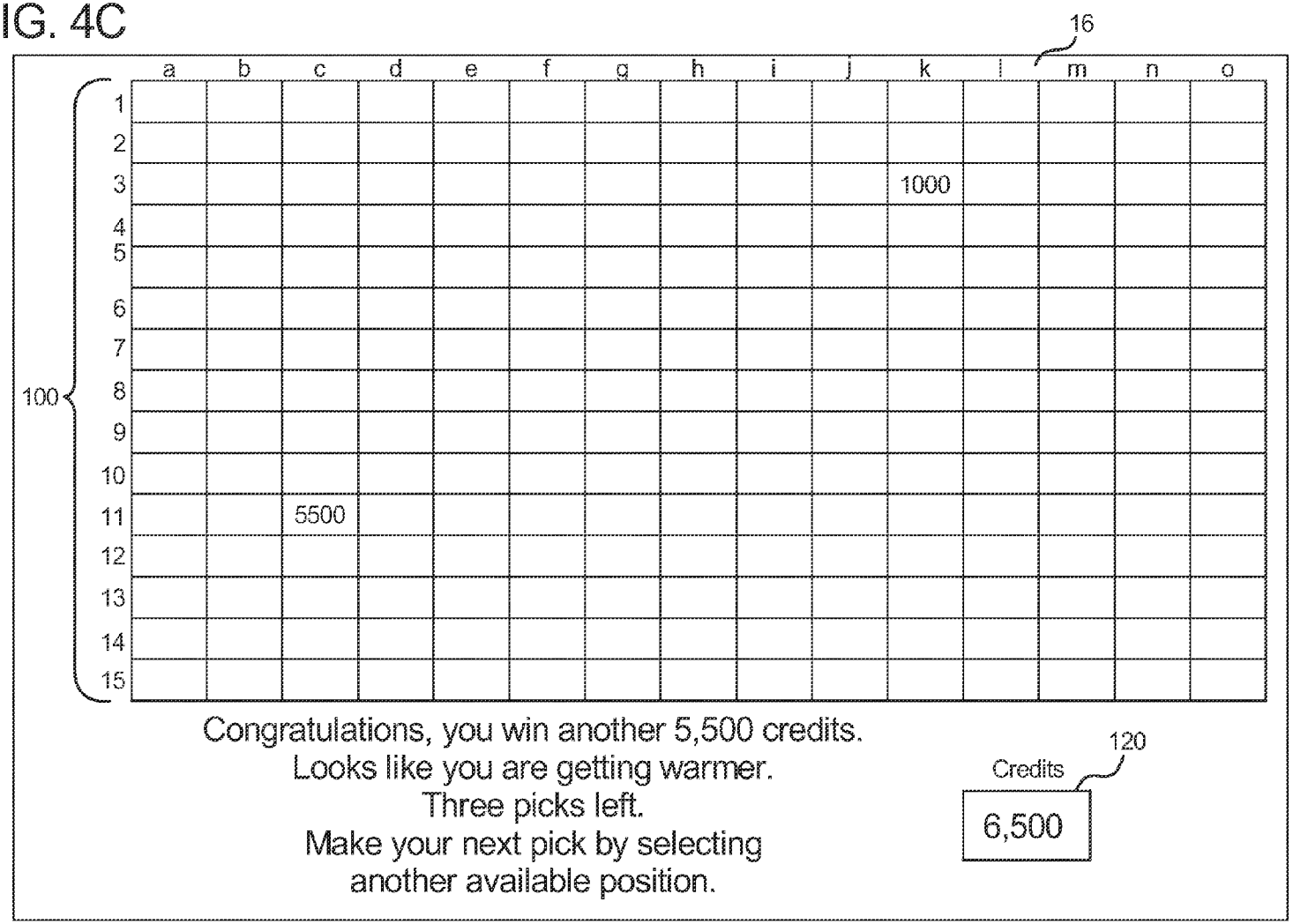
Figure 4D:
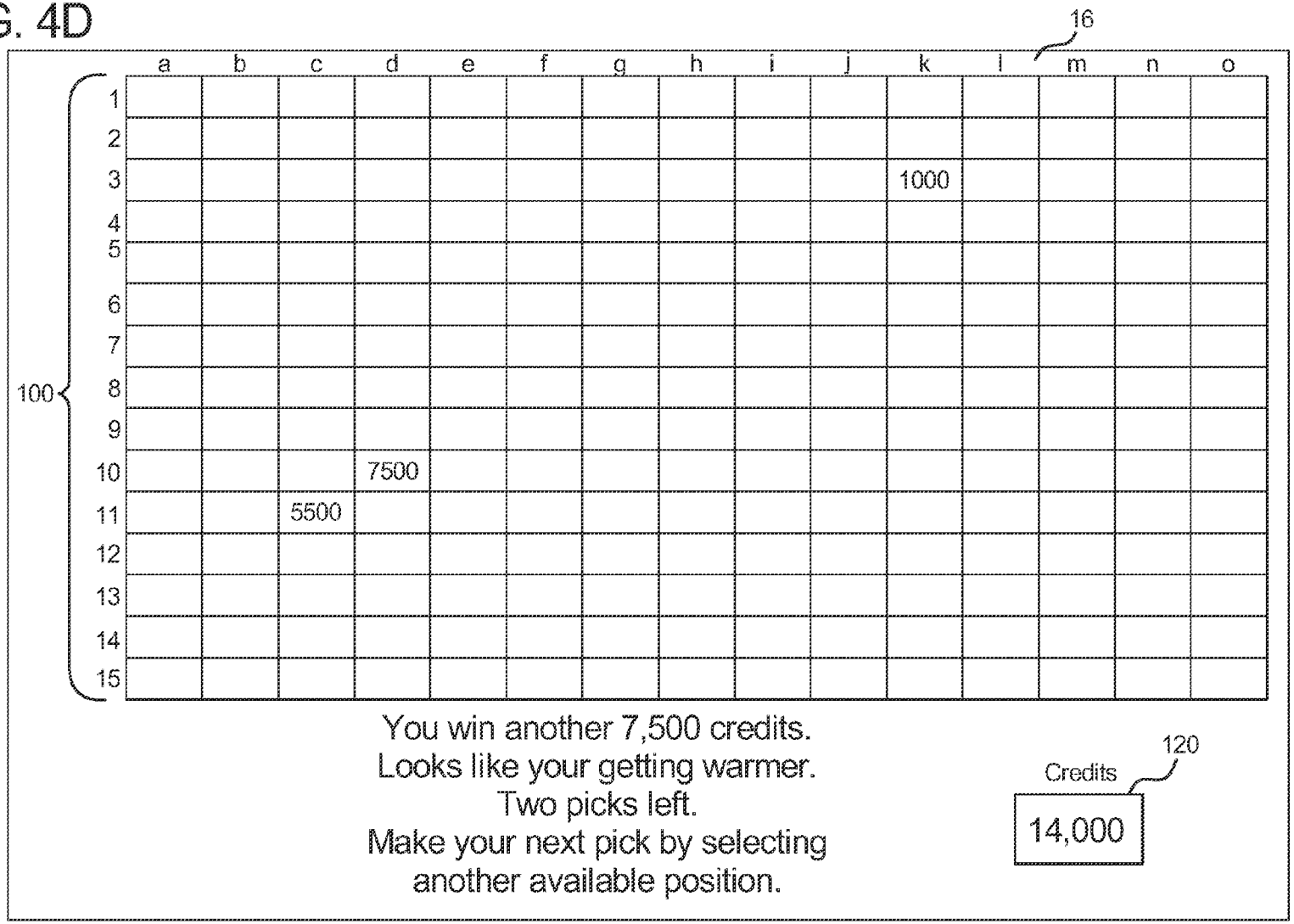

Seeking an area that may contain a much larger award, referring to FIG. 4C, the player selects position 111*c*, located in a much different area on the grid 100. Position 111*c* is associated with an award of 5,500 credits, and accordingly, the gaming device provides the player with an award of 5,500 credits, as reflected in the credit meter 120 in FIG. 4C. The gaming device then instructs the player to make their third pick, as illustrated in FIG. 4C.

The award of 5,500 credits associated with position 111*c* provides the player with information indicative of the general award values of that respective portion of the grid 100. Accordingly, referring to FIG. 4D, for the player's third pick, the player selects position 110*d*, located in the same vicinity as position 111*c*. The player's intuition was correct. Position 110*d* is associated with an award of 7,500 credits and thus, the gaming device provides the player with an additional 7,500 credits, as reflected in the credit meter 120 in FIG. 4D. The gaming device then instructs the player to make their fourth pick.

Figure 4E:
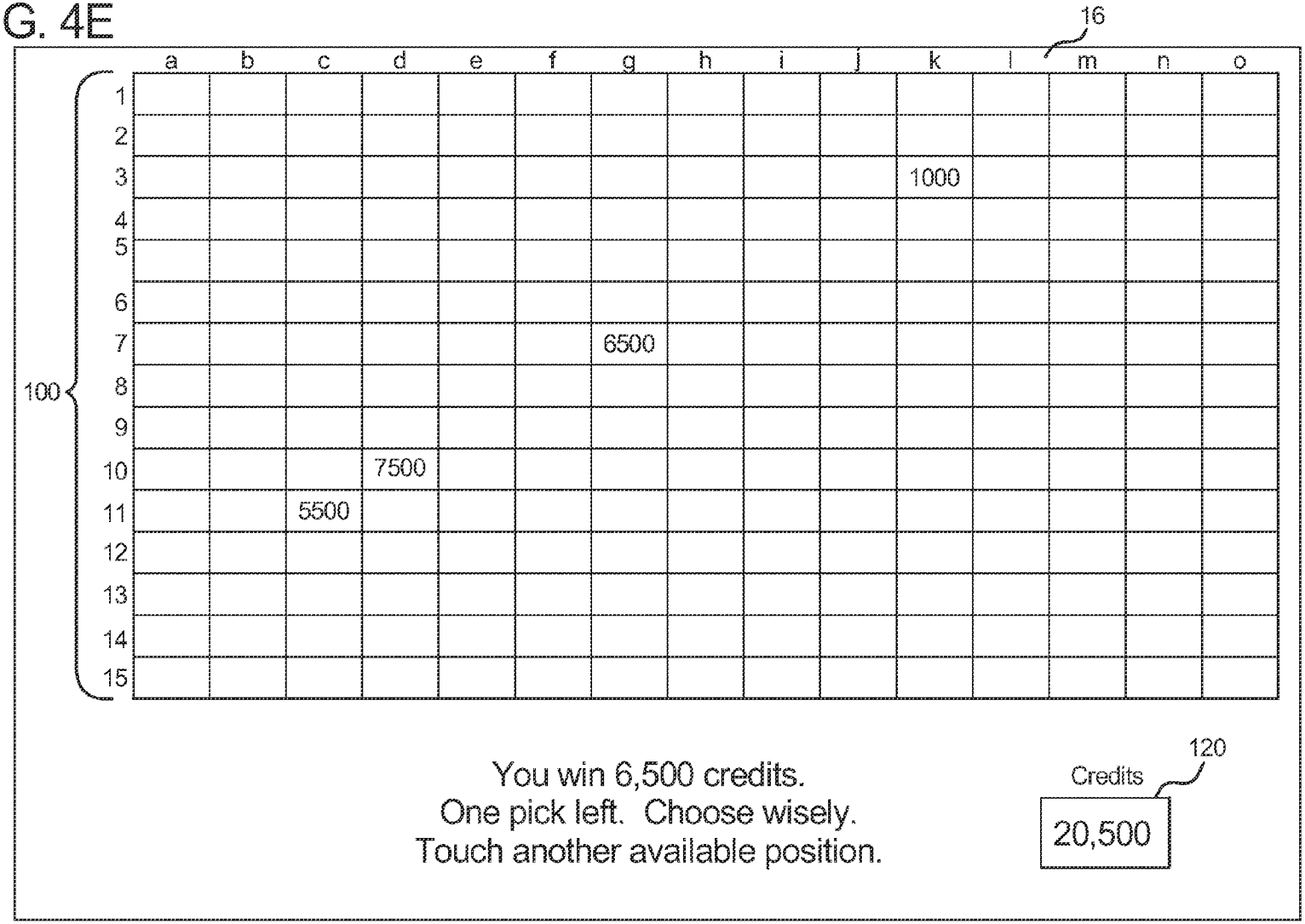

After sequentially selecting positions 111*c* and 110*d* associated with respective awards of 5,500 and 7,500 credits, the player is able to infer that a line defined by positions 111*c* and 110*d* represents an upward trend in awards. Accordingly, the player attempts to select the peak of this trend by selecting position 107*g*, as illustrated in FIG. 4E. Position 107*g* is associated with an award of 6,500 credits and thus, the gaming device provides the player an additional 6,500 credits, as reflected in the credit meter 120 illustrated in FIG. 4E. The gaming device then instructs the player to make their final pick, as illustrated in FIG. 4E.

Figure 4F:
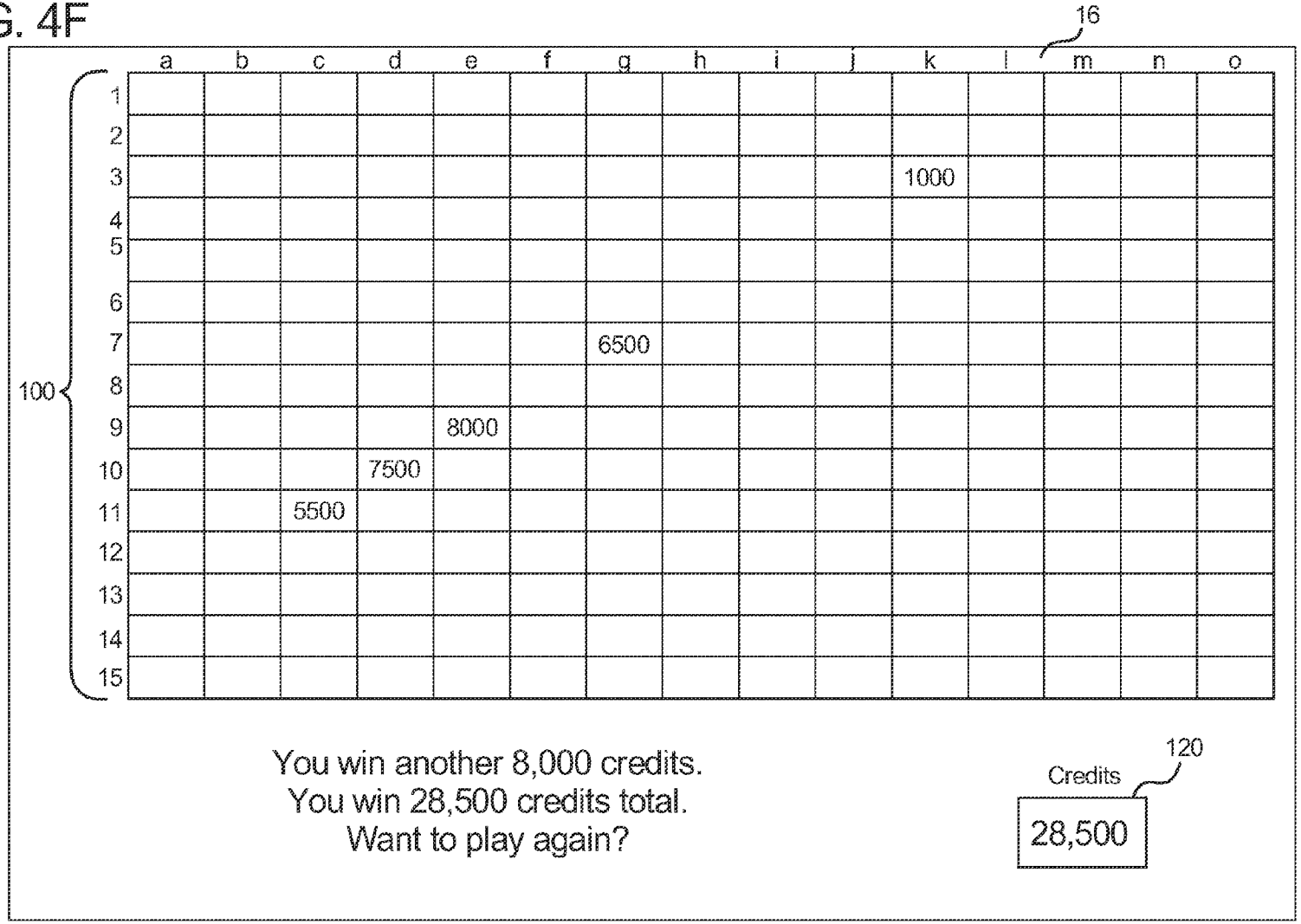

The player appears to have not located the highest award along the line defined by positions 111*c*, 110*d* and 107*g* because the award associated with position 107*g* was lower than that associated with position 110*d*. Accordingly, as illustrated in FIG. 4F, the player's fifth pick is position 109*e*, between positions 110*d* and 107*g*, as illustrated in FIG. 4F. Position 109*e* is associated with an award of 8,000 credits, and thus, the gaming device provides the player with an additional 8,000 credits, resulting in a total accumulated award of 28,500 credits, as reflected in the credit meter 120 in FIG. 4F.

Referring to FIG. 4G, the gaming device displays two-dimensionally each of the awards associated with the grid 100. In this embodiment, the selectable positions include two primary clusters of positions, wherein the awards associated with the selectable positions of each cluster are interdependently related. In FIG. 4G, these two clusters of positions have been emphasized by bold lines for illustrative purposes. The awards associated with the selectable positions in each of the clusters are interdependently related in that the values of the awards associated with each selectable position in each cluster, being within a certain mathematical limit or range relative to its bordering values, provide information which can be subsequently used to more strategically select other selectable positions in the cluster. Each of the illustrated clusters of selectable positions associated with awards includes an area including maximum or larger awards. Generally, as positions near these areas in each cluster, the awards associated with those selectable positions increase.

In FIG. 4G, each of the positions in the grid 100 is associated with an award, although the positions in the clusters are associated with relatively higher awards than the other positions in the grid 100. It should be appreciated that in various other embodiments, all of the positions in the grid 100 need not be associated with an award.

It should be appreciated that in various embodiments, different clusters of positions in the grid 100 are associated with relatively different magnitudes of award values. For example, a first cluster of positions may include positions each associated with relatively large awards and a second cluster of positions may include positions each associated with relatively smaller awards.

It should be appreciated that in various embodiments, each of the awards associated with a play of the game are in a respective cluster.

Figure 4H:
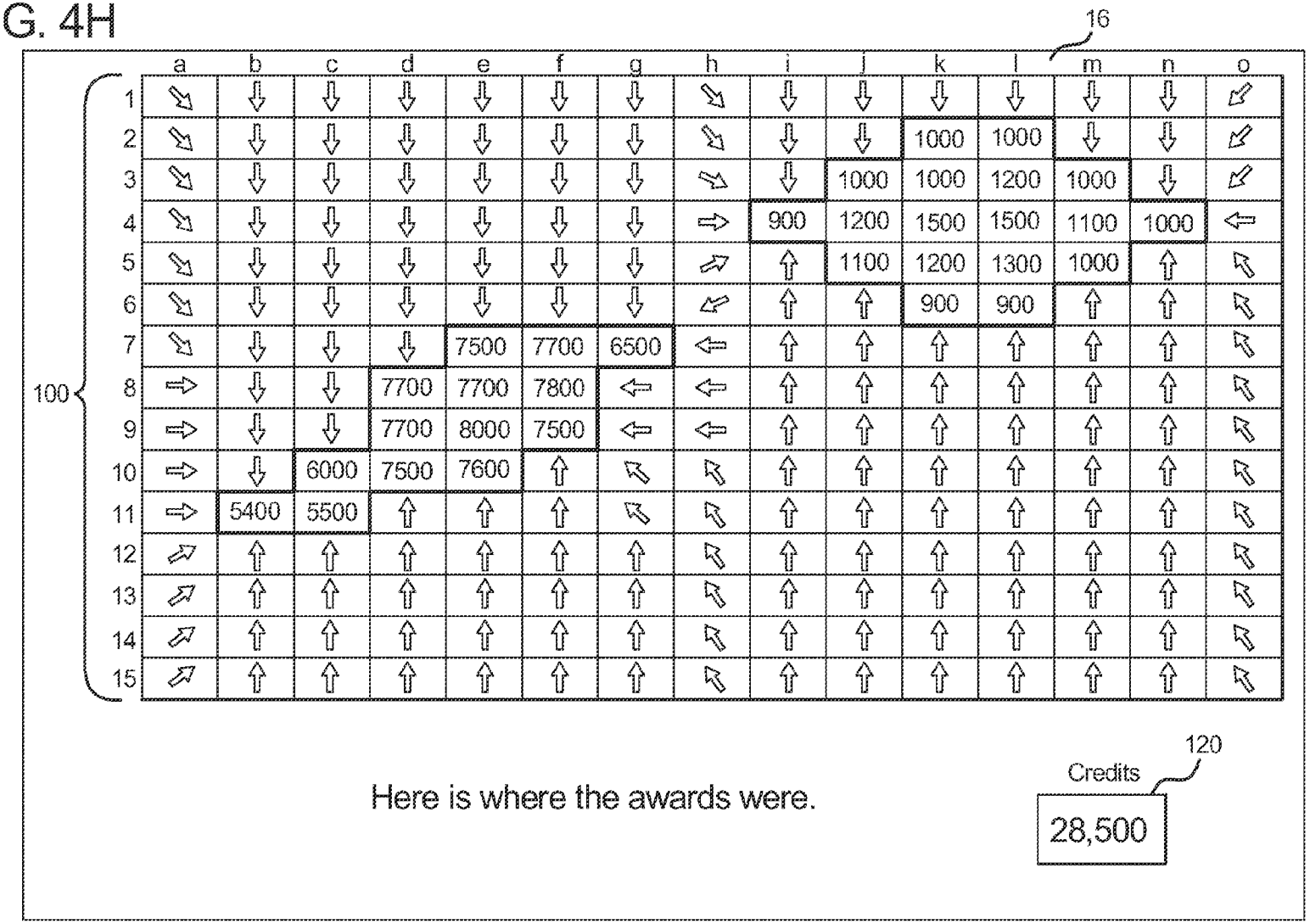

FIG. 4H provides an example of an alternative embodiment in which each of the positions in the grid 100 not associated with a relatively larger award is associated with a piece of locality information. In this example, the locality information is an arrow directing a player to the nearest cluster of positions associated with awards. In such an embodiment, during play of the bonus selection game, a player although using one of their designated number of selections to select such a position, would be able to make a better informed subsequent decision, knowing the general direction of the nearest cluster of positions associated with awards.

Figure 4I:
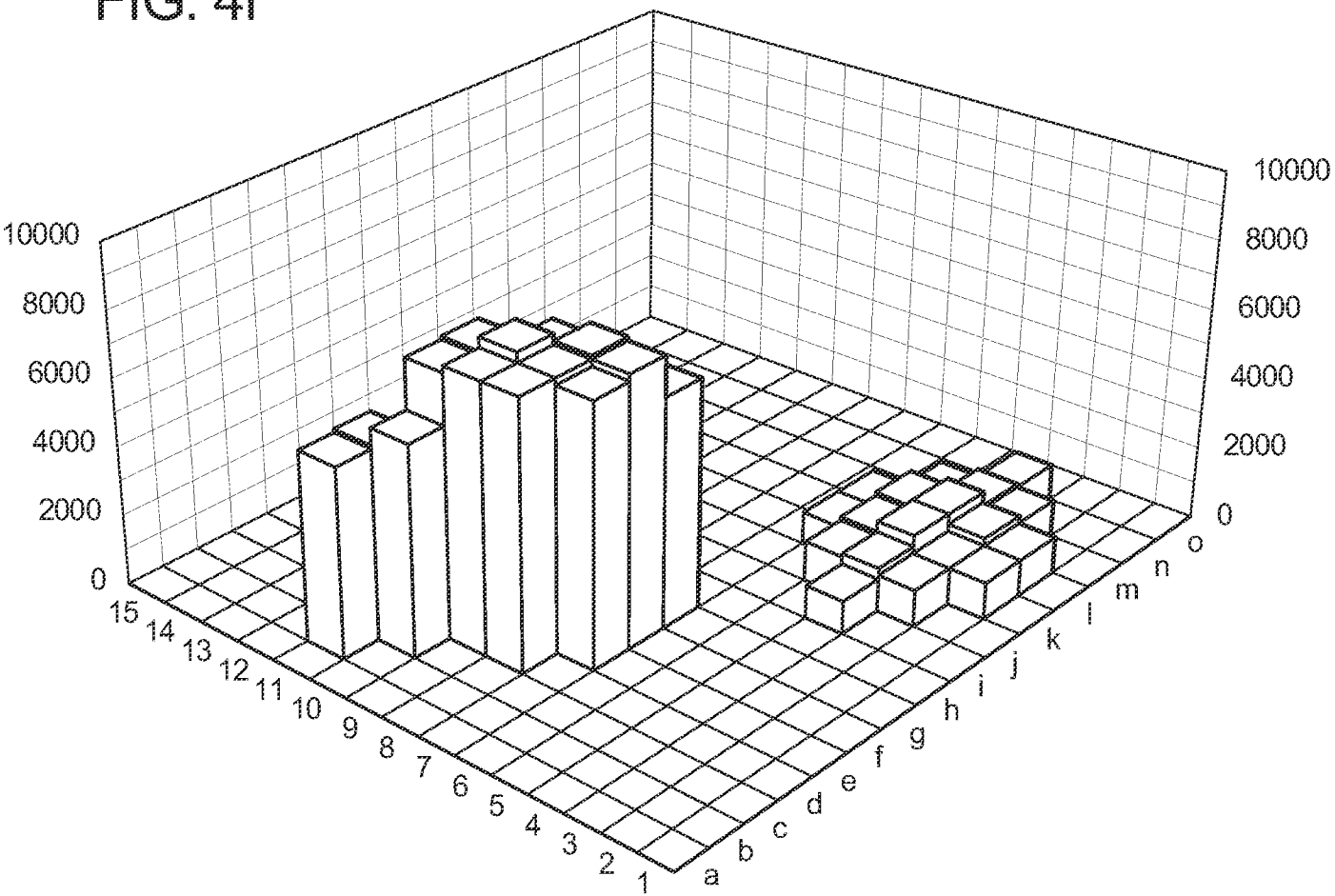

The gaming device may also display a three-dimensional perspective of the awards associated with a plurality of selectable positions in the grid 100, as illustrated in FIG. 4I. It should be appreciated that in various embodiments, peaks in a three dimensional representation of the grid 100 represent higher awards. FIG. 4I illustrates an example in which the award values are reflected as being positive relative to a designated vertical coordinate (0 in FIG. 4I). Examples of game themes which could utilize such a graphical representation of and mathematical distribution of awards include games involving a city landscape or mountainous region or aviation themed games. It should be appreciated that any suitable game theme may be used for this type of embodiment.

Figure 4J:
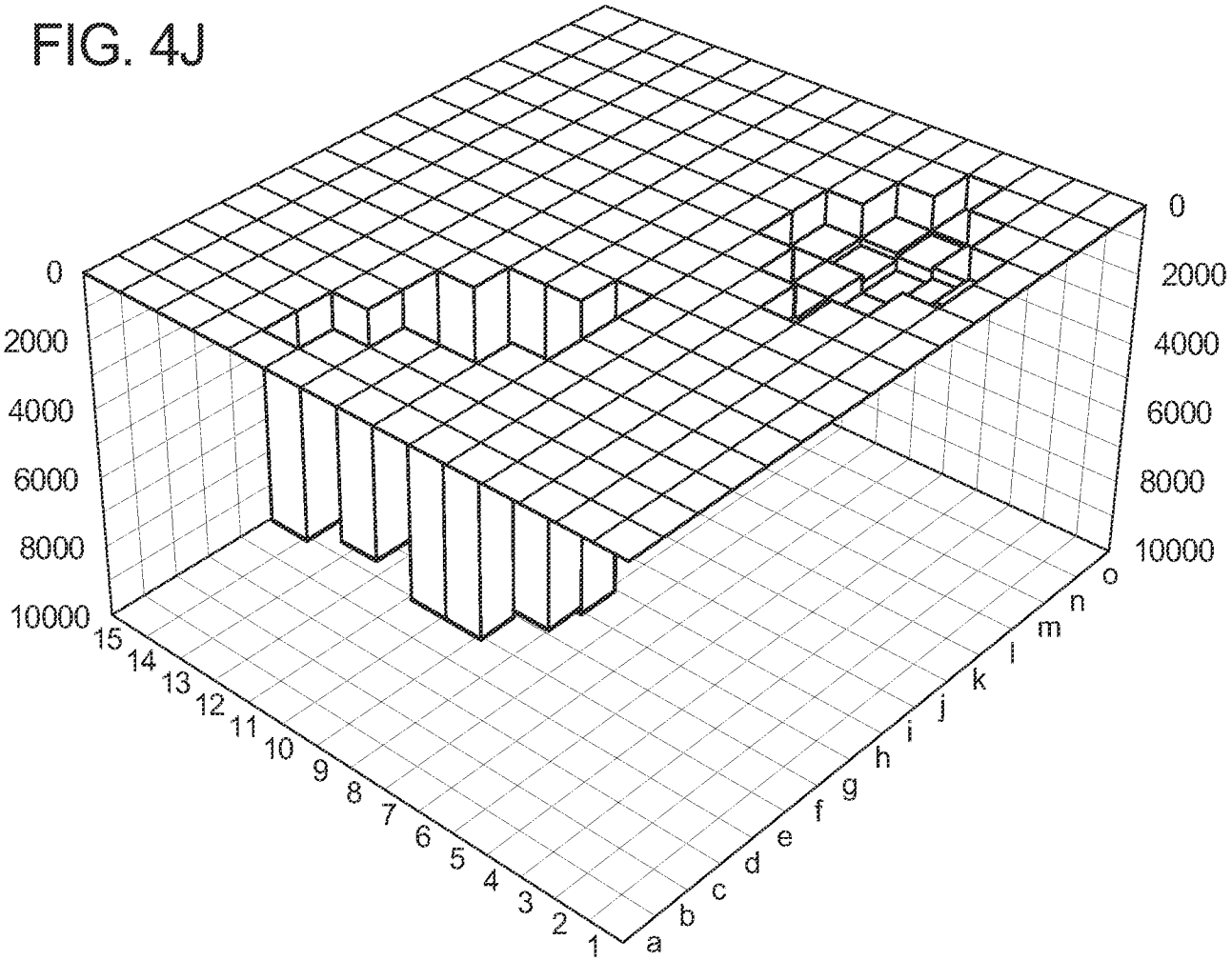

Referring to FIG. 4J for illustrative purposes, various other embodiments of the selection game could include an ocean theme, for example, where award values are reflected as being negative relative to a designated vertical coordinate (0 in FIG. 4J), when mathematically, the player receives the absolute value of the award value. In such embodiments, deeper ocean depths are associated with larger awards, and thus, the game theme lends itself to the graphical depiction of FIG. 4J. The depths (award amounts) form a hidden seascape following semi-realistic contours. It should be appreciated that any suitable game theme may be used for this type of embodiment.

Figure 4K:
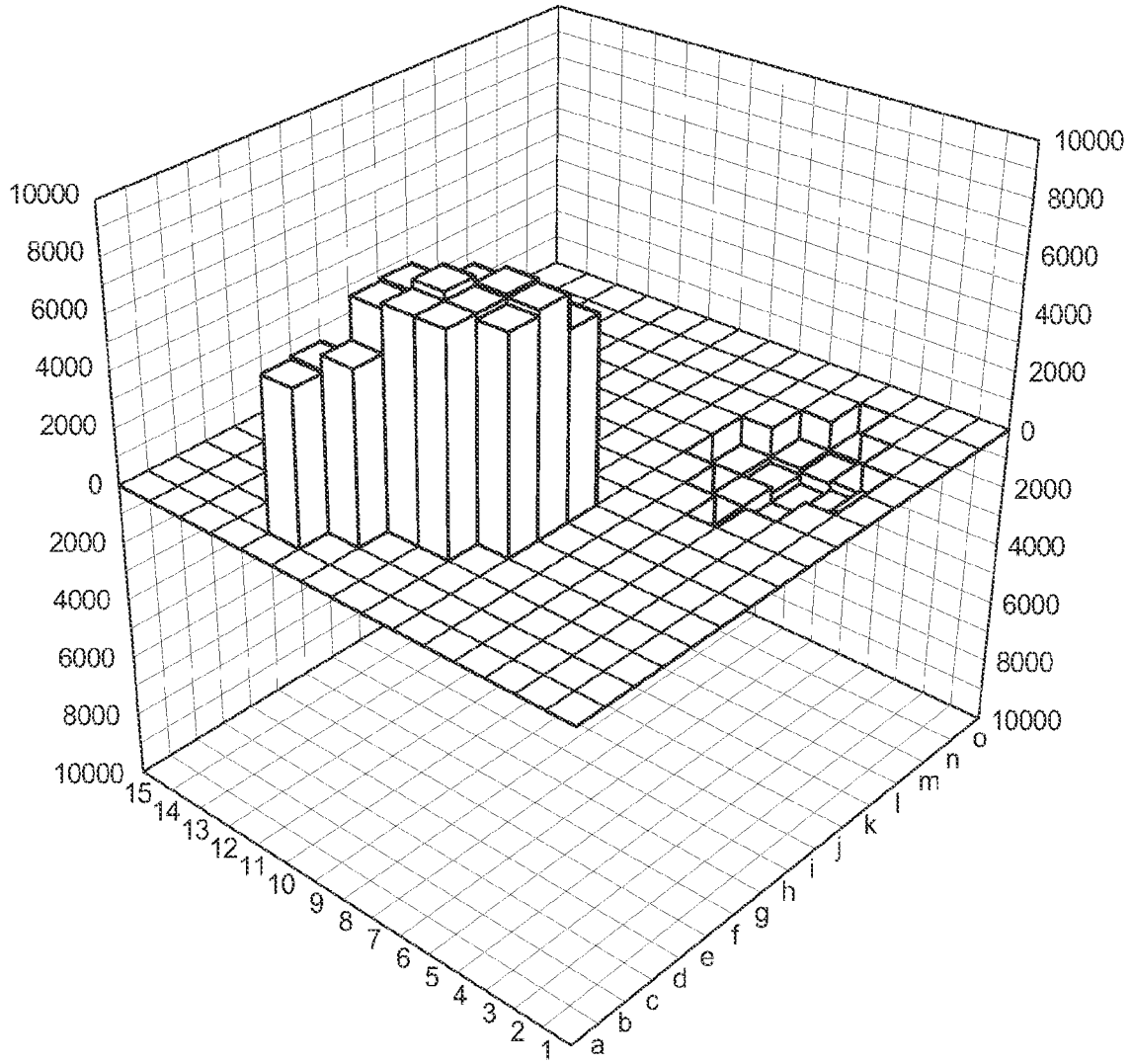

Referring now to FIG. 4K for illustrative purposes, various other embodiments of the selection game could include geographic themes encompassing both values reflected as being positive and negative relative to a designated vertical coordinate (0 in FIG. 4K). For example, an outdoor-themed game could include a three-dimensional landscape encompassing both a mountainous region and a lake, or body of water. In such embodiments, deeper water depths are associated with larger awards, as are higher altitude locations associated with a mountain, for example. It should be appreciated that any suitable game theme may be used for this type of embodiment.

It should be appreciated that in various embodiments, the gaming device displays the three-dimensional representation of the grid separate from the two-dimensional representation of the grid 100 as the player is making selections, making the reading of the three-dimensional map and determination of what positions on the grid 100 correspond to what positions on the three dimensional representation of the grid 100 a skill component of the selection game.

In various other embodiments, the gaming device displays a two-dimensional or three-dimensional image of the grid 100 including a display of one or more of the awards associated with a plurality of the selectable positions in the grid prior to starting the player's play of the selection game. If a subsection of the grid 100 is displayed, in various embodiments, the gaming device randomly determines which subsection to display or displays a predetermined subsection. By previewing at least a portion of the awards associated with plurality of selectable positions in the grid 100, the player gets an idea of the patterns, valleys, atolls, shallows, canyons, cliffs, etc. (or for other game themes, similar relevant information) that are included in the distribution of the awards about the plurality of selectable positions in the grid 100. This incorporates some level of player skill into the selection game in that the player may attempt to memorize certain award patterns in the grid 100.

In various other embodiments including an ocean theme, prior to beginning the selection game, the gaming device enables a player to select a particular region of the world or ocean for the game, varying the volatility of the terrain. For example, the Caribbean has a rather smooth ocean bottom without many extremes. The South Pacific has large canyons but also large sand bars. It should be appreciated that this sort of player selection, varying the difficulty or volatility of the bonus game, is applicable to any suitable game theme.

In various other embodiments, the gaming device assists the player during play of the game. For example, in one embodiment, the gaming device provides the player with clues (such as shading each picked position, showing the player the direction of an increasing or decreasing award pattern associated with that position). In one such embodiment including an ocean theme, the gaming device enables players to select a portion of ocean (a portion of the grid), for example, with murky bottoms that give no surface direction information, but include higher award amounts associated with deeper positions. This concept could apply to any game theme.

In addition to or instead of an award, in various other embodiments, one or more of the plurality of positions in the grid 100 may be associated with: (a) a plurality of awards; (b) a plurality of levels (i.e., depths); (c) a symbol; (d) a piece of information; (e) a terminating condition or event; (f) a modifier; (g) any combination of these; and (h) any other suitable symbol or event.

Although in this embodiment, the player selects the selectable positions using an input device, such as a touch screen, in various other such embodiments, the positions could be selected: (a) randomly by the gaming device; (b) in a predetermined manner by the gaming device; (c) by an avatar displayed by the gaming device and controlled by a player; (d) by an avatar displayed by the gaming device and acting according to artificial intelligence; (e) any combination of these; and (f) any other suitable manner of selection.

In various embodiments, the gaming device places at least one restriction on one or more selections of the selectable positions in the grid 100 by the player. Examples of such restrictions could include: (a) limiting the player to a designated amount of time to make each selection; (b) limiting the total number of positions between a selected position and a subsequently selected position; (c) any combination of these; and (d) any other suitable restrictions.

In various embodiments, the award associated with one of, a plurality or each of the plurality of positions may include: (a) a number of credits; (b) a number of free spins or activations; (c) a number of activations or plays of a bonus game; (d) a number of selections; (e) a physical prize; (f) promotional points; (g) player tracking points; (h) money; (i) award modifiers; (j) special advantages (i.e., the ability to see awards immediately adjacent to or bordering the current selection, or the ability to see if the awards generally increase or decrease immediately adjacent to or bordering the currently selected position); (k) any combination of these; and (l) any suitable award.

It should be appreciated that although this embodiment was described as a single player game, the same game principle could be implemented by the gaming device in a multi-player format, wherein the players alternate selections and the interdependence of the awards enables the players make subsequent position selections based both on their previous selections and other players' previous selections.

Multi-Player Example Embodiment

FIGS. 5A to 5H illustrate an embodiment in which the selection game is a multi-player primary game wherein each of a plurality of players are provided with a designated number of selections of the selectable positions upon placement of a wager. In this embodiment, interdependence of the awards enables the players make subsequent position selections based both on their previous selections and other players' previous selections. The selection game of this embodiment may also be provided as a multi-player secondary game which can be triggered in any suitable manner.

In this embodiment, the gaming device includes a grid 200 including a plurality of selectable positions, 201*a* to 210*j* (the positions in the grid 200 are referenced according to their vertical numerical coordinate and horizontal alphabetical coordinate, (i.e., the top left position in the grid 200 is 201*a* and the bottom right position in the grid 200 is 210*j*)), as illustrated in FIG. 5A. In this embodiment, the selectable positions in the grid 200 include a plurality of clusters of positions, wherein the one or more awards associated with the selectable positions of each of the plurality of clusters are interdependently related, as illustrated in FIG. 5A. One or more of the awards associated with the selectable positions in each of the plurality of clusters are interdependently related in that the values of the awards associated with each selectable position in each cluster provide information which can be subsequently used to more strategically select other selectable positions in the cluster. Each of the illustrated clusters of selectable positions associated with awards includes an area including maximum or larger awards. Generally, as positions near the these areas in each cluster, the awards associated with those selectable positions increase, as illustrated in FIG. 5A.

In this embodiment, each of the positions in the grid 200 is associated with a plurality of levels or stages, each of which may be associated with an award. FIG. 5A illustrates the first level of each of the plurality of selectable positions on the grid 200. In FIG. 5A, the majority of the positions in grid 200 include first levels which are associated with an award. It should be appreciated that in various other embodiments, the first level of each of the positions in the grid 200 is associated with an award. It should also be appreciated that in various other embodiments, the first or other levels of certain of the positions in the grid 200 is associated with a piece of locality information (i.e., an arrow directing a player to near-by awards). A player selects the first level of a selectable position by selecting the position for the first time. Each subsequent time that position is selected, the next respective level associated with that position is selected. Table 240 of FIG. 5B illustrates for each of the plurality of selectable positions in the grid, what, if any, award is associated with each of the levels of the plurality of positions. Certain levels of a plurality of the selectable positions of the grid 200 are associated with a stop symbol, which prevents the selection of further levels for that position. It should be appreciated that in various embodiments, each of the positions in the grid 200 may be associated with any number of levels or stages. In this embodiment, although more than five levels or stages are not illustrated, for each of the positions in the grid 200, what would be a sixth level or stage is associated with a stop symbol. It should be appreciated that although this embodiment of the grid 200 includes one hundred positions, in various other embodiments the grid 200 includes various other designated numbers of positions. In another alternative embodiment, the grid 200 includes a number of positions which varies as a function of the number of players which place a wager on the game.

Figure 5C:
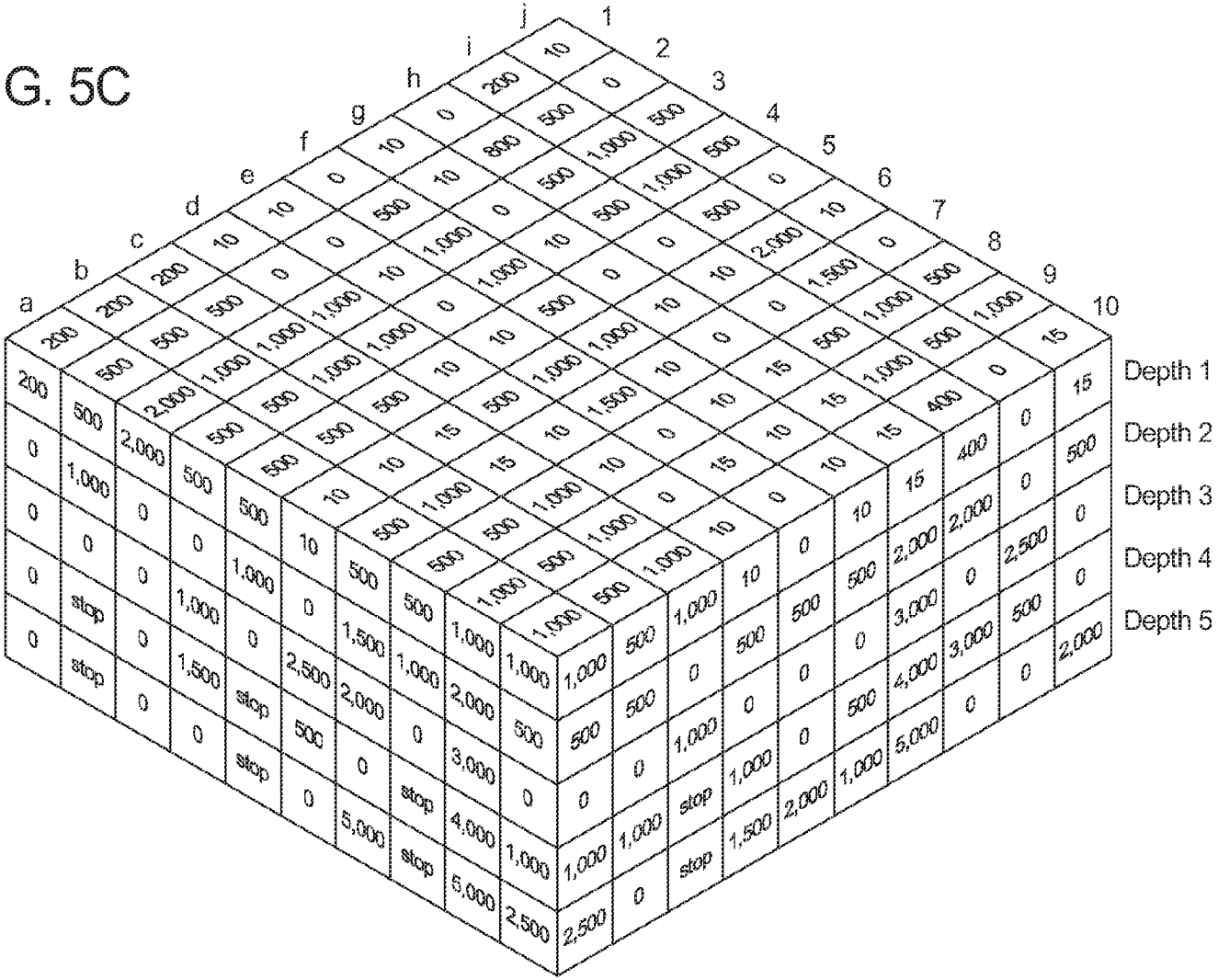

FIG. 5C provides a perspective three-dimensional view of the table of FIG. 5B, which visually illustrates the different levels, stages or depths of certain of the positions in the grid in a different manner. It should be appreciated that FIG. 5C has been provided for illustrative purposes and does not show each of the levels or stages of each of the positions in the grid 200 and may not be exactly to scale. It should be appreciated that in various embodiments, such a perspective three-dimensional may be partially cutaway to show additional values associated with various positions and levels.

Figure 5D:
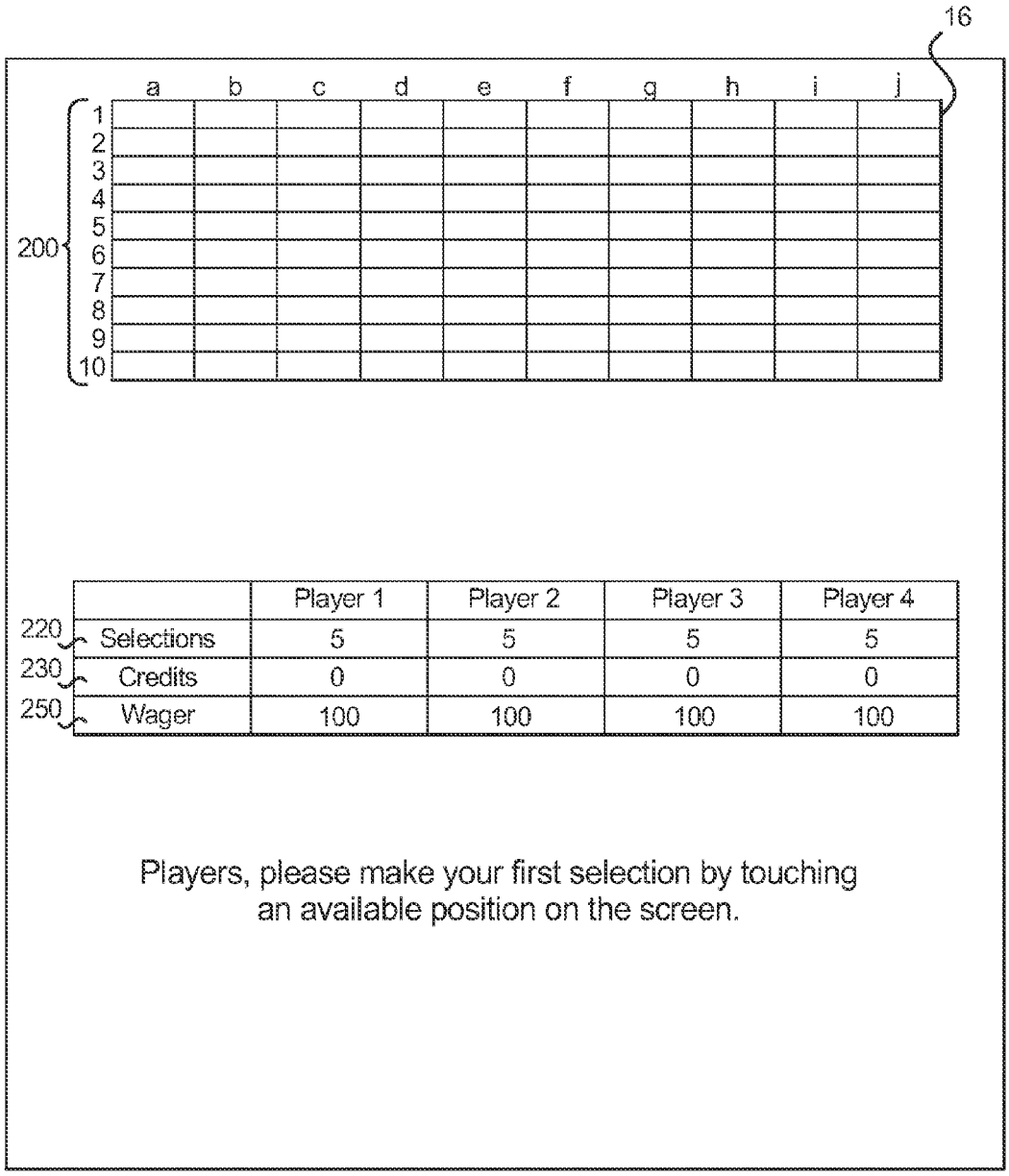

Referring now specifically to FIG. 5D, the gaming device accepts a wager of 100 credits from each of four players. The gaming device provides each of the four players with five selections, as illustrated in FIG. 5D on selection display 220. It should be appreciated that although in this example each of the four players begin play of the game at the same time, in various other embodiments, new players may enter play of the game at designated intervals (i.e., every 45 seconds in an extended or persistence type version of the game) or points in game play (i.e., after each of the plurality of active players have made a move in the game). Also, it should be appreciated that although in this embodiment, each of the players received five selections for a play of the game, in various other embodiments, the gaming device provides players with other numbers of selections upon the placement of a designated wager.

The grid 200 includes ten individually selectable vertical and horizontal coordinates. Preferably the screen or display 16 includes a touch screen, and players select respective positions on the grid 200 by touching that position directly on the displayed grid 260. It should be appreciated that in this embodiment, each player has their own display, on which they select positions. In various other embodiments, players select positions on a single display. In other embodiments, players select positions on respective individual displays, with the gaming system also including a master display viewable be each of the players.

Referring to FIG. 5D, the players are prompted to make their first position selection. Player one selects position 205*d*; player two selects position 205*j*; player three selects position 202*b*; and player four selects position 209*g*. In this embodiment, the players are represented on the grid by respective displayed avatars 214*a*, 214*b*, 214*c* and 214*d*. Thus, after the players make their first position selections, the gaming device displays avatar one 214*a* at position 205*d*; displays avatar two 214*b* at position 205*j*; displays avatar three 214*c* at position 202*b*; and displays avatar four 214*d* at position 209*g*, as illustrated in FIG. 5E.

Figure 5E:
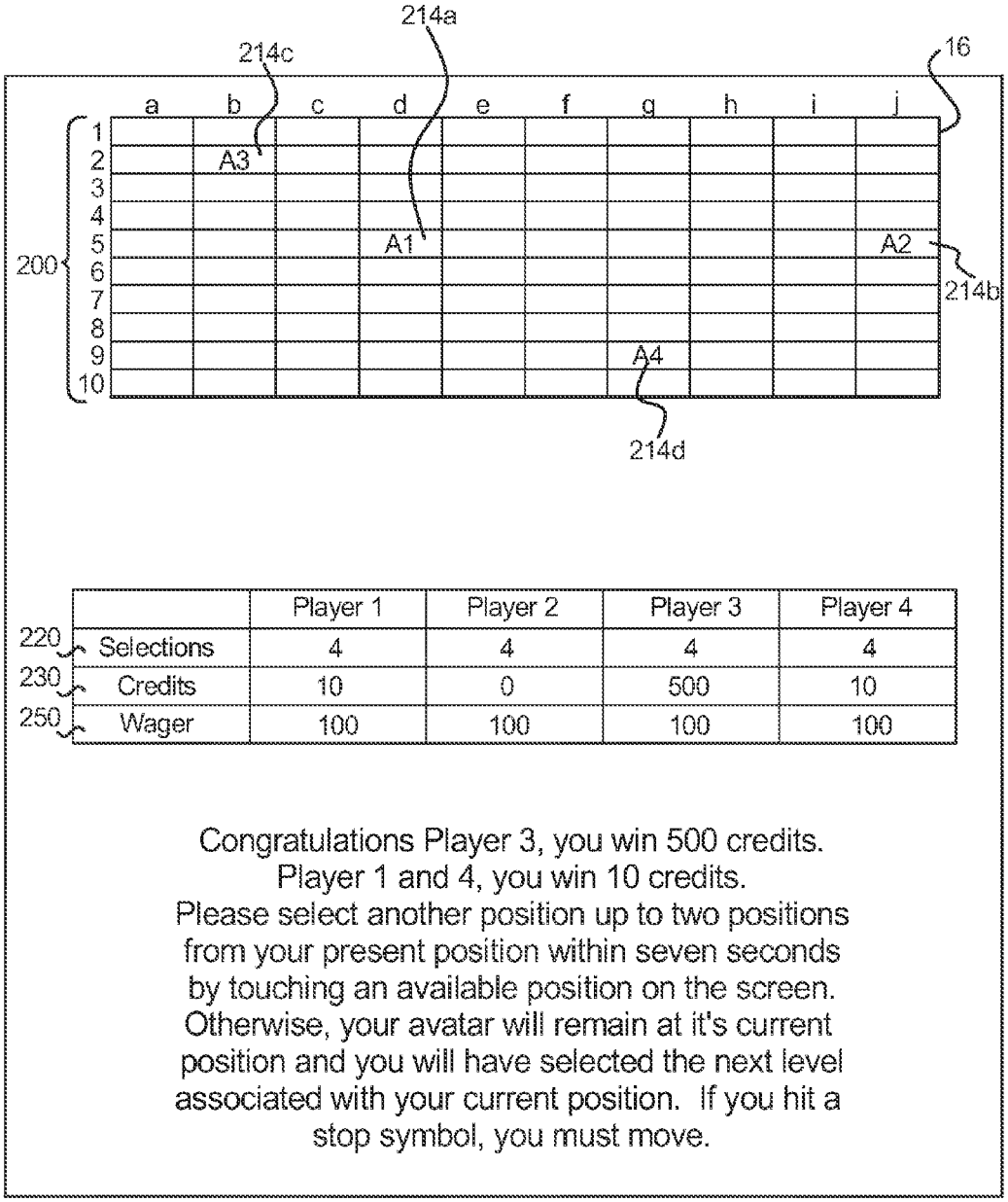

Referring to the award table 240 in FIG. 5C and the credit display 230 in FIG. 5E: the first level of position 205*d* occupied by avatar one 214*a* is associated with an award of 10 credits, thus the gaming device provides player one an award of 10 credits; the first level of position 205*j* occupied by avatar two 214*b* is not associated with an award; the first level of position 202*b* occupied by avatar three 214*c* is associated with an award of 500 credits, thus the gaming device provides player three an award of 500 credits; and the first level of position 209*g* occupied by avatar four 214*d* is associated with an award of 10 credits, thus the gaming device provides player four an award of 10 credits.

As illustrated in FIG. 5E, each of the players have four selections remaining after the first pick. Each of the players see any award resulting from each of the players' prior location on the credit display 230. It should be appreciated that in various other embodiments, the gaming device does not display awards resulting from a player's selection of a particular position to other players playing the game until the player's avatar moves from that particular position. After the first pick, each of players one, two and four will notice that player three was the only player to receive a relatively large award. Accordingly, players one, two and four infer that there may be higher valued awards in the vicinity of player three's avatar 214*c* at position 202*b*. Each of the players have seven seconds to select another position for their respective avatar, up to two positions from its present position. In this example, two avatars may not occupy a same position. However, it should be appreciated that in various other embodiments, two or more avatars can occupy the same position. Players need not move their avatar, unless the respective players hit a stop symbol associated with the respective level of their position. In this example, there is an implied stop symbol after the fifth level of every grid position.

In one embodiment, a stop designation can coincide with a value designation in the same position and level. If a player has reached a level associated with a stop symbol or event, in various embodiments, there are different game events which follow, including but not limited to: (a) forcing the player to relocate; (b) automatically relocating the player to the nearest open position; (c) automatically relocating the player to a random location; (d) automatically relocating player to a specific location; (e) ending the game for said player; (f) ending the game for all players in the game; (g) advancing the player to a new round of play; (h) deducting a number of turns from the player; (i) deducting repositioning allowance from the player; (j) deducting redemption efficiency from the player; (k) allowing the player to stay in place and essentially lose pick opportunities; and (l) in a multiplayer version, allowing other players to trap said player in said player's position.

In various embodiments, various criteria can govern one or more players' ability to see other players' position selections. In such embodiments, the degree to which one or more players may see other players' selections may be: predetermined, randomly determined, determined based on the player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day), determined based on an amount of coin-in accumulated in one or more pools or determined based on any other suitable method or criteria.

Figure 5F:
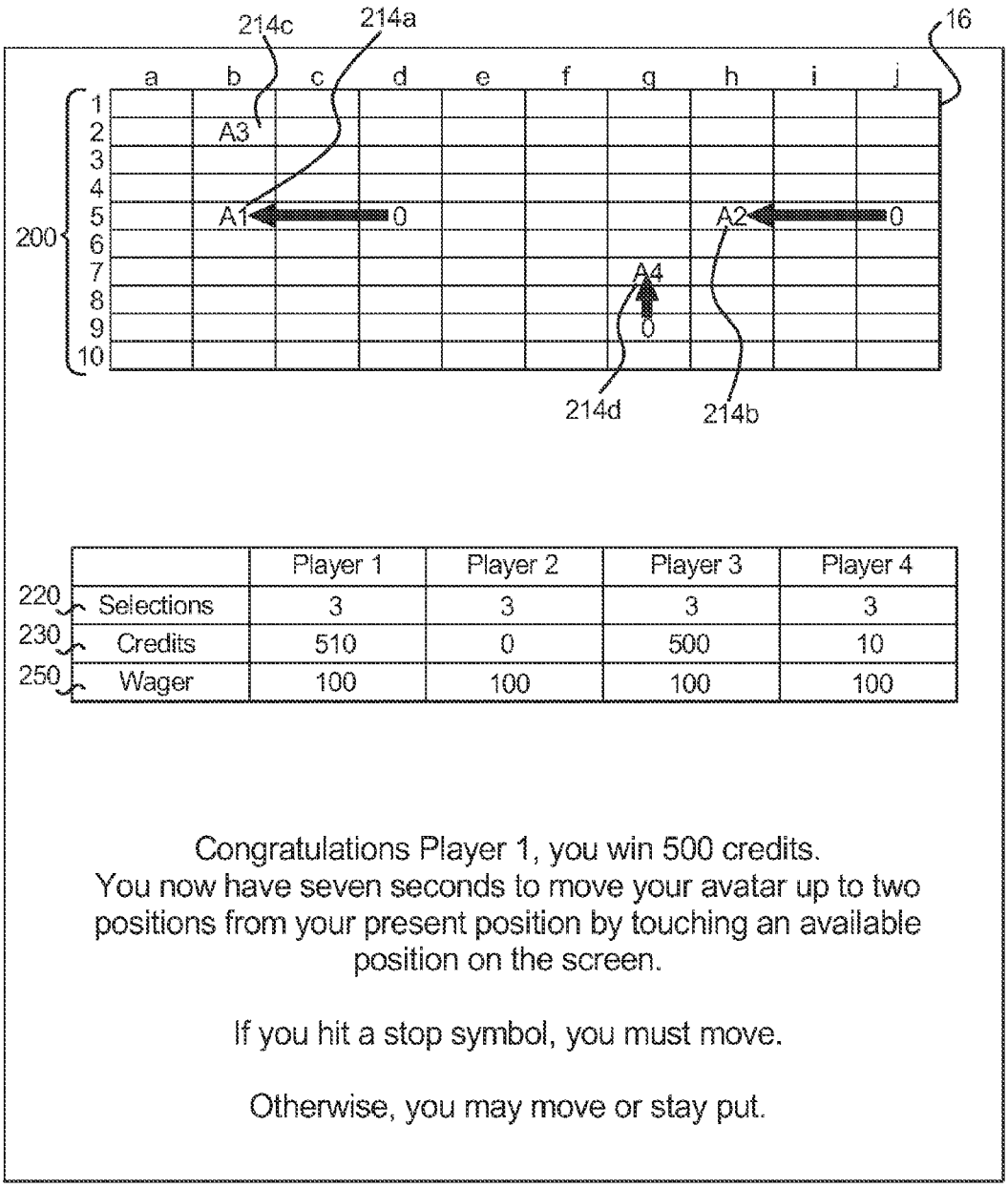

Referring now to FIG. 5F, seeing that player three received an award, each of players one, two and three cause the gaming device to move their respective avatars 214*a*, 214*b* and 214*d* as follows: avatar one 214*a* moves from position 205*d* to position 205*b*; avatar two 214*b* moves from position 205*j* to position 205*h*; and avatar four 214*d* moves from position 209*g* to position 207*g*. Content with having received an award and hopeful for more awards to follow at further depths, player three causes their avatar 214*c* to remain at position 202*b*, as illustrated in FIG. 5F.

Referring to FIG. 5B and the credit display 230 in FIG. 5F: the first level of position 205*b* occupied by avatar one 214*a* is associated with an award of 500 credits, thus the gaming device provides player one with an award of 500 credits; the first level of position 205*h* occupied by avatar two 214*b* is not associated with an award; the second level of position 202*b* still occupied by avatar three 214*c* is not associated with an award; and the first level of position 207*g* occupied by avatar four 214*d* is not associated with an award.

Figure 5G:
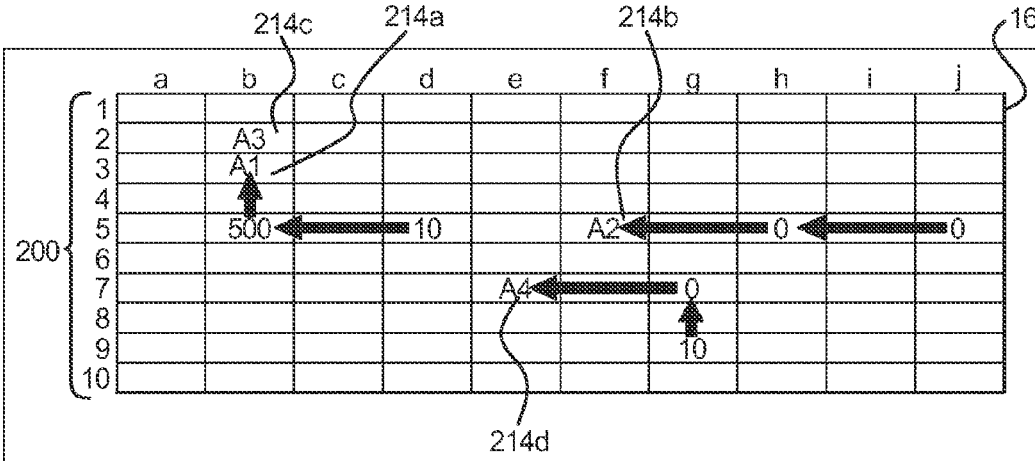

Based on the results illustrated in credit display 230 in FIG. 5F, player one, having received an award of 500 credits, still has a hunch there are more awards closer to avatar three 214*c*, still located at position 202*b*. Accordingly, player one causes avatar one 214*a* to move from position 205*b* to position 203*b*, as illustrated in FIG. 5G. Player two, still not having received any awards, wants to move closer to players one and three, who have received awards. Accordingly, as illustrated in FIG. 5G, player two causes avatar two 214*b* to move from position 205*h* to position 205*f*. Player three, having invested two selections in position 202*b* decides it is worth selecting one further level and causes avatar three 214*c* to remain positioned at position 202*b*, as illustrated in FIG. 5G. Player four, just as player two, still not having received any awards, wants to move closer to players one and three, who have received awards. Accordingly, as illustrated in FIG. 5G, player four causes avatar two 214*d* to move from position 207*g* to position 207*e*.

Referring to FIG. 5B and the credit display 230 in FIG. 5G: the first level of position 203*b* occupied by avatar one 214*a* is associated with an award of 500 credits, thus the gaming device provides player one with an award of 500 credits; the first depth of position 205*f* occupied by avatar two 214*b* is also associated with an award of 500 credits, thus the gaming device provides player two with an award of 500 credits; the third level of position 202*b* still occupied by avatar three 214*c* is associated with an award of 1,000 credits, thus the gaming device provides player three with an award of 1,000 credits; and the first depth of position 207*e* occupied by avatar four 214*d* is associated with an award of 1,500 credits, thus the gaming device provides player four with an award of 1,500 credits.

Figure 5H:
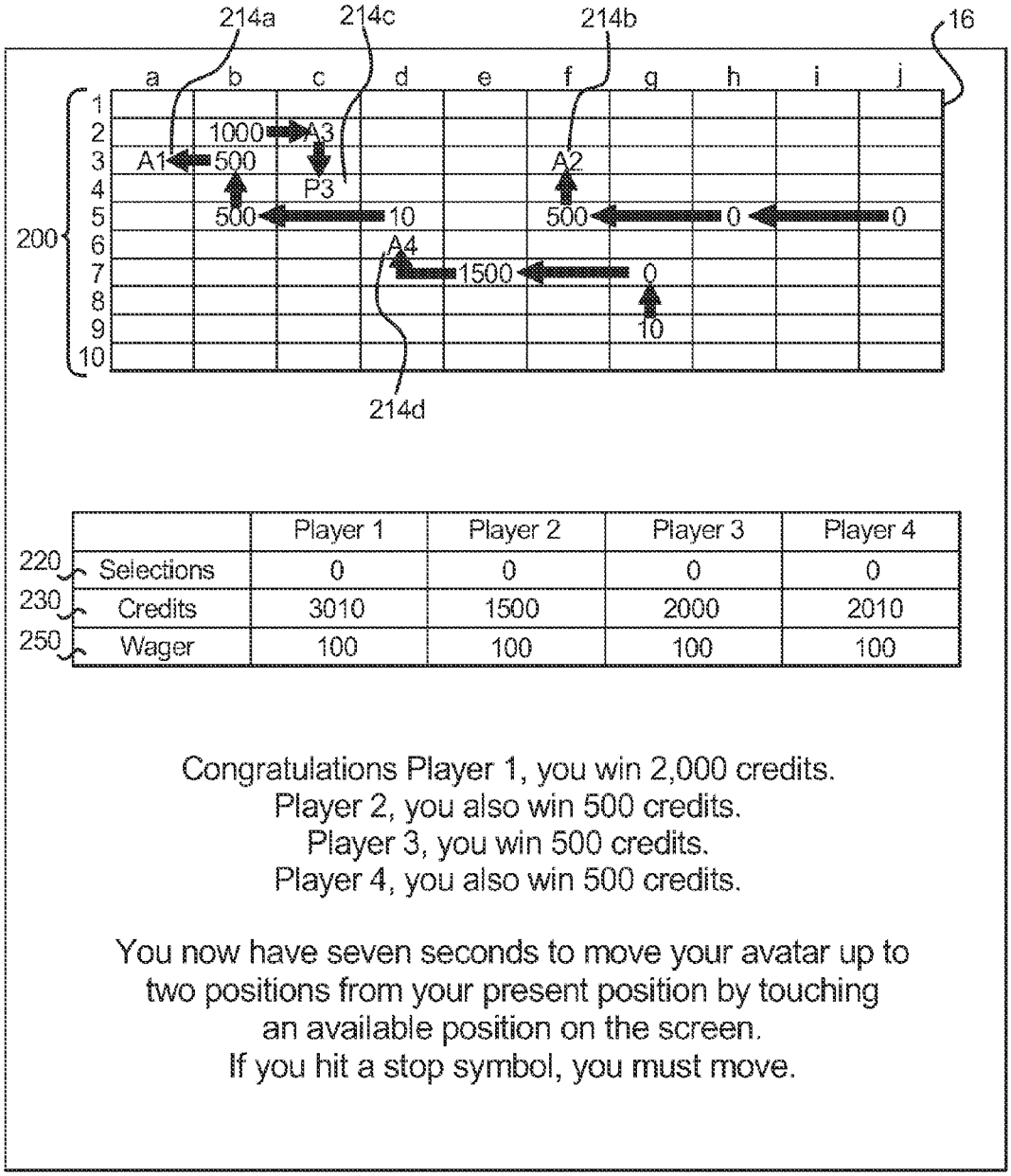

Referring to FIG. 5G, each player has two selections remaining. In view of the results displayed on the credit display 230 in FIG. 5G, the players determine their next move. Referring now to FIG. 5H, player one likes the area they are in, but tries a new position, causing the gaming device to move avatar one 214*a* from position 203*b* to position 203*a*.

Player two, still migrating towards the area of the grid 200 occupied by player one and player three causes the gaming device to move avatar 214*b* from position 205*f* to position 203*f*. Player three, speculating that position 202*b* is tapped out, causes the gaming device to move avatar three 214*c* from position 202*b* to 202*c*. Player four causes avatar 214*d* to move from position 207*e* to position 206*d*.

Referring to FIG. 5B and the credit display 230 in FIG. 5H: the first level of position 203*a* occupied by avatar one 214*a* is associated with an award of 2,000 credits, thus the gaming device provides player one with an award of 2,000 credits; the first depth of position 203*f* occupied by avatar two 214*b* is associated with an award of 1,000 credits, thus the gaming device provides player two with an award of 1,000 credits; the first depth of position 202*c* occupied by avatar three 214*c* is associated with an award of 500 credits, thus the gaming device provides player three with an award of 500 credits; and the first depth of position 206*d* occupied by avatar four 214*d* is associated with an award of 500 credits, thus the gaming device provides player four with an award of 500 credits.

After the fourth selection, each player has one selection remaining. In view of the results displayed on the credit display 230 in FIG. 5H, the players determine their next move. Player one, having just received 2,000 credits, causes the gaming device to leave avatar one 214*a* at position 203*a*. Player two, having just received 1,000 credits, causes the gaming device to leave avatar two 214*b* at position 203*f*. Player three causes the gaming device to move avatar three 214*c* from position 202*c* to position 204*c*. Player four causes the gaming device to leave avatar 214*d* at position 206*d*.

Figure 5I:
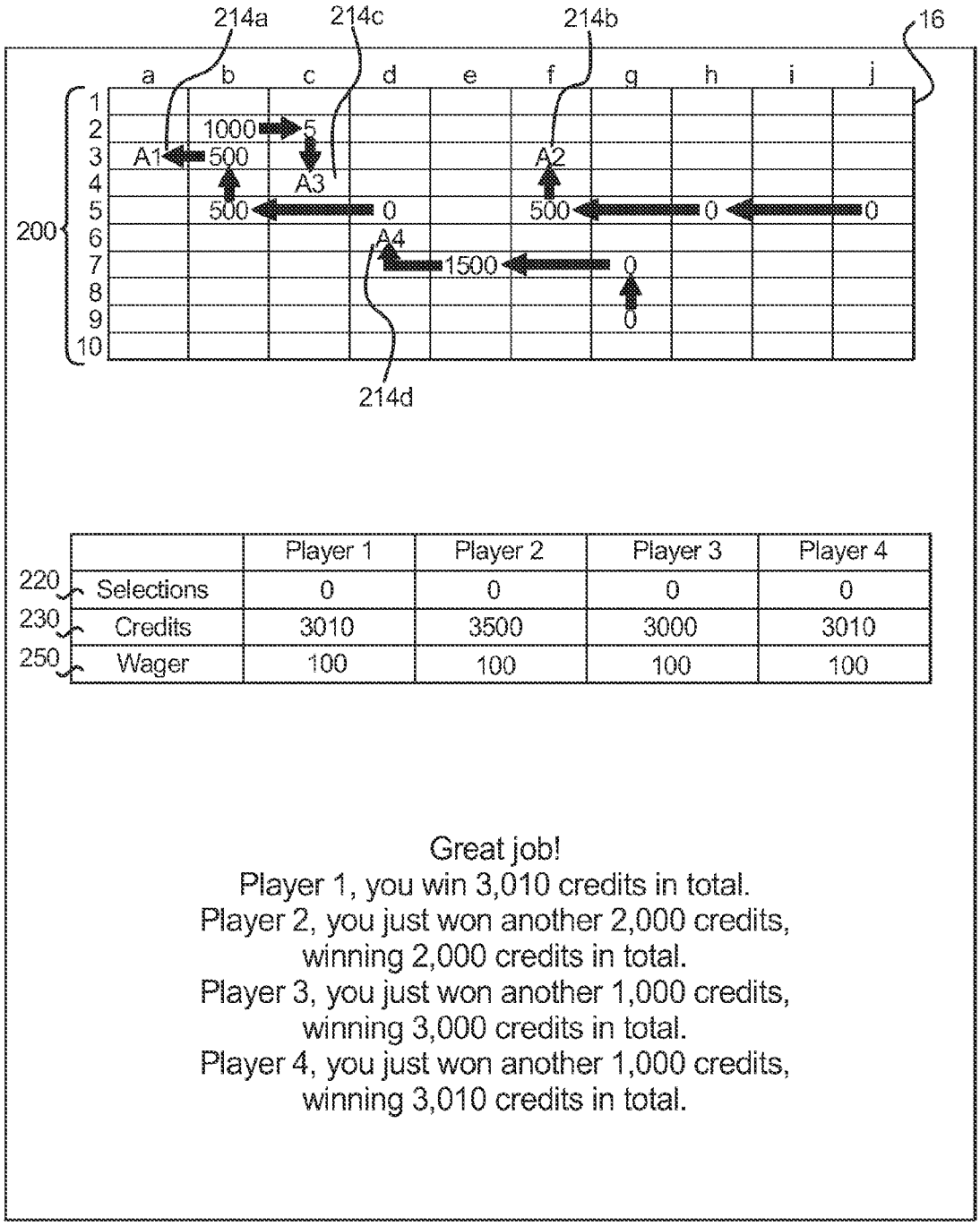

Referring to FIG. 5B and the credit display 230 in FIG. 5I: the second level of position 203*a* occupied by avatar one 214*a* is not associated with an award; the second level of position 203*f* occupied by avatar two 214*b* is associated with an award of 2,000 credits, thus the gaming device provides player two with an award of 2,000 credits; the first level of position 204*c* occupied by avatar three 214*c* is associated with an award of 1,000 credits, thus the gaming device provides player three with an award of 1,000 credits; and the second level of position 206*d* occupied by avatar four 214*d* is associated with an award of 1,000 credits, thus the gaming device provides player four with an award of 1,000 credits. Since the players have no selections remaining, the game is over, as illustrated in FIG. 5I.

In various other embodiments, players receive enhanced avatars upon the placement of a certain wager or the placement of an additional or side-wager, or as a bonus. In various embodiments, enhanced avatars have characteristics including one or more of: (a) enhanced or weak movement abilities (i.e., speed or range); (b) enhanced or weak award collecting capacity; (c) the ability to inhibit the movement of other avatars; (d) the ability to teleport to other areas on the grid; (e) the ability to randomly teleport to other areas on the grid; (f) the ability to provide the player with information relevant to the contents of positions on the grid; (g) the ability to take treasure from other avatars; (h) the ability to collect awards associated with more or fewer grid positions with a single pick; (i) the ability to collect awards with more or fewer levels with a single pick; (j) increased or reduced sensitivity to game items that affect player gaming abilities (such as redemption ability, repositioning ability, access to locality information, remaining number of selections, remaining amount of time, etc.); (k) other suitable default behavior; (l) artificial intelligence; and (m) any suitable combination of these characteristics.

In addition to or instead of an award or a stop symbol, in various other embodiments one or more of the plurality of positions in the grid 200 may be associated with: (a) a plurality of awards; (b) a symbol; (c) information; (d) a terminating condition or event; (e) a modifier; (f) any combination of these; and (g) any other suitable symbol or event. In one embodiment in which a plurality of awards may be associated with at least one single position, the number of awards associated with the at least one position varies as a function of time. In various other such embodiments, the number of awards associated with the at least one position varies as a function of any suitable variable.

Although in this embodiment, the players select the selectable positions using an input device, such as a touch screen, in various other such embodiments, the positions could be selected: (a) randomly by the gaming device; (b) in a predetermined manner by the gaming device; (c) by an avatar displayed by the gaming device and acting according to artificial intelligence; (d) any combination of these; and (e) any other suitable manner of selection.

In this embodiment, players had seven seconds between position selections and could move up to two positions from their current positions. However, it should be appreciated that in various other embodiments, the players may have any suitable amount of time to make position selects and may have any suitable restrictions imposed on the number of positions they may each cause the gaming device to move one or more avatars. In various embodiments, the gaming device displays a countdown meter which indicates how much time each player has to make their next selection. In various other embodiments, players may make position selections substantially simultaneously at the end of a count down. Additionally, in other embodiments, one or more additional suitable restrictions may be placed on players' position selections.

Although in this embodiment, the awards associated with certain levels of the plurality of selectable positions in the grid 100 were respective numbers of credits, in various other embodiments, the awards associated with one or more of the plurality of positions could include: (a) a number of free spins or activations; (b) a number of activations or plays of a bonus game; (c) a number of selections; (d) a physical prize; (e) promotional points; (f) player tracking points; (g) money; (h) any combination of these; and (i) any other suitable award.

It should be appreciated that although this embodiment was described as a multi-player game, the same game principle could be implemented by the gaming device in a single format, wherein a single player selects positions associated with a plurality of levels and uses the result of one selection to strategically make a subsequent selection.

In other embodiments, although as few as one player are playing the selection game live, the gaming system provides at least one virtual player. In various embodiments, the at least one virtual player: (a) emulates the actions of other players according to predetermined programmed behavior to create a more competitive or realistic gaming environment for the live players, and (b) emulates the actions of other players according to artificial intelligence based on the actions of the live players.

In one such embodiment, the number of virtual players active in a given game is dependent upon the number of live players. In various embodiments, virtual players may affect live players' game abilities (such as redemption ability, repositioning ability, access to locality information, remaining number of selections, remaining amount of time, etc.).

In one embodiment, virtual players may uncover grid positions and/or levels, but do not redeem uncovered values, thereby making said unredeemed value available for redemption by one or more live players. In one variation, the behavior or ability of one or more virtual players is based upon factors including, but not limited to, time of day, day of week, casino promotions, number of players, value of players relative to player loyalty program standing, longevity of continuous player play, progressive award size, whether or not a tournament mode of play is enabled, whether or not a bonus mode of play is enabled, whether play is occurring at the initial game level or at a follow-on game level, or any other suitable factor.

In various other embodiments, the selection game may include a character or avatar which is neither a player nor an avatar representative of or acting in the interests of any particular player. Rather, such avatar may have any suitable task or action which is part of the game, and although it does not collect awards, for example, on behalf of a player, it may provide one or more players with information or interact with player avatars. Such an avatar's abilities may be different than players' (or players' avatars) abilities.

In another embodiment, avatars are associated with one or more of: (a) an energy variable (e.g., fuel) and (b) a time variable (i.e., lifespan). In such an embodiment, certain avatars move and collect awards on players' behalves until they run out of energy and certain avatars move and collect awards on players' behalves for a designated amount of time or number of turns.

In one such embodiment, the gaming device provides players twenty seconds, or another designated amount of time, to make each move. Time spent between player picks does not count, but time spent revealing the awards or information associated with each selection does count. In a mining theme example, for illustrative purposes, this would be time spent digging. Digging lower (or to further levels associated with the position) in various embodiments takes more time, but yields better awards. Even if the entire field of awards are displayed to the players, players will have to make choices as to how to best use their respective resource allotment. For example, a player may have enough resources to collect an award of ninety credits, or two smaller awards of fifty credits each. In another embodiment, one or more avatars have a limited amount of energy which is used up by moving and as well as by collecting awards. In another embodiment, a player simply has a limited duration of time and all actions take time, including moving, collecting and contemplating a next move.

In one embodiment, players could play the selection game in teams, wherein one or more players select positions in the grid on behalf of their respective team. In such embodiments, various criteria govern which of the one or more players make selections on behalf of their respective teams. In such embodiments, which of the one or more players on each team make selections may be: predetermined, randomly determined, determined based on the player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day), determined based on an amount of coin-in accumulated in one or more pools or determined based on any other suitable method or criteria.

In one embodiment, player loyalty points associated with a player are used as a guide for giving players enhanced avatars or other special features.

Multi-Avatar Example Embodiments

In another more complex multi-player embodiment, the selection game is a multi-player primary game wherein each of a plurality of players are provided with a plurality of avatars possessing different qualities and a designated number of selections of the selectable positions for each of their respective avatars upon the placement of a designated wager. It should be appreciated that this selection game may be a primary game or a secondary game initiated in any suitable manner.

A plurality of positions 301*a* to 310*j* in a grid 300 are each associated with at least one of: (a) an award; (b) information relating to whether an award is associated with that or another position; (c) a plurality of levels (i.e., depths); (d) a level which can only be breached by a designated type of avatar; (e) any combination of these; and (f) any other suitable information or award.

For illustrative purposes, this embodiment is described in the context of a mining theme, wherein the levels associated each position are depths and the selection game includes other elements associated with a mine theme. It should be appreciated that in various other implementations, this embodiment may be provided in any suitable game theme.

Referring specifically to FIGS. 6A to 6G, in this embodiment, each player pays for and controls a group such as an army of different avatars each of which have different capabilities. In this specific embodiment, the avatars include: (a) miners 318*a*; (b) diggers 318*b*; (c) blasters 318*c*; (d) prospectors 318*d*; (e) geologists 318*e*; and (f) security 318*f*. Example of avatars which could be included in other various embodiments include spies, saboteurs and claim jumpers.

In various embodiments, each different type of avatar has a different characteristic, potential characteristics including one or more of: (a) enhanced or weak movement abilities; (b) enhanced or weak award collecting capacity; (c) the ability to inhibit the movement of other avatars; (d) the ability to teleport to other areas on the grid; (e) the ability to provide the player with information relevant to the contents of positions on the grid; (f) other suitable default behavior; (g) artificial intelligence; (h) a different tool (e.g., an ax or a shovel); (i) the ability to assist or impede avatars of other players; (j) any suitable combination of these characteristics; and (k) other suitable default characteristics.

In various embodiments, a player is assigned a designated number of each of type of available avatar. It should be appreciated that in various embodiments, the number of each type of avatar a player controls or uses for a play of the game varies based on: (a) player selection; (b) a wager; (c) a stage of play; (d) game environment chosen by a player; (e) player standing in a current game; (f) player standing in a current play session; (g) player standing for all time; (h) whether or not tournament mode of play is enabled; (i) where or not bonus mode of play is active; (j) any combination of these; and (k) other suitable game events or criteria.

In various embodiments, each player has anywhere from one type to each type of available avatar. It should also be appreciated that in various embodiments, the types of avatar a player controls or uses for a play of the game vary based on: (a) player selection; (b) a wager; (c) an additional fee paid by a player; (d) a stage of play; (e) an outcome of another game; (f) any combination of these; and (g) other suitable game events or criteria.

In various embodiments, the gaming device enables players to control the avatars in different manners including: (a) moving individual avatars one at a time; (b) moving all of the player's avatars at once; (c) selecting a type of avatar and controlling all avatars associated with that type; (d) selecting a specific set of avatar and controlling all avatars associated with that set; (e) relying upon the artificial intelligence of each respective avatar to determine avatar movement; (f) allowing the gaming device to make movements; (e) any combination of these; and (g) other suitable manners.

Figure 6A:
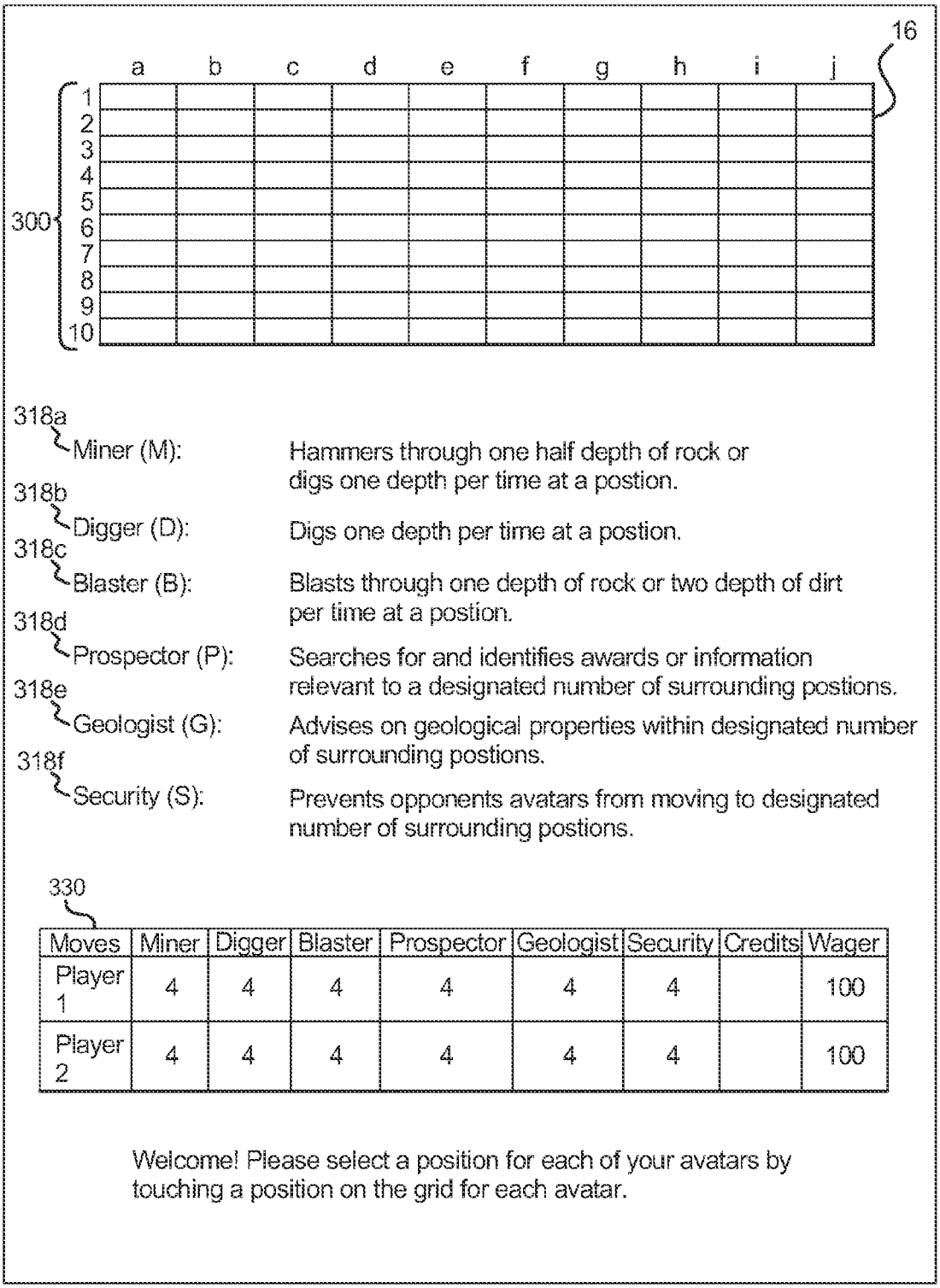

Referring now specifically to FIG. 6A, the grid 300 includes ten individually selectable vertical and horizontal coordinates. In this embodiment, preferably the screen or display 16 includes a touch screen and players select respective positions of the grid 300 by touching that position directly on the displayed grid 300. In various embodiments, players move respective avatars by touching a position on the display 16 an avatar is currently located at and then touching a desired position. In various other embodiments, players move respective avatars by touching a position on the display 16 an avatar is currently located at, moving the avatar to a desired position by moving the avatar while holding their finger on the display 16 ("dragging"), and releasing their finger ("dropping") when they have moved the avatar to a desired position.

The gaming device provides each player with any suitable method of determining which type of avatar to place at a particular position when touching the display 16. In various embodiments, the gaming device may display a selector (not shown) which the players select prior to selecting a position to indicate which avatar they are moving to that respective position. It should be appreciated that in this embodiment, each player has their own display, on which they select positions. In various other embodiments, players select positions on a single display. In other embodiments, players select positions on respective individual displays, with the gaming system also including a master display viewable be each of the players.

After accepting a wager of 100 credits from each of two players, the gaming device provides each player one of each of a plurality of different types of avatars. It should be appreciated that in various other embodiments, the gaming device provides players with multiples of the same type of avatar or various combinations of different avatars, which may include a plurality of one or more different types of avatars.

Any suitable game theme may be utilized for this embodiment of the selection game. In this particular example, avatars perform various functions in a geographical landscape comprised of rock and dirt. In this example, each avatar performs a specific function during the time it is at a position. As illustrated in FIG. 6A, miners 318*a* hammer through one half depth of rock or dig one depth per time a position; diggers 318*b* dig one depth per time at a position; blasters 318*c* blast through one depth of rock or two depths of dirt per time at a position; prospectors 318*d* search for and identify awards or information relevant to a designated number of surrounding positions (in this example, the positions the prospectors border which are not occupied by another avatar); geologists 318*e* advise on geological properties within a designated number of surrounding positions (in this example, the positions the prospectors border which are not occupied by another avatar); and security avatars 318*f* prevent opponents' avatars from moving to a designated number of positions surrounding the respective security avatar (in this example, the positions the security avatars border which are not occupied by another avatar). In this example, only miners and diggers pick up awards. It should be appreciated that in various other embodiments, other or all types of avatars may pick up awards.

Figure 6B:
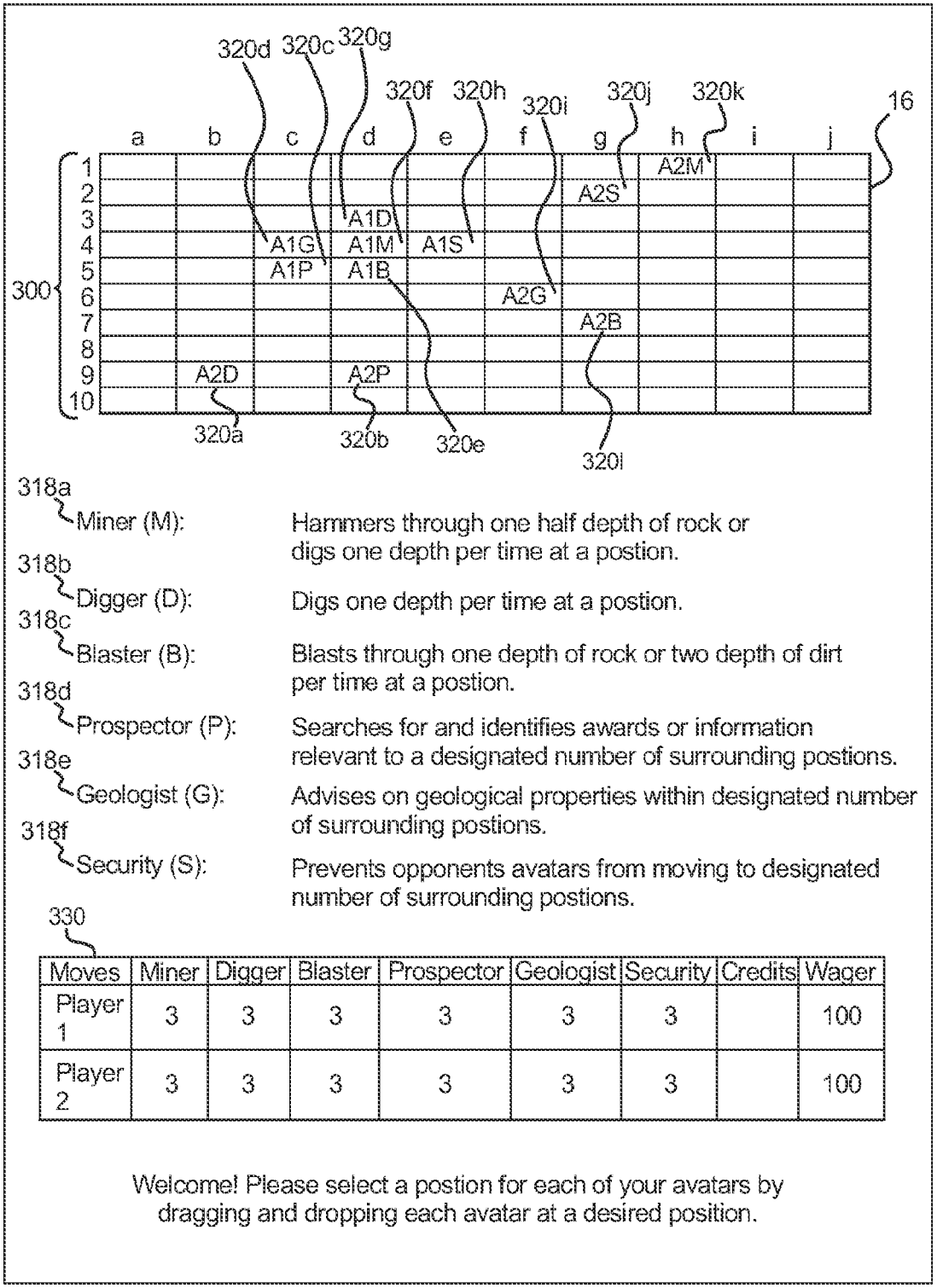

The gaming device instructs the players to make their first of five position selections for each of their avatars, as illustrated in FIG. 6A. It should be appreciated that in various other embodiments, the gaming device randomly assigns the first position the players' avatars occupy. Referring to FIG. 6B, player one causes the gaming device to place their avatars as follows: the prospector avatar 320*c* at position 305*c* on grid 300; the geologist avatar 320*d* at position 304*c*; the blaster avatar 320*e* at position 305*d*; the miner avatar 320*f* at position 304*d*; the digger avatar 320*g* at position 303*d*; and the security avatar 320*h* at position 304*e*.

Player two causes the gaming device to place their avatars as follows: the prospector avatar 320*b* at position 309*d* on grid 300; the geologist avatar 320*i* at position 306*f*; the blaster avatar 320*l* at position 307*g*; the miner avatar 320*k* at position 301*h*; the digger avatar 320*a* at position 309*b*; and the security avatar 320*j* at position 302*g*.

It should be appreciated that this example embodiment enables players to employ a variety of strategies. For example, if a high volatility player buys a designated number of avatars serving as miners, employing one strategy, the high volatility player would initially place all of the avatars together, such that if a rich position ends up being located within the placement area of the avatars, the player capitalizes on the region. The downside of such a strategy, is if the area within which the avatars are placed is not rich in awards, the player will be at a disadvantage in getting to other areas of the grid.

An example strategy a lower risk player seeking a high hit frequency would employ is spreading their avatars across the board, such that at least one of the avatars will most likely uncover an award, whether or not located in the most award-rich portion of the grid or board.

In this example, player one and player two employed different strategies. Referring to FIG. 6B, player one concentrated their avatars close together, employing a high volatility all or nothing type strategy. Player two spread their avatars out.

FIG. 6C illustrates the positions which are associated with rock and the awards associated with each respective position for this example. Note that in this embodiment, the position 106*g* associated with an award of 2,000 credits located underneath rock is illustrated as being masked with diagonal lines to differentiate it from other positions only associated with rock. In this example, the geographic properties and awards associated with the positions are not revealed to the players until one of the players selects the position or a capable avatar identifies an award or geographic property.

Referring to FIG. 6D, neither player acquired an award as a result of the initial placement of the avatars. However, the players receive valuable information as a result of the placement of the avatars, specifically, the prospector and geologist avatars in this example. In this embodiment, all players can see the information obtained from others' avatars in addition to their own avatars. It should be appreciated that in various other embodiments, players only see information gathered by their own avatars. In various embodiments, players may receive any suitable information from any suitable type of avatar with enhanced characteristics, such as those discussed above.

Player one's prospector avatar 320*c* causes the gaming device to reveal that positions 306*b* and 306*c* are associated with awards, but the gaming device does not reveal the amount of those respective awards, as illustrated in FIG. 6D. Player two's prospector avatar 320*b* causes the gaming device to reveal that positions 309*c*, 310*c*, 309*e* and 310*e* are associated with awards, but the gaming device does not reveal the amount of those awards, as illustrated in FIG. 6D.

Player one's geologist avatar 320*d* causes the gaming device to reveal that positions 304*b* and 303*c* are associated with rock. Player two's geologist avatar 320*i* causes the gaming device to reveal that positions 305*g* and 306*g* are also associated with rock.

The gaming device instructs the players to move their avatars no more than two positions from their respective positions or leave them stationary, pointing out that awards may be located under rock, as illustrated in FIG. 6D.

Referring now to FIG. 6E, for their second set of selections, player one adjusts their avatars as follows: moves the prospector avatar 320*c* to position 305*b* on grid 300; leaves the geologist avatar 320*d* at position 304*c*; leaves the blaster avatar 320*e* at position 305*d*; moves the miner avatar 320*f* to position 306*d*; moves the digger avatar 320*g* to position 303*b*; and moves the security avatar 320*g* to position 306*e*.

For their second set of selections, player two adjusts their avatars as follows: moves the prospector avatar 320*b* to position 309*b* on grid 300; leaves the geologist avatar 320*i* at position 306*f*; moves the blaster avatar 320*l* to position 306*g*; moves the miner avatar 320*k* to position 303*h*; moves the digger avatar 320*a* to position 309*c*; and moves the security avatar 320*j* to position 303*g*.

Referring to FIGS. 6C and 6E, the gaming device awards player two 500 credits for their second set of selections for the placement of digger avatar 320*a* at position 309*c*. Player one's geologist avatar 320*d* causes the gaming device to reveal that position 303*c* is associated with rock. Player one's prospector avatar causes the gaming device to reveal that positions 306*a*, 306*b* and 306*c* are associated with awards, but does not reveal the amounts of those awards, as illustrated in FIG. 6E. Player two's geologist avatar 320*i* causes the gaming device to reveal that position 305*g* is associated with rock. Player two's prospector avatar 320*b* causes the gaming device to reveal that positions 310*b* and 310*c* are associated with awards, but does not reveal the amounts of those awards, as illustrated in FIG. 6E. The gaming device then instructs the players to make their third set of selections, as illustrated in FIG. 6E.

Referring now to FIG. 6F, for their third set of selections, player one adjusts their avatars as follows: causes the gaming device to leave the prospector avatar 320*c* at position 305*b* on grid 300; leave the geologist avatar 320*d* at position 304*c*; move the blaster avatar 320*e* to position 303*d*; move the miner avatar 320*f* to position 306*c*; move the digger avatar 320*g* to position 304*a*; and move the security avatar 320*g* to position 306*d*.

For their third set of selections, player two causes the gaming device to adjust their avatars as follows: leave the prospector avatar 320*b* at position 309*b* on grid 300; leave the geologist avatar 320*i* at position 306*f*; move the blaster avatar 320*l* to position 305*g*; move the miner avatar 320*k* to position 304*g*; move the digger avatar 320*a* to position 310*c*; and move the security avatar 320*j* to position 304*f*.

Referring to FIGS. 6C and 6F, the gaming device awards player one 500 credits for their second set of selections for the placement of miner avatar 320*f* at position 306*c* and awards player two 1,000 credits for their second set of selections for the placement of digger avatar 320*a* at position 310*c*. Player one's geologist avatar 320*d* causes the gaming device to reveal that position 303*c* is associated with rock. Player one's prospector avatar causes the gaming device to reveal that positions 306*a* and 306*b* are associated with awards, but does not reveal the amounts of those awards, as illustrated in FIG. 6F. Player two's prospector avatar 320*b* causes the gaming device to reveal that position 310*b* is associated with an award, but does not reveal the amount of that award, as illustrated in FIG. 6F. The gaming device then instructs the players to make their final set of selections, as illustrated in FIG. 6F.

Referring now to FIG. 6G, player one causes the gaming device to adjust their avatars as follows: leave the prospector avatar 320*c* at position 305*b* on grid 300; leave the geologist avatar 320*d* at position 304*c*; move the blaster avatar 320*e* to position 303*c*; move the miner avatar 320*f* to position 306*b*; move the digger avatar 320*g* to position 306*a*; and leave the security avatar 320*g* at position 306*d*.

For their final set of selections, player two causes the gaming device to adjust their avatars as follows: leave the prospector avatar 320*b* at position 309*b* on grid 300; leave the geologist avatar 320*i* at position 306*f*; leave the blaster avatar 320*l* at position 305*g*; move the miner avatar 320*k* to position 304*i*; move the digger avatar 320*a* to position 310*b*; and leave the security avatar 320*j* at position 304*f*.

Referring to FIGS. 6C and 6G, the gaming device awards player one 1,500 credits for their fourth set of selections for the placement of miner avatar 320*f* at position 306*b* and digger avatar 320*g* at position 306*a* and awards player two 500 credits for their fourth set of selections for the placement of digger avatar 320*a* at position 310*b*.

Although in this embodiment, the players select the selectable positions using an input device, such as a touch screen, in various other such embodiments, the positions could be selected: (a) randomly by the gaming device; (b) in a predetermined manner by the gaming device; (c) by an avatar displayed by the gaming device and acting according to artificial intelligence; (d) any combination of these; and (e) any other suitable manner of selection.

In this embodiment, players' avatars could be moved up to two positions from their current positions. However, it should be appreciated that in various other embodiments, the gaming device may impose any limit on the number of positions the avatars may move for one selection. Additionally, in other embodiments, one or more additional suitable restrictions may be placed on players' position selections.

Although in this embodiment, the awards associated with certain levels of the plurality of selectable positions in the grid 100 were respective numbers of credits, in various other embodiments, the awards associated with one or more of the plurality of positions could include: (a) a number of activations of a base game; (b) a number of activations of a bonus game; (c) a number of selections; (d) any combination of these; and (e) any other suitable award.

It should be appreciated that although in this embodiment, players-controlled avatars have a virtual physical function, in various other embodiments, players could control non-moving stationary symbols which serve a function in conjunction with physically moving avatars. For example, instead of a security avatar, as in the foregoing embodiment, which keeps other players' avatars a designated number of positions away, players could place a blocking symbol (e.g., a large rock) in a position or block a designated number of positions (e.g., by having the ability to place a virtual fence around a plurality of positions).

In various embodiments, such a blocking or non-moving symbol is: (a) placed and moved by one or more players; (b) controlled by the gaming device; and (c) placed by the gaming device at the beginning of a play of the game and stationary throughout the play of the game.

In various other embodiments, the game includes non-moving symbols not associated with awards which when collected by an avatar or on a position occupied by an avatar provide a benefit to that avatar or serve a function in the game. For example, in various embodiments, such symbols could include: (a) a first aid kit which when collected by an avatar, provides the avatar with extra energy or heals the avatar; (b) a ladder or bridge which enables an avatar to walk over a virtual hole or geographic landscape requiring a ladder or bridge; (c) virtual food; (d) virtual beverage; (e) a symbol associated with extra lives; and (f) any suitable symbol.

In various other embodiments, the game includes consentient avatars controlled by the gaming device which serve a function for a play of the game, but have no bias to any particular actual player. In conjunction with the foregoing game theme, examples of consentient avatars could include: (a) an avatar who places dirt back in a "hole" when it occupies a position; (b) a monster avatar which "scares" other avatars away (regardless of player); (c) a doctor avatar who gives whatever avatars (regardless of player) it comes in contact with extra energy or heals injured avatars; and (d) any suitable avatar having any suitable game function.

It should be appreciated that although this embodiment was described as a multi-player game, the same game principle could be implemented by the gaming device in a single player format, wherein a single player selects positions associated with a plurality of levels using a plurality of avatars and the gaming device controls a plurality of avatars, simulating actual competitive play.

Multi-Player Persistence Type Selection Game Example Embodiments

Referring now to FIGS. 7A to 12D, in one embodiment, the selection game is a persistence game, continuing until a terminating event occurs. In this embodiment, a plurality of players may enter an on-going selection game upon the placement of a designated wager. It should be appreciated that in various other embodiments, players may enter the selection game: (a) at designated time intervals; (b) as a bonus award associated with a play of another game; (c) any combination of these; and (d) any other manners.

Figure 7A:
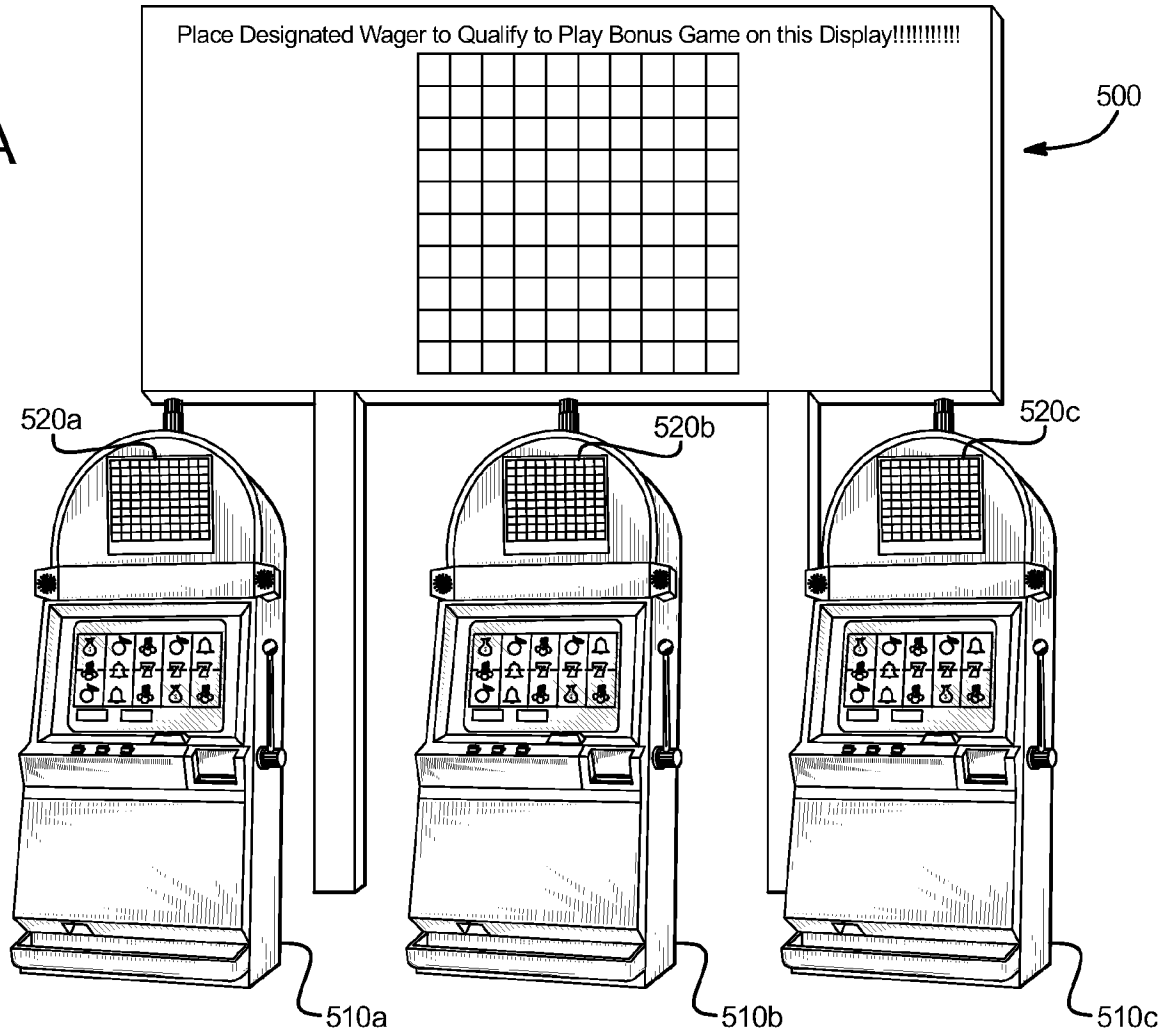
FIG. 7A includes a front view of a gaming system enabling a play of a game by multiple players in accordance with another embodiment of the gaming device disclosed herein.

Referring specifically to FIG. 7A, in this embodiment, a gaming system including a plurality of gaming devices 510*a*, 510*b* and 510*c* includes a central display 500 on which the persistence game is displayed to all players. Each of the gaming devices 510*a*, 510*b* and 510*c* also include additional secondary displays 520*a*, 520*b* and 520*c* which also display the persistence game, if that respective gaming device is eligible for the persistence game. In this embodiment, the persistence game is on-going and played concurrently with a primary game upon the placement of designated wager in the primary game.

Referring to FIG. 7B, the persistence game includes a plurality of positions, each associated with an award of a designated number of credits. In addition to or instead of an award, one or more of the plurality of positions in various other embodiments may be associated with: (a) a plurality of awards; (b) a plurality of levels (i.e., depths); (c) a symbol; (d) a piece of information; (e) a terminating condition or event; (f) a modifier; (g) any combination of these; and (h) any other suitable symbol or event.

It should be appreciated that although in this embodiment, the persistence game includes one hundred positions, in this and various other embodiments of selection games disclosed herein, the game may include any suitable number of positions.

As in the case of other embodiments, the awards associated with the plurality of positions are interdependently related in that the award associated with certain positions is indicative of the awards associated with certain bordering positions. For example, referring to FIG. 7B, the awards associated with the upper right portion of the plurality of selectable positions increase as they near the upper right-most position, peaking at 5,000 credits. Similarly, near the center of the plurality of positions, two positions associated with an award of 5,000 credits are surrounded by relatively lower awards, which increase as they near the positions associated with awards of 5,000 credits.

Although in this embodiment, each of the plurality of selectable positions are associated with an award, it should be appreciated that in various other embodiments, each of the plurality of selectable positions is not associated with an award.

Figure 8A:
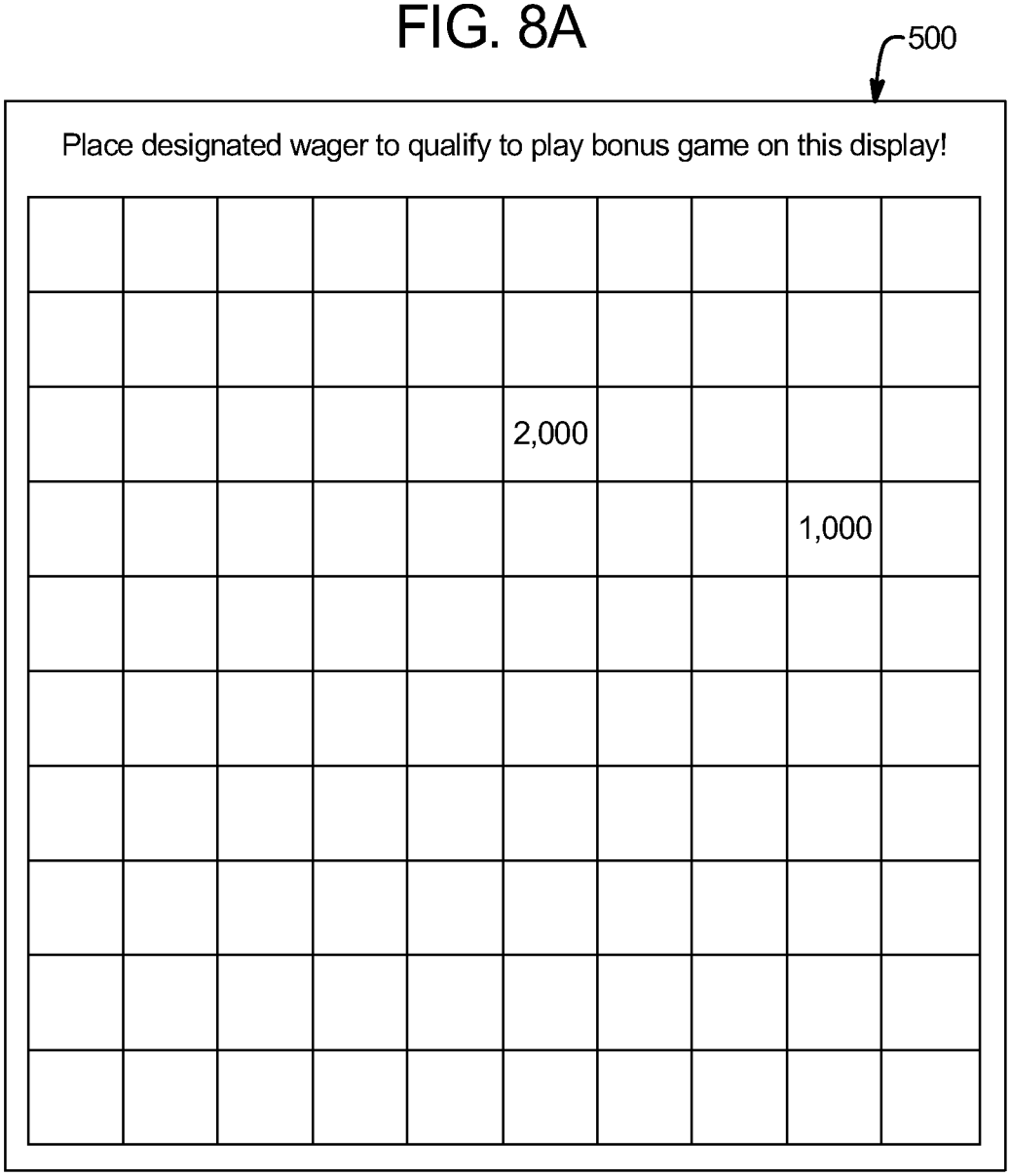
FIGS. 8A and 8B include a front view of a gaming device display enabling a play of a game by multiple players in accordance with another embodiment of the gaming device disclosed herein.
Figure 8B:
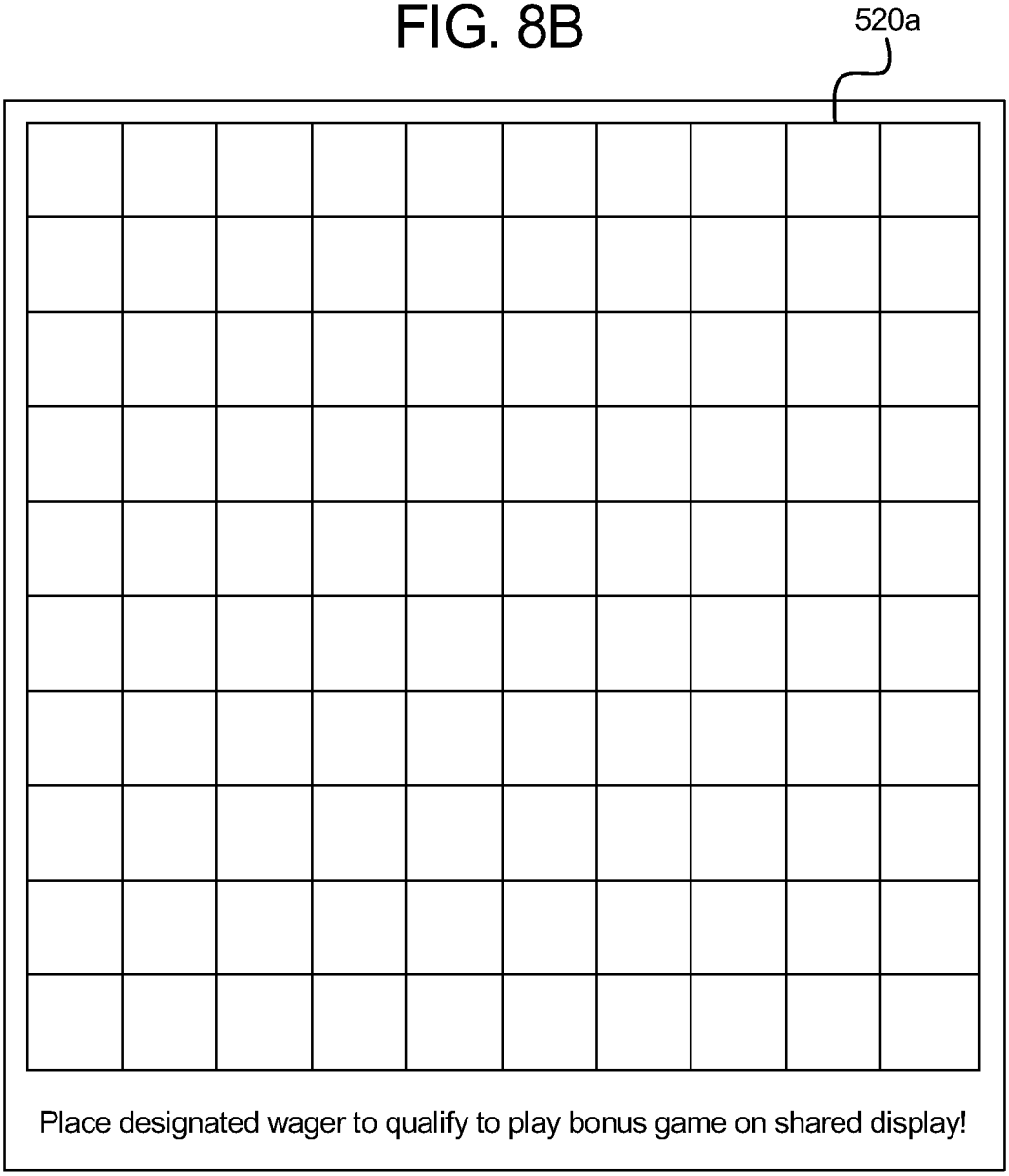
Figure 9A:
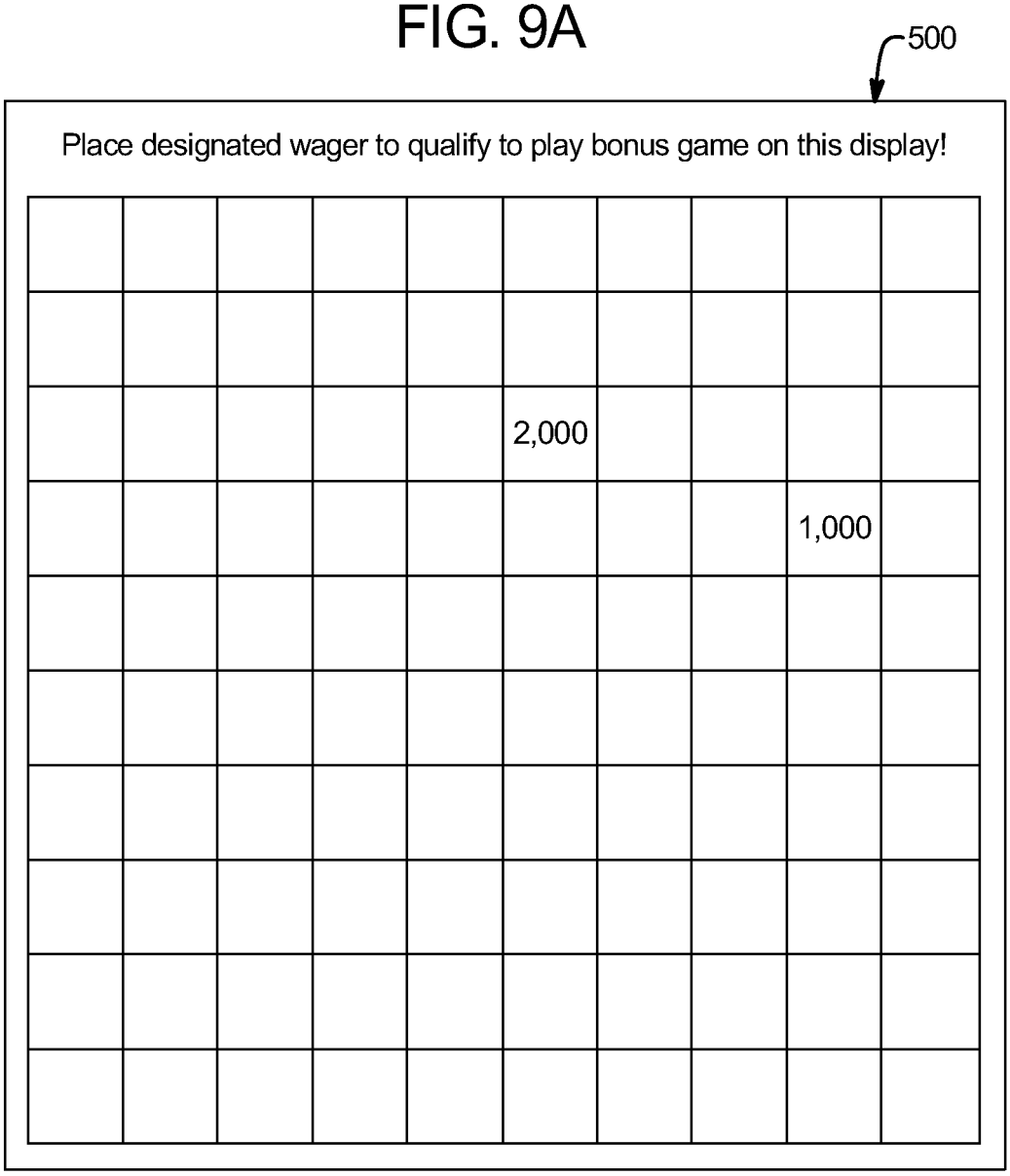
FIGS. 9A, 9B, 9C and 9D include a front view of a gaming device display enabling a play of a game by multiple players in accordance with another embodiment of the gaming device disclosed herein.
Figure 9B:
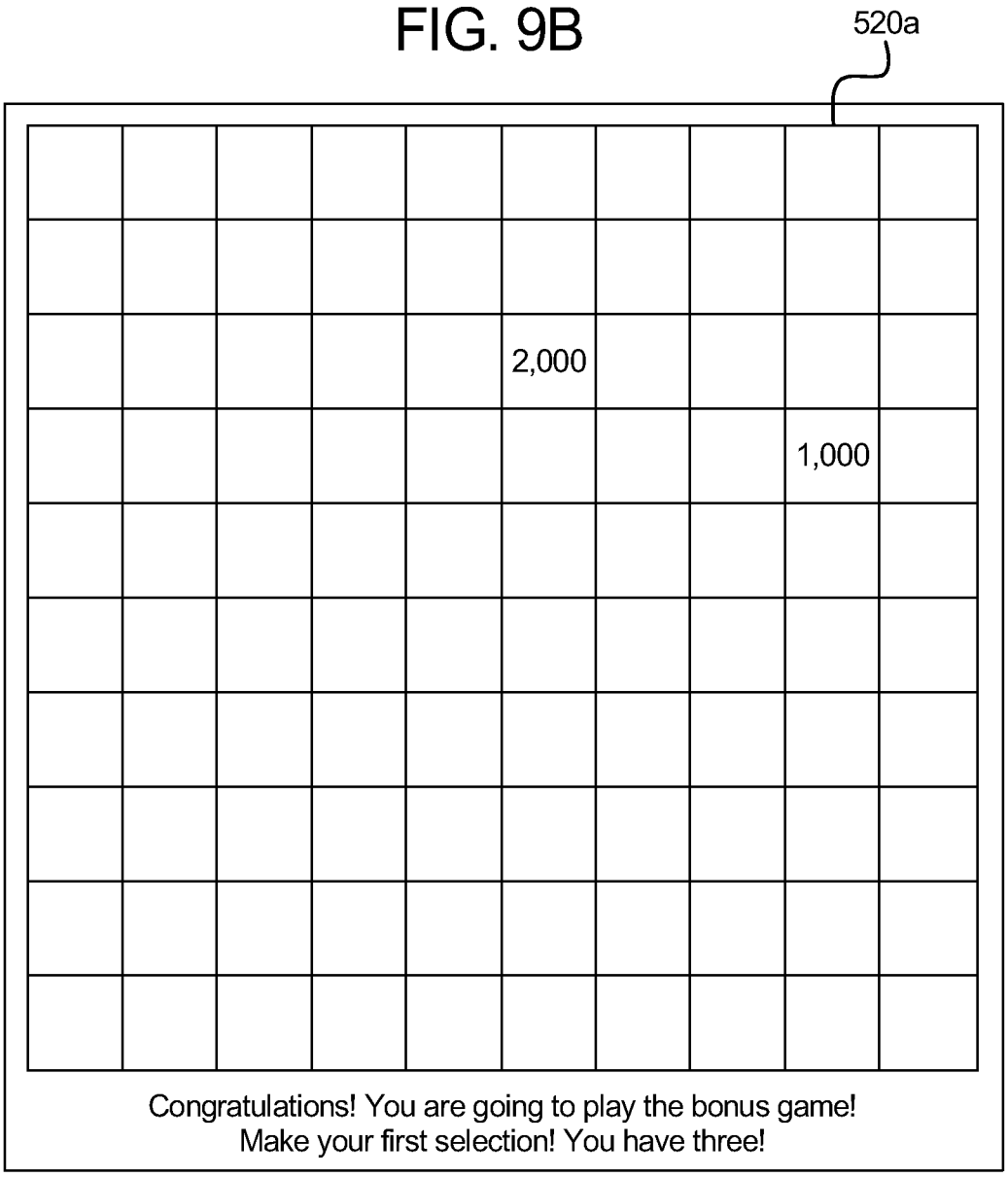
Figure 9C:
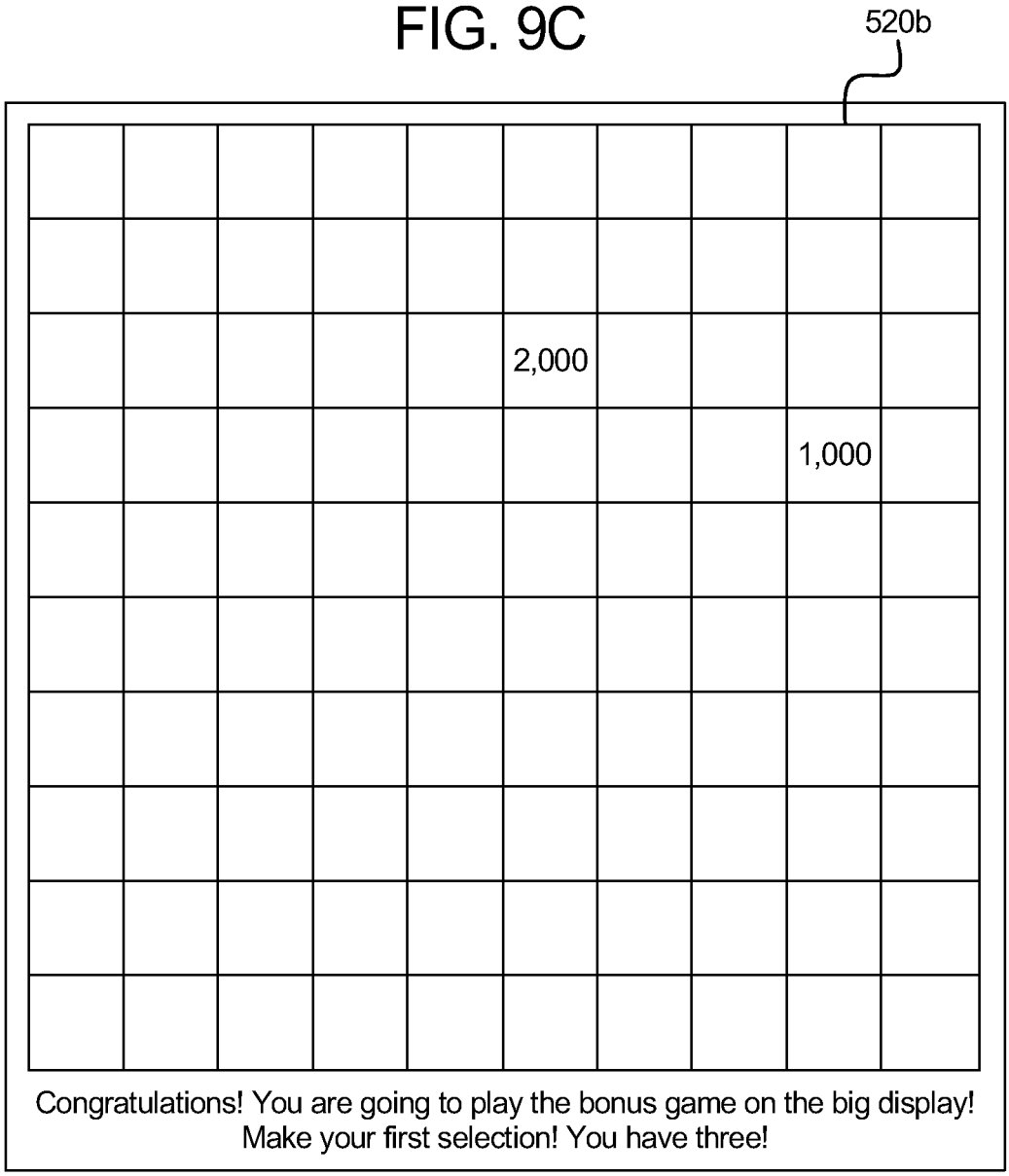
Figure 9D:
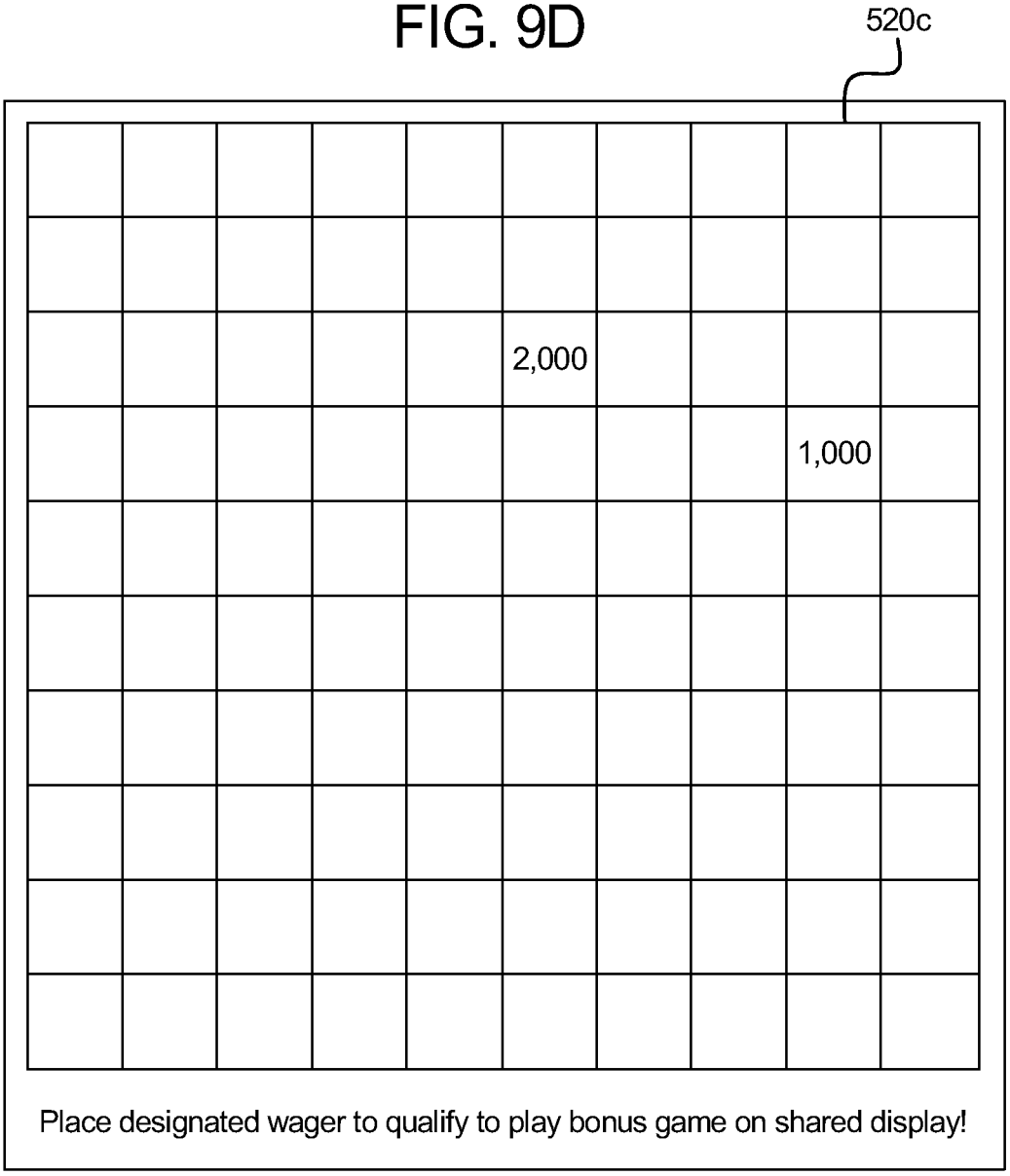
Figure 10B:
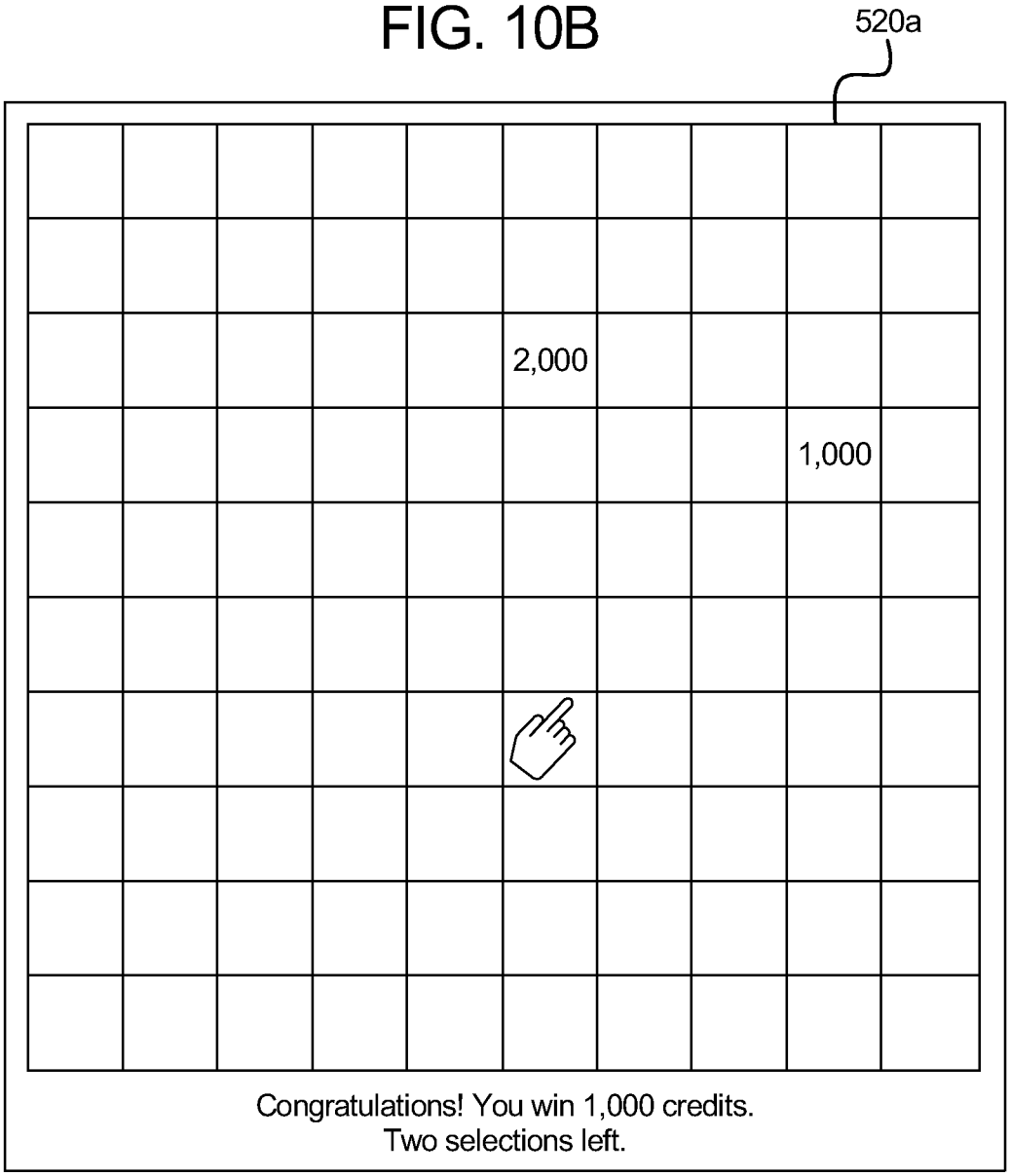
Figure 10C:
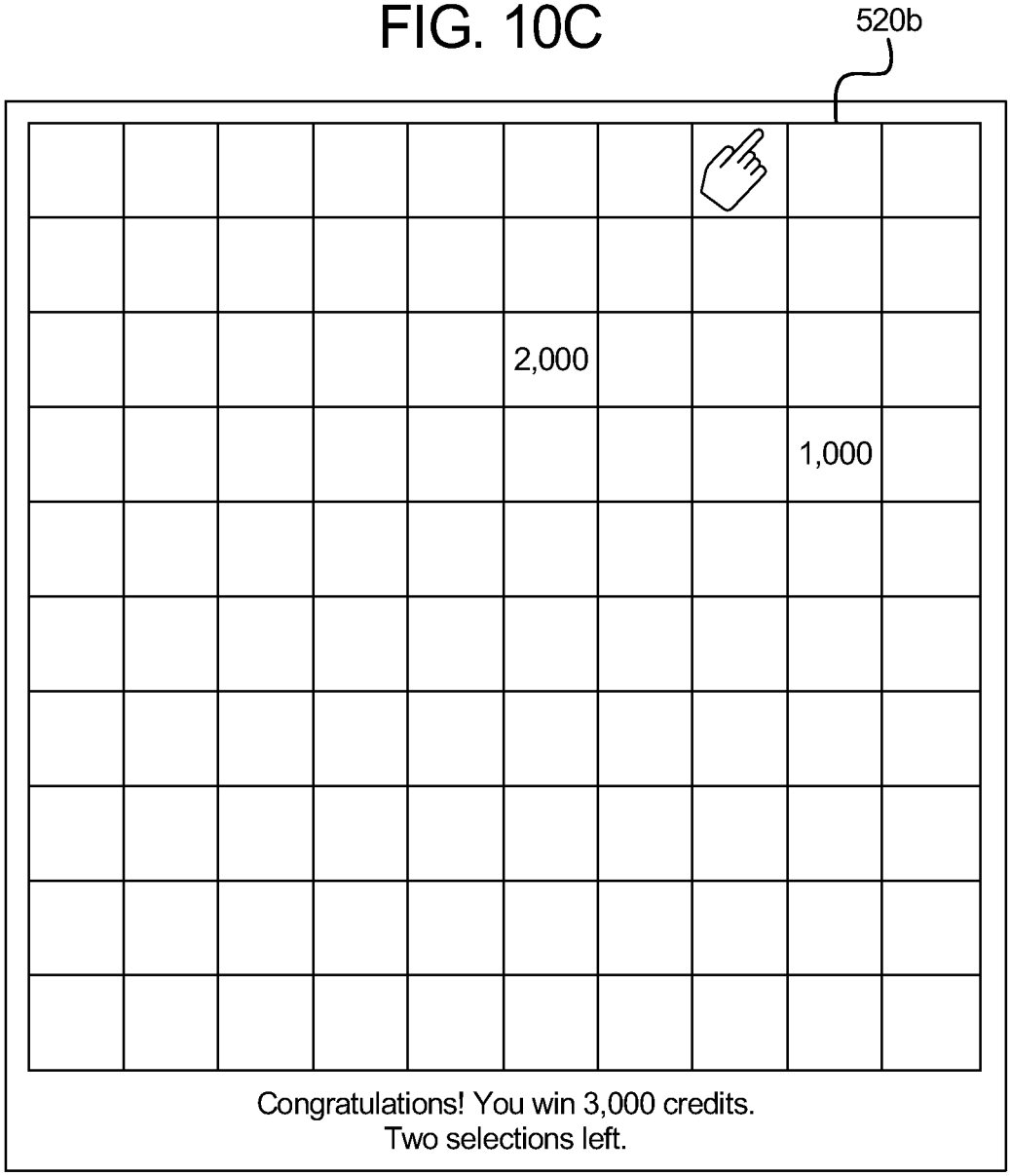
Figure 10D:
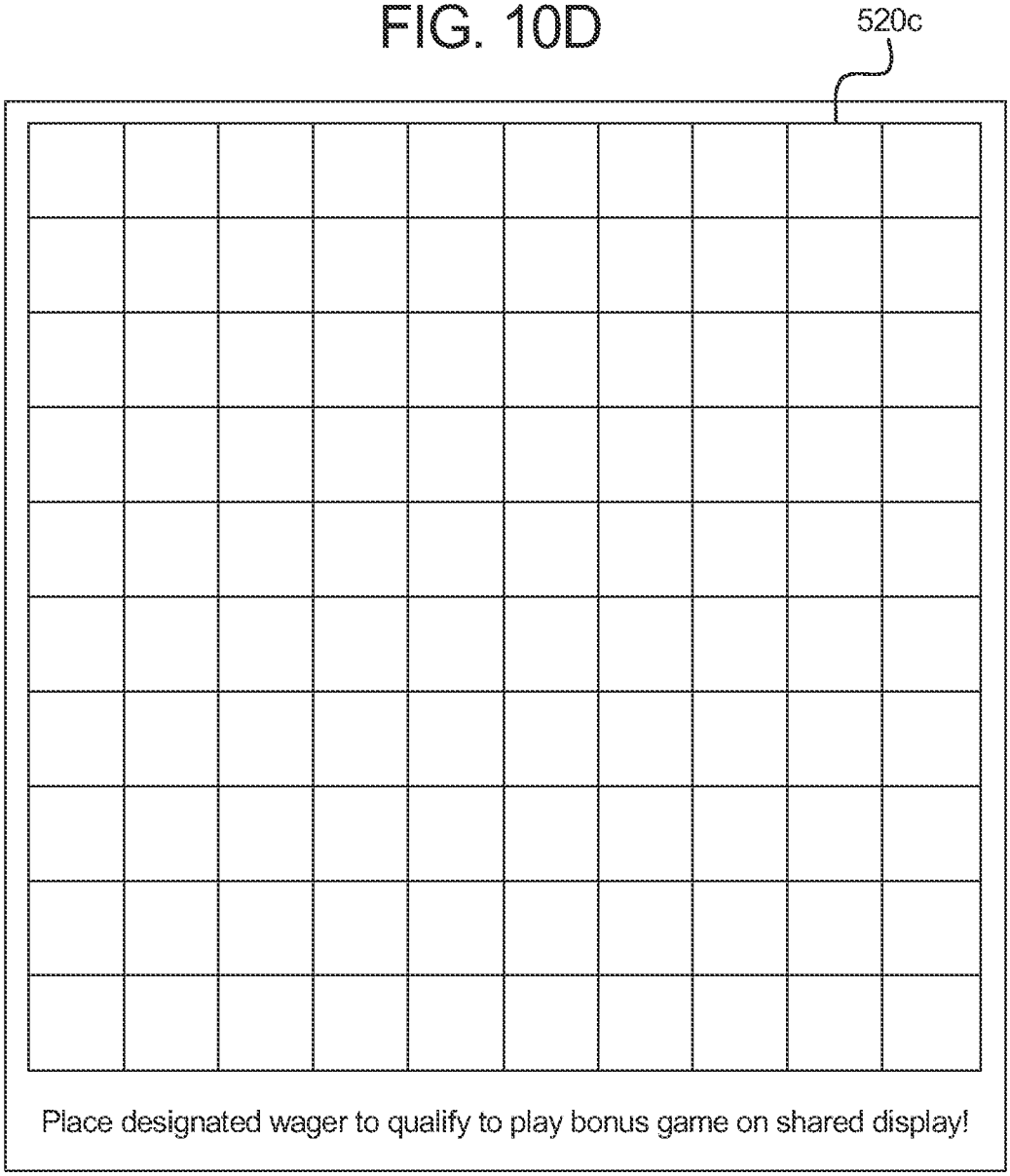
Figure 11B:
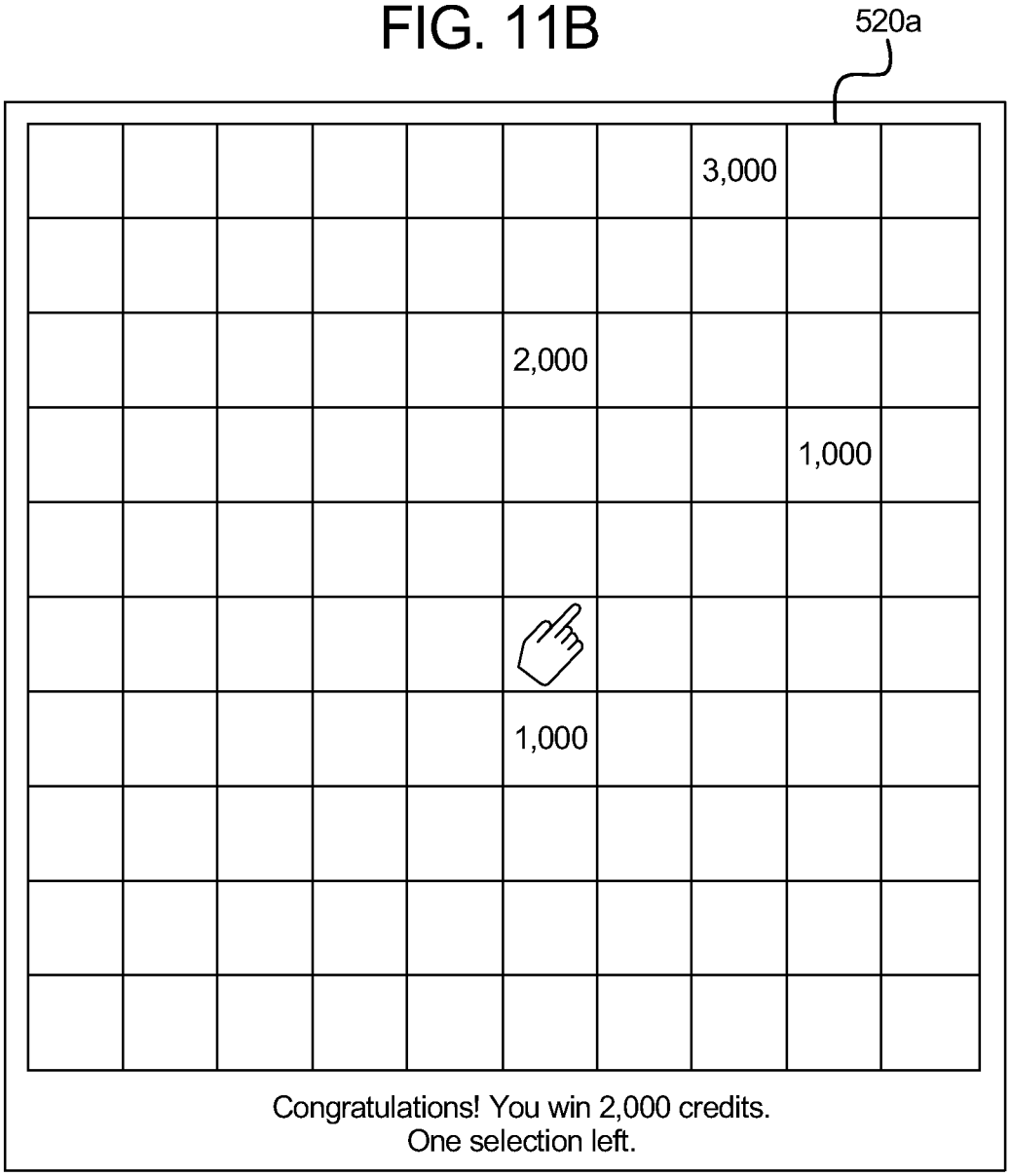
Figure 11C:
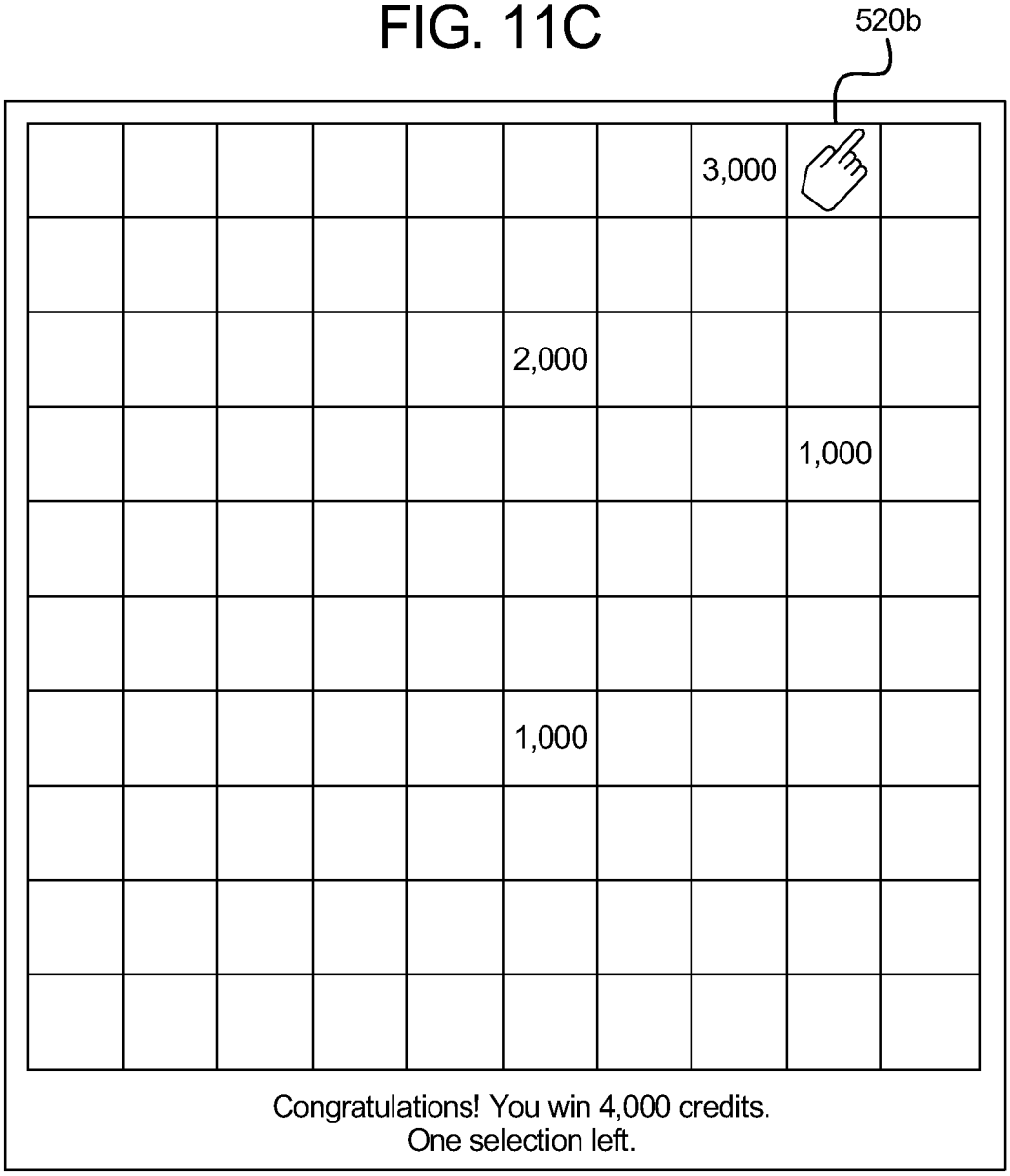
Figure 11D:
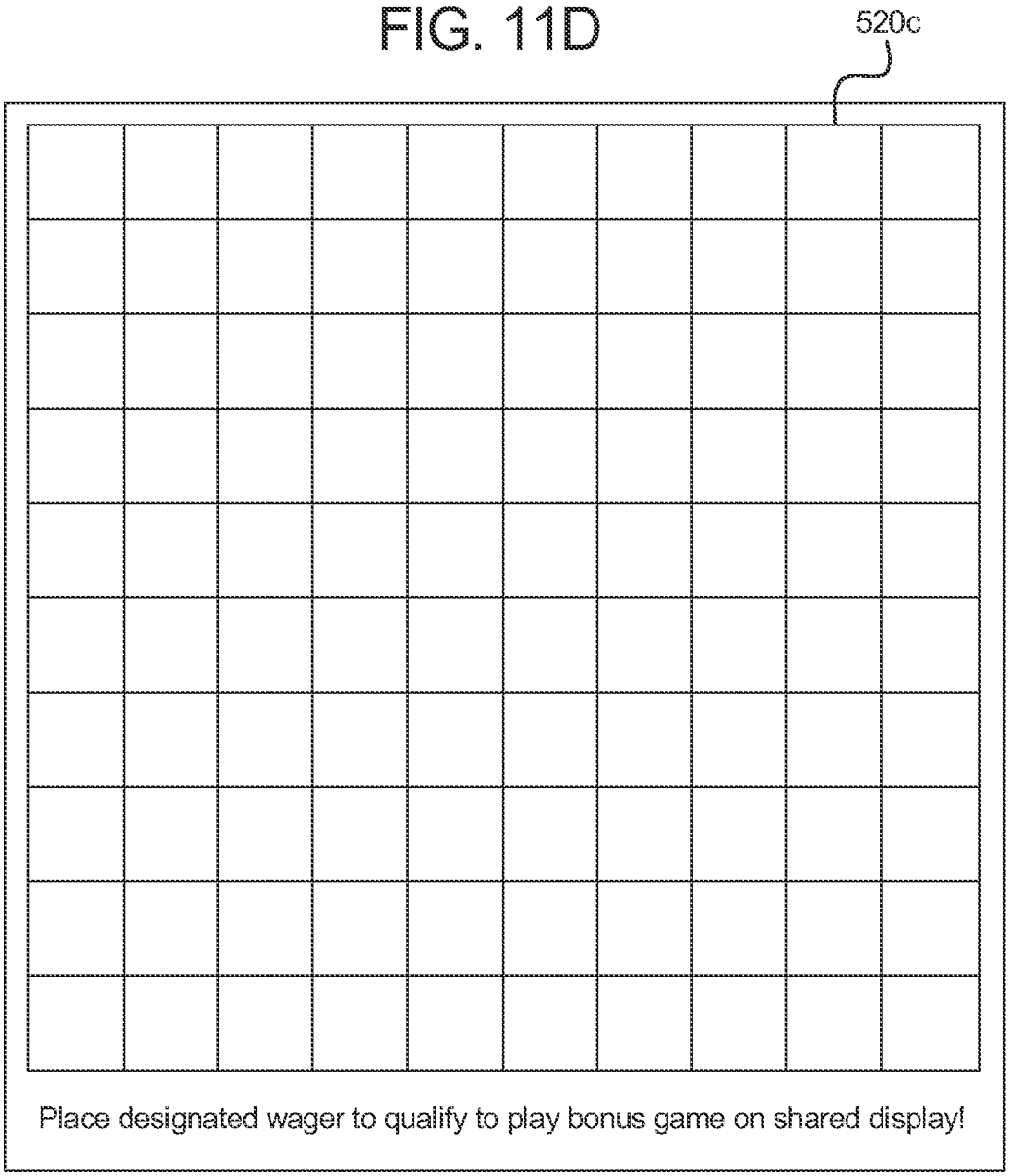
Figure 12B:
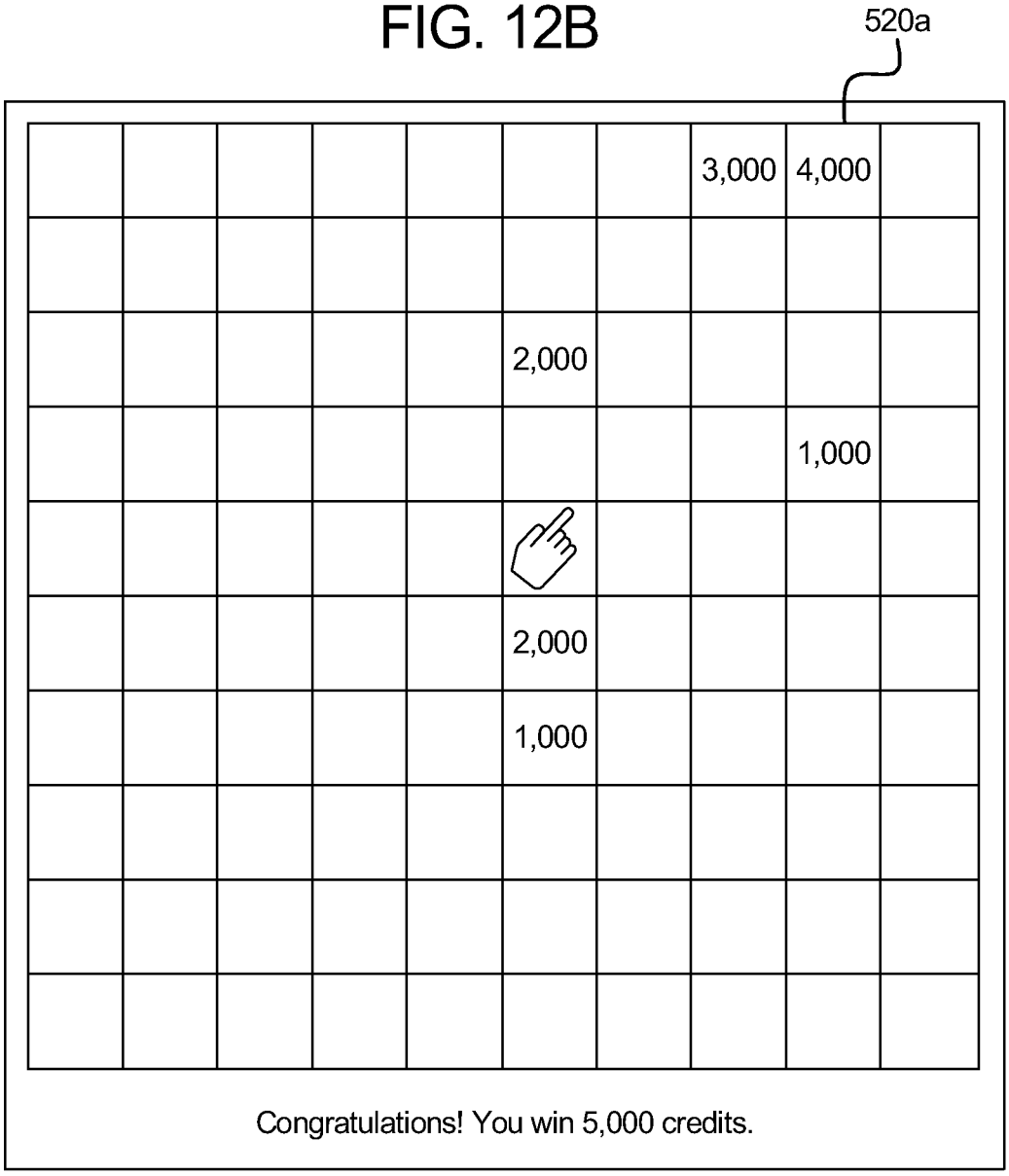
Figure 12C:
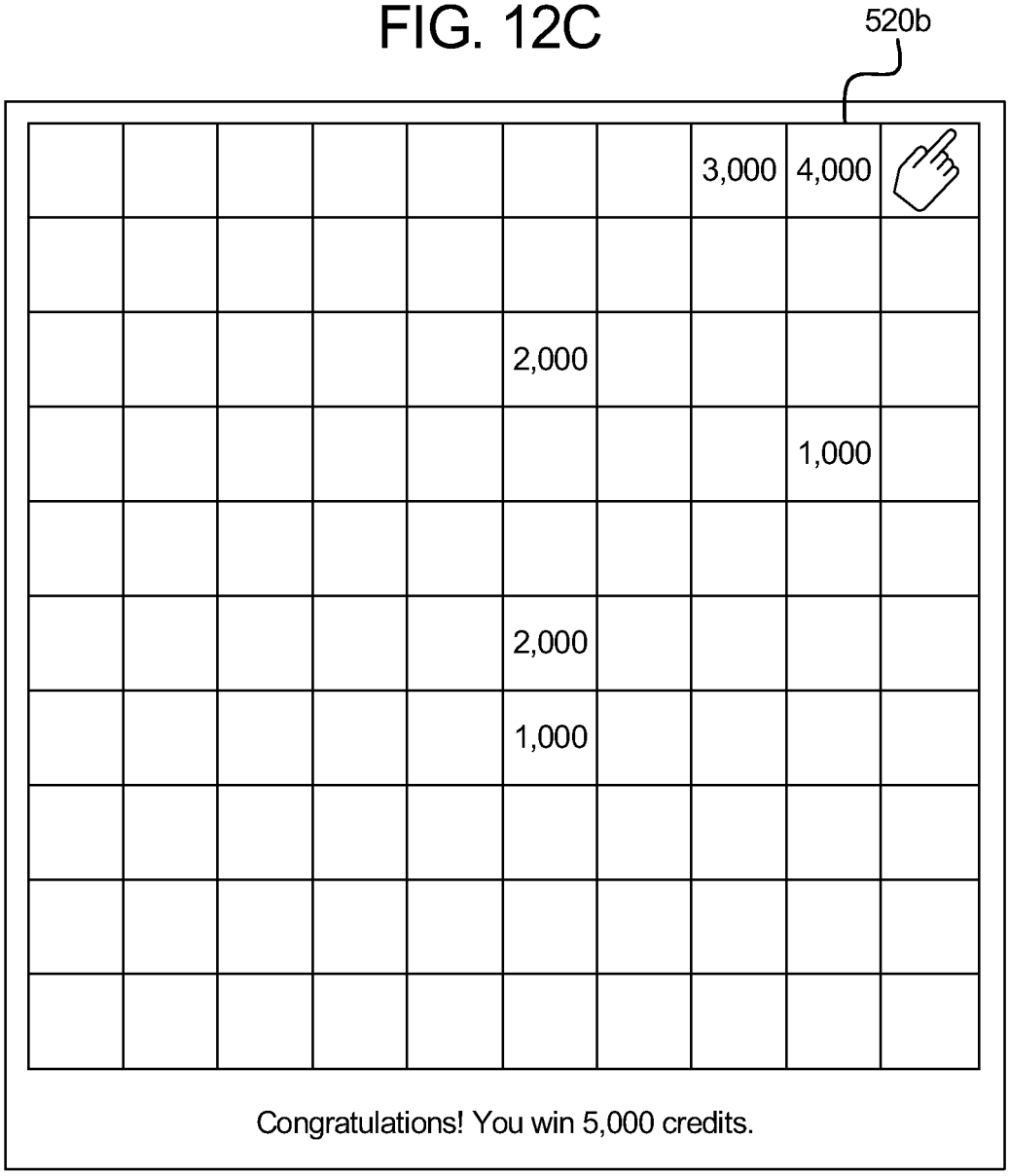
Figure 12D:
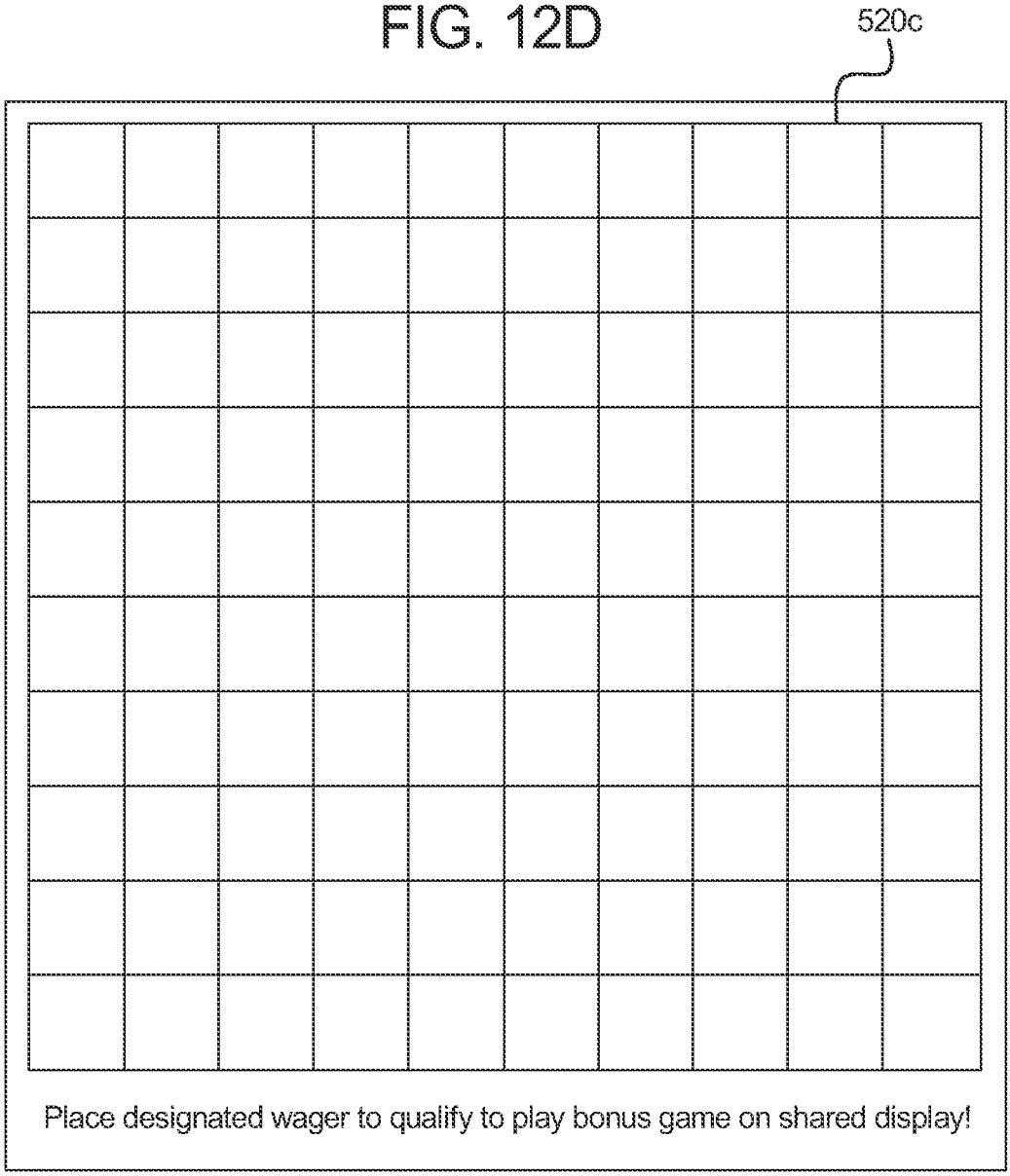

Referring now to FIGS. 8A and 8B, the secondary display 520*a* instructs players to place a designated wager if they want to be eligible for the persistence bonus game. Secondary displays 520*b* and 520*c* display the same as that displayed in FIG. 8B. Central display 500 displays two awards associated with the selection game, 2,000 credits and 1,000 credits, that have already been selected by other players. The persistence game carries on, independent of players coming and going from the gaming devices 510*a*, 510*b* and 510*c*. In this embodiment, one or more of the awards associated with the plurality of selectable positions change upon the occurrence of one or more designated triggering events. In this embodiment, changing an award means associating at least one selectable position which is associated with an award, but has already been selected, with a new award. It should be appreciated that in various other embodiments, changing an award associated with the selectable positions could include changing the award associated with at least one of the plurality of selectable positions that is already associated with an award and yet to be selected and associating an award with at least one selectable position which was not previously associated with an award.

In this embodiment, the designated triggering event that causes the changing of one or more awards is the selection of each of the plurality of positions. In various other such embodiments, the designated triggering event which causes one or more awards to change includes: (a) the entry of the selection game by one or more players; (b) the depletion of the sum of the awards associated with each of the plurality of positions below a designated amount; (c) the depletion of the total number of the plurality of positions associated with awards below a designated number; (d) the passage of a designated period (i.e., an amount of time); (e) a change in the available awards relative to the average expected value; and (f) any other suitable event.

Referring now to FIGS. 9A to 9D, a designated wager was made at gaming devices 510*a* and 520*a* making those gaming devices eligible for the bonus persistence game, as illustrated on respective secondary displays 520*a* and 520*b*. In this embodiment, upon being eligible for the persistence selection game, the gaming system provides each eligible player with three selections, as illustrated in FIGS. 9A to 9D. The gaming device ends each eligible player's play of the selection game when they run out of selections. In various other embodiments, when a player enters the selection game, the player may: (a) play the selection game for a designated period (i.e., amount of time); (b) play the selection game until no awards remain in the selection game; (c) play the selection game until selecting one or more designated selectable positions which cause the termination of that player's participation in the selection game; and (d) play the selection game according to any other suitable criteria.

In this embodiment, each of the secondary displays 520*a*, 520*b* and 520*c* are preferably touch screens and players make position selections by touching one of the plurality of selectable positions on their respective touch screen. Referring now to FIGS. 10A to 10D, for their first selection, the player playing gaming device 510*a* selects a position associated with 1,000 credits and thus, the gaming device provides the player with an award of 1,000 credits. As illustrated in FIGS. 10A to 10D, the award associated with this position is reflected on the central display 500, such that any of the players eligible for the selection game may use the award associated with the position to strategically make future position selections. The player playing gaming device 510*b* selected a position associated with an award of 3,000 credits for their first selection and thus the gaming device provided this player with an award of 3,000 credits. Similarly, the association of that selected position with an award of 3,000 credits is indicated on the central display 500, as indicated in FIGS. 10A to 10D.

The player playing gaming device 510*a* selects a position associated with an award of 2,000 credits for their second selection. Thus, the gaming device provides the player with an award of 2,000 credits and the gaming system indicates this selection on the central display 500, as illustrated in FIGS. 11A to 11D. The player playing gaming device 510*b* selects a position associated with an award of 4,000 credits for their second selection. Thus, the gaming device provides the player with an award of 4,000 credits and the gaming system indicates this selection on the central display 500, as illustrated in FIGS. 11A to 11D.

The player playing gaming device 510*a*, recognizing a pattern of increasing awards, selects a position associated with an award of 5,000 credits for their third selection. Thus, the gaming device provides the player with an award of 5,000 credits and the gaming system indicates this selection on the central display 500, as illustrated in FIGS. 12A to 12D. The player playing gaming device 510*b* also recognizing a pattern of increasing awards, selects a position associated with an award of 5,000 credits for their second selection. Thus, the gaming device provides the player with an award of 5,000 credits and the gaming system indicates this selection on the central display 500, as illustrated in FIGS. 12A to 12D.

This type of embodiment enables a player to participate in two preferably different games simultaneously, thereby enhancing their gaming experience. It should be appreciated that providing the player with gaming elements of the secondary game regardless of any event or outcome that occurs in the primary game increases the player's enjoyment and level of excitement, in particular in part because a positive component of the secondary game can be provided when a losing outcome in the primary game is provided and vice versa.

In various other such embodiments, selections in the secondary game are provided at a rate associated with the number of times the primary game is played. That is, at least one secondary game selection may be provided each time the primary game is played, every other time the primary game is played or based on any other suitable predetermined or randomly determined frequency of plays of the primary game.

In another embodiment, the persistence selection game is a secondary or bonus game and the awards in a suitable primary game are based on probability data, while the awards in the secondary or bonus game are part of at least one predetermined pool or set of predetermined awards. In the bonus game, as the gaming device provides each award to a player, the gaming device flags or removes the provided award from the predetermined set or pool. Once flagged or removed from the set or pool, the specific provided award from that specific pool cannot be provided to that or another player again.

In one such embodiment, the bonus game includes a plurality of award sets or pools each associated with a plurality of positions (i.e., awards associated with positions on different mines or islands). Once an area (i.e., mine or island) is running low on awards, the gaming device must close the area and replenish awards elsewhere in the bonus game (i.e., move players to another island; another planet; a parallel universe; another mine; etc., depending on game theme). For example, when the award set or pool associated with one location has a designated number of awards remaining, the gaming device in various embodiments: (a) lumps those awards into a progressive award or; (b) rolls those awards into another award set or pool associated with another location in the bonus game at which one or more players are or will be located.

For example, the bonus game could include three virtual islands each including a pool of 100 awards and a plurality of players could be located at a first of the three islands. Once the available awards on the first island reaches 10 awards, each of the players are transported to a second of the three islands, which includes a fresh 100 awards, and the total value of the 10 awards from the first island are lumped into a progressive award associated with the bonus game. In another variation, the 10 awards are added to the second island, meaning when the players are transported to the second island, the second island includes 110 awards.

In one such embodiment, the gaming device sends one or more players to a bonus area (i.e., island or universe) for a limited amount of time, the bonus area including its own plurality of positions and award set or pool.

In other such embodiments, one or more of the awards associated with the plurality of selectable positions change upon the occurrence of one or more designated triggering events. It should be appreciated that for purposes of these embodiments, changing the awards associated with the selectable positions includes, but is not limited to any or multiple of: (a) changing the award associated with at least one of the plurality of selectable positions that is already associated with an award and yet to be selected; (b) associating an award with at least one selectable position which was not previously associated with an award; (c) associating at least one selectable position which was associated with an award, but has been selected, with a new award; (d) increasing all awards by a predetermined amount; (e) multiplying all awards by a predetermined amount; (f) increasing each award by a randomly determined amount; (g) multiplying each award by a randomly determined amount; (h) inverting the value of award locations so that previously revealed (but not awarded) high award values are now low and previously revealed (but not awarded) low award values are now high; (i) regeneration of the entire game field; (j) any combination of these; and (k) any other suitable change.

In one embodiment, each of the plurality of positions in the persistence-type selection game could have an undefined "depth" and changing the award could include placing a plurality of awards at the positions beneath the vacancies created by awards which have already been selected and awarded to a player. In such embodiments, awards could continuously be placed below the vacancies unless the gaming system is prompted otherwise. For example, consider a position associated with an undefined number of virtual vertical positions. At the beginning of a play of the selection game, the first ten vertical positions from a top-most vertical position are associated with an award. Once awards associated with the first ten vertical positions have been provided, or upon the occurrence of any suitable triggering event, the positions below the initial ten positions (i.e., positions eleven to twenty) are associated with awards, and so on.

In various persistence-type embodiments, the plurality of selectable positions may be divided into a plurality of designated groups each including a designated number of positions and changing the awards includes replacing one or more of the designated groups with a replacement group having the same number of positions. In various such embodiments, the gaming device determines a replacement group to replace each designated group of positions by: (a) randomly associating awards with each of the positions in the replacement group; (b) selecting a replacement group from a plurality of predetermined replacement groups; (c) randomly selecting a replacement group from a plurality of predetermined replacement groups; and (d) determining a replacement group using any suitable method.

It should be appreciated that although in certain of the examples disclosed herein, the gaming device displays a plurality of positions topographically, in various other embodiments, the gaming device displays at least some portion of a play of the game in three dimensions.

It should be appreciated that in various embodiments in which players engage in group play, the game display includes: (a) a large central display; (b) a plurality of individual displays; (c) a large central display and a plurality of individual displays; (d) any combination of these; and (e) any other suitable displays. In one such embodiment, one or more players are not located at the same physical premises (such as via play in an online gaming environment).

It should be appreciated that the gaming device, gaming system and method disclosed herein in various embodiments includes single player configurations in which the gaming device controls additional fictitious players or avatars to make game play for a single player more interesting, integrating an element of competition.

In one embodiment, the gaming device includes an asynchronous mode which allows at least one player to make selections within a smaller period of time than that governing one or more other players' selections.

In one multi-player embodiment, the gaming device divides the game into multiple tiers of rounds where the top players from one round advance to a higher value round in a tournament ladder fashion. Such a tournament round could offer player versus player competition where awards are based on final tournament ranking. Non-advancing players would remain in the lowest level tier.

It should be appreciated that in various multi-player embodiments, the gaming system enables multiple players to play a selection game in different manners. For example, in one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

In various embodiments, instead of immediately revealing information regarding a selected position to one or more players, the information is suppressed. For example, in one embodiment, other players only see the award a player receives as a result of occupying a position, after the player leaves that position. Other players might notice that another player's avatar has not moved for a few turns and is therefore likely at an award-rich position. In another embodiment, information regarding one or more positions is suppressed for one turn, giving the original player located at the position one cycle worth of exclusivity. In one such example played in a team environment, that player's teammates all get immediate information about other teammates' positions that other players will not see for one turn.

In various embodiments, instead of awards, the gaming device awards players points. In such embodiments, players subsequently redeem the points for various awards.

It should be appreciated that although a variety of game themes were used in this disclosure, they were used for illustrative purposes. A variety of game themes may be implemented with the present invention (i.e., diving for treasures in a body of water; tomb raiding; a fishing tournament; carnival games, such as those involving darts and balloons; field of flowers; and picking rare, medium or well-done steaks off a grill.)

It should be appreciated that each of the foregoing examples are for illustrative purposes and that any of the features of any of the examples or other disclosure herein may be combined in any manner.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A method of operating a gaming system, said method comprising:

(a) causing at least one processor to execute a plurality of instructions stored in at least one memory device to operate with at least one display device to display a selection game having a plurality of positions, each of the positions being selectable;

(b) causing the at least one processor to execute the plurality of instructions to associate a plurality of awards with the positions, each of the awards having a value, each of the awards being masked such that the value of said award is not displayed, wherein, for each of a plurality of the awards, said award being associated with one of the positions, said award has a relationship to one or more of the awards associated with the positions bordering said position such that when said position is selected, the value of said award provides certain information which can be subsequently used to make better informed decisions regarding one or more subsequent position selections;

(c) causing the at least one processor to execute the plurality of instructions to operate with at least one input device to enable a first player to select one of the positions;

(d) causing the at least one processor to execute the plurality of instructions to determine if the first player's selected position is associated with an award;

(e) if the first player's selected position is associated with an award, causing the at least one processor to execute the plurality of instructions to operate with the at least one display device to unmask said award and display the value of said award;

(f) causing the at least one processor to execute the plurality of instructions to operate with the at least one input device to enable a second player to select another one of the positions using the information provided by the value of the award associated with the first player's selected position;

(g) causing the at least one processor to execute the plurality of instructions to determine if the second player's selected position is associated with an award; and (h) if the second player's selected position is associated with an award, causing the at least one processor to execute the plurality of instructions to operate with the at least one display device to unmask said award and display the value of said award.

2. The method of claim 1, wherein for at least one selected position, the information provided by the value of the award associated with said selected position includes one or more of: (a) information enabling an inference of the value of one or more awards associated with one or more positions bordering said selected position; (b) information enabling an inference of the value of one or more awards associated with one or more other of the positions; (c) information enabling an inference of whether one or more positions bordering said selected position are associated with any awards; and (d) information regarding other awards associated with said selected position.

3. The method of claim 1, wherein the selection game includes a plurality of clusters of the positions, each cluster including a plurality of, but less than all of, the positions.

4. The method of claim 3, wherein the awards associated with the positions in each of said clusters are interdependently related awards in that, for each of the clusters, for each position in said cluster associated with one of the awards, said award has a relationship to one or more of the awards associated with the positions bordering said position.

5. The method of claim 3, wherein one or more clusters of positions associated with interdependently related awards is bordered or surrounded by a plurality of positions not associated with awards.

6. The method of claim 1, which includes causing the at least one processor to execute the plurality of instructions to operate with the at least one input device and the at least one display device to provide the selection game concurrent with a primary game.

7. The method of claim 1, wherein at least one restriction is placed on one or more selections of the positions, the at least one restriction including at least one of: (a) limiting one or more of the players to a designated amount of time to make each selection; (b) limiting a total number of positions between a selected position and a subsequently selected position; (c) limiting an amount of time a player indicator remains at each position; and (d) limiting a number of turns a player indicator remains at each position.

8. The method of claim 1, wherein the awards associated with the positions include at least one of: (a) a number of credits; (b) a number of free spins or activations; (c) a number of activations or plays of a bonus game; (d) a number of selections; (e) a physical prize; (f) promotional points; (g) player tracking points; (h) money; (i) an increase or decrease in an amount of additional time remaining in the selection game; (j) an increase or decrease in a range in which a player may select a position relative to a last selected position; and (k) an increase or decrease in a multiplier that applies to all awards.

9. The method of claim 1, wherein one or more of the positions is associated with one or more of: (a) a plurality of awards; (b) a plurality of levels; (c) an award value; (d) information; (e) a terminating symbol; and (f) a modifier.

10. The method of claim 1, which includes causing the at least one processor to execute the plurality of instructions to operate with the at least one input device to enable a plurality of players to select at least one of the positions, and wherein information obtained from the first player's position selection provides information to at least one of the other players which can be used to make better informed decisions regarding one or more subsequent position selections.

11. The method of claim 10, which includes causing the at least one processor to execute the plurality of instructions to operate with the at least one input device to enable the plurality of players to make position selections in an alternating manner.

12. The method of claim 1, which is provided through a data network.

13. The method of claim 12, wherein the data network is an internet.

14. A method of operating a gaming system, said method comprising:

(a) causing at least one processor to execute a plurality of instructions stored in at least one memory device to operate with at least one display device to display a primary game;

(b) if a designated event occurs, causing the at least one processor to execute the plurality of instructions to enable entry into a selection game having a plurality of positions which is played concurrently with the primary game until a terminating event occurs, each of the positions being selectable, wherein:

(i) a plurality of the positions are associated with awards, each of the awards having a value, each of the awards being masked such that the value of said award is not displayed; and (ii) for each of a plurality of the awards, said award being associated with one of the positions, said award has a relationship to one or more of the awards associated with the positions bordering said position such that when said position is selected, the value of said award provides certain information which can be subsequently used to make better informed decisions regarding one or more subsequent position selections; and (c) causing the at least one processor to execute the plurality of instructions to operate with at least one input device to enable selection of a plurality of the positions and, for each of the selected positions that is associated with one of the awards, operate with the at least one display device to unmask said award and display the value of said award.

15. The method of claim 14, wherein the designated event is an event selected from the group consisting of: (a) a passage of a designated time interval; (b) a receipt of a bonus award associated with the primary game; and (c) a placement of a designated wager on the primary game.

16. The method of claim 14, which includes, when a player enters the selection game, causing the at least one processor to execute the plurality of instructions to operate with the at least one input device and the at least one display device to enable the player to at least one of: (a) play the selection game for a designated amount of time; (b) make a designated number of selections; (c) play the selection game until no awards remain in the selection game; and (d) play the selection game until the player selects one or more designated positions which cause the termination of that player's participation in the selection game.

17. The method of claim 14, wherein the awards associated with each of the positions in the selection game do not change and the terminating event is the selection of each of the awards associated with the positions by one or more players.

18. The method of claim 14, wherein for at least one selected position, the information provided by the value of the award associated with said selected position includes one or more of: (a) information enabling an inference of the value of one or more awards associated with one or more positions bordering said selected position; (b) information enabling an inference of the value of one or more awards associated with one or more other of the positions; (c) information enabling an inference of whether one or more of the positions bordering said selected position are associated with any awards; and (d) information regarding other awards associated with said selected position.

19. The method of claim 14, wherein the selection game includes one or more clusters of the positions, wherein each cluster includes a plurality, but less than all, of the positions.

20. The method of claim 19, wherein the awards associated with the positions in said clusters are interdependently related awards in that, for each of the clusters, for each position in said cluster associated with one of the awards, said award has a relationship to one or more of the awards associated with the positions bordering said position.

21. The method of claim 14, which includes causing the at least one processor to execute the plurality of instructions to operate with the at least one input device and the at least one display device to enable a player to play the selection game at a time selected from the group consisting of: (a) simultaneously with the primary game; (b) after the primary game; and (c) while the primary game is paused.

22. The method of claim 14, wherein at least one restriction is placed on one or more selections of the positions, the at least one restriction including at least one of: (a) limiting each player to a designated amount of time to make each selection; (b) limiting a total number of positions between a selected position and a subsequently selected position; (c) limiting an amount of time each player remains at each position; and (d) limiting a number of turns each player remains at each position.

23. The method of claim 14, wherein the awards associated with the positions include at least one of: (a) a number of credits; (b) a number of free spins or activations; (c) a number of activations or plays of a bonus game; (d) a number of selections; (e) a physical prize; (f) promotional points; (g) player tracking points; (h) money; (i) an increase or decrease in an amount of additional time remaining in the selection game; (j) an increase or decrease in a range in which a player may select a position relative to a last selected position; and (k) an increase or decrease in a multiplier that applies to all awards.

24. The method of claim 14, wherein in addition to or instead of an award, one or more of the positions is associated with: (a) a plurality of awards; (b) a plurality of levels; (c) an award value; (d) information; (e) a terminating condition or event; and (f) a modifier.

25. The method of claim 14, which includes causing the at least one processor to execute the plurality of instructions to operate with the at least one input device and the at least one display device to enable a plurality of players to play the selection game, wherein information obtained from a first player's position selection provides information to at least one of the other players which can be used to make better informed decisions regarding one or more subsequent position selections.

26. The method of claim 25, which includes causing the at least one processor to execute the plurality of instructions to operate with the at least one input device and the at least one display device to enable the plurality of players to make position selections in an alternating manner.

27. The method of claim 14, which is provided through a data network.

28. The method of claim 27, wherein the data network is an internet.

29. A method of operating a gaming system, said method comprising:

(a) causing at least one processor to execute a plurality of instructions stored in at least one memory device to operate with at least one display device to display a selection game having a plurality of positions, each of the positions being selectable;

(b) causing the at least one processor to execute the plurality of instructions to associate a plurality of awards with the positions, each of the awards having a value, each of the awards being masked such that the value of said award is not displayed, wherein:

(i) for each of a plurality of the awards, said award being associated with one of the positions, said award has a relationship to one or more of the awards associated with the positions bordering said position such that when said position is selected, the value of said award provides certain information which can be subsequently used to make better informed decisions regarding one or more subsequent position selections; and (ii) no two bordering positions of a first plurality of the positions are associated with respective awards having values which differ by more than a designated amount, wherein the designated amount is the difference between an amount of a largest award value and a smallest award value associated with said first plurality of the positions;

(c) causing the at least one processor to execute the plurality of instructions to operate with at least one input device enable a player to select a second plurality of the positions; and (d) for each selected position associated with one of the awards, causing the at least one processor to execute the plurality of instructions to operate with the at least one display device to unmask said award and display the value of said award, wherein the information provided by said value enables the player to make better informed subsequent selections of one or more of the positions.

30. The method of claim 29, wherein for at least one selected position, the information provided by the value of the award associated with said selected position includes one or more of: (a) information enabling an inference of the value of one or more awards associated with one or more positions bordering said selected position; (b) information enabling an inference of the value of one or more awards associated with one or more other of the positions; (c) information enabling an inference of whether one or more positions bordering said selected position are associated with any awards; and (d) information regarding other awards associated with said selected position.

31. The method of claim 29, wherein the selection game includes one or more clusters of the positions, each cluster including a plurality, but less than all, of the positions.

32. The method of claim 31, wherein the awards associated with the positions in said clusters are interdependently related awards in that, for each of the clusters, for each position in said cluster associated with one of the awards, said award has a relationship to one or more of the awards associated with the positions bordering said position.

33. The method of claim 31, wherein one or more clusters of positions associated with interdependently related awards is bordered or surrounded by a plurality of positions not associated with awards.

34. The method of claim 29, wherein at least one restriction is placed on one or more selections of the positions, the at least one restriction including at least one of: (a) limiting each player to a designated amount of time to make each selection; (b) limiting a total number of positions between a selected position and a subsequently selected position; (c) limiting an amount of time each player remains at each position; and (d) limiting a number of turns each player remains at each position.

35. The method of claim 29, wherein the awards associated with the plurality of positions include at least one of: (a) a number of credits; (b) a number of free spins or activations; (c) a number of activations or plays of a bonus game; (d) a number of selections; (e) a physical prize; (f) promotional points; (g) player tracking points; (h) money; (i) an increase or decrease in an amount of additional time remaining in the selection game; (j) an increase or decrease in a range in which a player may select a position relative to a last selected position; and (k) an increase or decrease in a multiplier that applies to all awards.

36. The method of claim 29, wherein in addition to or instead of an award, one or more of the positions is associated with: (a) a plurality of awards; (b) a plurality of levels; (c) an award value; (d) information; (e) a terminating condition; and (f) a modifier.

37. The method of claim 29, wherein the designated amount is less than a difference between an amount of a largest award value and a smallest award value associated with the positions.

38. The method of claim 29, wherein the selection game includes a plurality of different groups of positions, and wherein for each of the groups of positions, no two bordering positions within said group of positions are associated with respective awards which differ by more than a designated amount.

39. The method of claim 29, which is provided through a data network.

40. The method of claim 39, wherein the data network is an internet.

41. A method of operating a gaming system, said method comprising:

(a) causing at least one processor to execute a plurality of instructions stored in at least one memory device to operate with at least one display device to display a selection game having a plurality of selectable positions;

(b) causing the at least one processor to execute the plurality of instructions to associate a plurality of awards with the selectable positions, each of the awards having a value, each of the awards being masked such that the value of said award is not displayed, such that each of a plurality of the awards has a relationship to one or more of the awards associated with the positions bordering said position such that when each of the positions is selected, the value of the award of said position which is displayed provides certain information which can be subsequently used to make better informed position selections, wherein the certain information includes locality information related to the locations of one or more awards;

(c) causing the at least one processor to execute the plurality of instructions to operate with at least one input device to enable a first player to select one of said plurality of positions;

(d) causing the at least one processor to execute the plurality of instructions to determine if the first player's selection is associated with an award;

(e) causing the at least one processor to execute the plurality of instructions to operate with the at least one display device to display any award associated with the first player's selection;

(f) causing the at least one processor to execute the plurality of instructions to operate with the at least one input device to enable a second player to select one of the plurality of selections based on information associated with the first player's selection;

(g) causing the at least one processor to execute the plurality of instructions to determine if the second player's selection is associated with an award; and (h) causing the at least one processor to execute the plurality of instructions to operate with the at least one display device to display any award associated with the second player's selection.

42. The method of claim 41, which is provided through a data network.

43. The method of claim 42, wherein the data network is an internet.

44. A method of operating a gaming system, said method comprising:

(a) causing at least one processor to execute a plurality of instructions stored in at least one memory device to operate with at least one display device to display a selection game having a plurality of selectable positions;

(b) causing the at least one processor to execute the plurality of instructions to associate a plurality of awards with the selectable positions, each of the awards having a value, each of the awards being masked such that the value of said award is not displayed, such that each of a plurality of the awards has a relationship to one or more of the awards associated with the positions bordering said position such that when each of the positions is selected, the value of the award of said position which is displayed provides certain information which can be subsequently used to make better informed position selections, wherein the certain information includes locality information related to the directions of one or more positions associated with an award from the selected position;

(c) causing the at least one processor to execute the plurality of instructions to operate with at least one input device to enable a first player to select one of said plurality of positions;

(d) causing the at least one processor to execute the plurality of instructions to determine if the first player's selection is associated with an award;

(e) causing the at least one processor to execute the plurality of instructions to operate with the at least one display device to display any award associated with the first player's selection;

(f) causing the at least one processor to execute the plurality of instructions to operate with the at least one input device to enable a second player to select one of the plurality of selections based on information associated with the first player's selection;

(g) causing the at least one processor to execute the plurality of instructions to determine if the second player's selection is associated with an award; and (h) causing the at least one processor to execute the plurality of instructions to operate with the at least one display device to display any award associated with the second player's selection.

45. The method of claim 44, which is provided through a data network.

46. The method of claim 45, wherein the data network is an internet.

47. A method of operating a gaming system, said method comprising:

(a) causing at least one processor to execute a plurality of instructions stored in at least one memory device to operate with at least one display device to display a primary game;

(b) if a designated event occurs, causing the at least one processor to execute the plurality of instructions to enable entry into a selection game having a plurality of selectable positions which is played concurrently with the primary game until a terminating event occurs, wherein a plurality of the selectable positions are associated with awards, each of the awards having a value, wherein each of a plurality of the awards has a relationship to one or more of the awards associated with the positions bordering such position such that when each of the positions is selected, the value of the award which is displayed provides certain information which can be subsequently used to make better informed subsequent position selections;

(c) causing the at least one processor to execute the plurality of instructions to operate with at least one input device to enable selection of a plurality of the positions and, for each of the selected positions, operate with the at least one display device to display the value of any award associated with the position;

(d) causing the at least one processor to execute the plurality of instructions to change one or more of the awards associated with the plurality of selectable positions upon the occurrence of one or more designated triggering events; and (e) causing the at least one processor to execute the plurality of instructions to operate with the at least one display device to display any awards associated with the plurality of selected positions.

48. The method of claim 47, which is provided through a data network.

49. The method of claim 48, wherein the data network is an internet.

50. A method of operating a gaming system, said method comprising:

(a) causing at least one processor to execute a plurality of instructions stored in at least one memory device to operate with at least one display device to display a primary game;

(b) if a designated event occurs, causing the at least one processor to execute the plurality of instructions to enable entry into a selection game having a plurality of selectable positions which is played concurrently with the primary game until a terminating event occurs, wherein a plurality of the selectable positions are associated with awards, each of the awards having a value, wherein each of a plurality of the awards has a relationship to one or more of the awards associated with the positions bordering such position such that when each of the positions is selected, the value of the award which is displayed provides certain information which can be subsequently used to make better informed subsequent position selections;

(c) causing the at least one processor to execute the plurality of instructions to operate with at least one input device to enable selection of a plurality of the positions and, for each of the selected positions, operate with the at least one display device to display the value of any award associated with the position;

(d) causing the at least one processor to execute the plurality of instructions to change one or more of the awards associated with the plurality of selectable positions upon the occurrence of one or more designated triggering events by at least one of:

(i) changing the award associated with at least one of the plurality of selectable positions that is already associated with an award and yet to be selected;

(ii) associating an award with at least one selectable position which was not previously associated with an award;

(iii) associating at least one selectable position which has already been selected with a new award; and (iv) associating awards with a position including a plurality of levels, some of which were associated with awards which have been provided to a player; and (e) causing the at least one processor to execute the plurality of instructions to operate with the at least one display device to display any awards associated with the plurality of selected positions.

51. The method of claim 50, which is provided through a data network.

52. The method of claim 51, wherein the data network is an internet.

53. A method of operating a gaming system, said method comprising:

(a) causing at least one processor to execute a plurality of instructions stored in at least one memory device to operate with at least one display device to display a primary game;

(b) if a designated event occurs, causing the at least one processor to execute the plurality of instructions to enable entry into a selection game having a plurality of selectable positions which is played concurrently with the primary game until a terminating event occurs, wherein a plurality of the selectable positions are associated with awards, each of the awards having a value, wherein each of a plurality of the awards has a relationship to one or more of the awards associated with the positions bordering such position such that when each of the positions is selected, the value of the award which is displayed provides certain information which can be subsequently used to make better informed subsequent position selections;

(c) causing the at least one processor to execute the plurality of instructions to operate with at least one input device to enable selection of a plurality of the positions and, for each of the selected positions, operate with the at least one display device to display the value of any award associated with the position;

(d) causing the at least one processor to execute the plurality of instructions to change one or more of the awards associated with the plurality of selectable positions upon the occurrence of one or more designated triggering events by at least one of:

(i) changing the award associated with at least one of the plurality of selectable positions that is already associated with an award and yet to be selected;

(ii) associating an award with at least one selectable position which was not previously associated with an award;

(iii) associating at least one selectable position which has already been selected with a new award; and (iv) associating awards with a position including a plurality of levels, some of which were associated with awards which have been provided to a player, wherein the designated triggering event includes:

(i) an entry or exit of the selection game by one or more players;

(ii) a depletion of the sum of the awards associated with each of the plurality of positions below a designated amount;

(iii) a depletion of the total number of the plurality of positions associated with awards below a designated number;

(iv) a passage of a designated amount of time; and (v) a change in the available awards relative to the average expected value; and (e) causing the at least one processor to execute the plurality of instructions to operate with the at least one display device to display any awards associated with the plurality of selected positions.

54. The method of claim 53, which is provided through a data network.

55. The method of claim 54, wherein the data network is an internet.

* * * * *